US005154411A

United States Patent [19]

Saito et al.

[11] Patent Number: 5,154,411

[45] Date of Patent: Oct. 13, 1992

[54] IMAGE FORMING APPARATUS

[75] Inventors: Jun Saito, Kawasaki; Tomoyuki Araki, Tokyo; Hironori Shido, Kawasaki; Junichi Kimizuka, Yokohama; Toshiyuki Itoh, Sagamihara; Kaoru Sato, Yokohama; Toshihiko Inuyama, Fujisawa, all of Japan

[73] Assignee: Canon Kabushiki Kaisha, Tokyo, Japan

[21] Appl. No.: 860,245

[22] Filed: Mar. 27, 1992

Related U.S. Application Data

[63] Continuation of Ser. No. 400,770, Aug. 30, 1989, abandoned.

[30] Foreign Application Priority Data

| | | | |
|---|---|---|---|
| Sep. 1, 1988 | [JP] | Japan | 63-219882 |
| Sep. 1, 1988 | [JP] | Japan | 63-219883 |
| Nov. 16, 1988 | [JP] | Japan | 63-289824 |
| Dec. 28, 1988 | [JP] | Japan | 63-330813 |
| Dec. 28, 1988 | [JP] | Japan | 63-330814 |
| Jan. 20, 1989 | [JP] | Japan | 1-011552 |

[51] Int. Cl.[5] ..... B65H 29/60

[52] U.S. Cl. ..... 271/289; 271/296

[58] Field of Search ..... 271/289, 296

[56] References Cited

U.S. PATENT DOCUMENTS

| | | | |
|---|---|---|---|
| 3,372,922 | 3/1968 | Snellman | 271/296 |
| 4,170,349 | 10/1979 | Baumann et al. | 271/296 |
| 4,344,614 | 8/1982 | Kaneko | 271/296 X |
| 4,352,490 | 10/1982 | Hatakeyama | 271/289 |
| 4,498,665 | 2/1985 | Watanabe | 271/289 |
| 4,576,371 | 3/1986 | Takahashi | 271/296 |
| 4,733,857 | 3/1988 | Feldeisen | 261/296 |

FOREIGN PATENT DOCUMENTS

| | | |
|---|---|---|
| 0259829 | 3/1988 | European Pat. Off. . |
| 2007627 | 5/1979 | United Kingdom . |

OTHER PUBLICATIONS

Patent Abstracts of Japan, vol. 9, No. 236 (P-390) (1959), Sep. 21, 1985.

*Primary Examiner*—Richard A. Schacher

*Attorney, Agent, or Firm*—Fitzpatrick, Cella, Harper & Scinto

[57] ABSTRACT

An image forming apparatus having a sorter, includes a plurality of bins for accommodating sheet materials, the bin each having sheet material sheet inlet portion, a discharging device movable along the inlet portions of the bins to discharge the sheet material to selected one of the bins, a sheet material accommodating tray other than the bins to accommodate the sheet materials, a guiding device switchable to direct the sheet material selectively to the bin or to the sheet material accommodating tray, and a device for switching the guiding device to direct the sheet material to the discharging device when the discharging device is at a position for discharging the sheet material to the bin, and the sheet material to the accommodating device when the discharging device is not at the position.

23 Claims, 42 Drawing Sheets

IMAGE FORMING APPARATUS

This application is a continuation of application Ser. No. 07/400,770 filed Aug. 30, 1989, now abandoned.

FIELD OF THE INVENTION AND RELATED ART

The present invention relates generally to an image forming apparatus such as a copying machine or a laser beam printer, equipped with a sorter for sorting the sheets discharged from the image forming apparatus into bins, more particularly to a sheet sorter usable with such an image forming apparatus.

An image forming apparatus is known which is equipped with a sorter for sorting the sheets discharged from the image forming apparatus into bins. In such an image forming apparatus, the sheet discharged from the image forming apparatus is conveyed to the sorter by a swingable conveying belt and is accommodated in a bin. When the sheet is discharged to and accommodated on a discharge tray of the image forming apparatus, the conveying belt is swung to its retracted position so as to not interfere with the sheet to the discharge tray (Japanese Patent Application Publication No. 2863/1983).

This type of image forming apparatus involves drawbacks of complicated structure and high cost because of the necessity for a provision of swingable conveying belt.

In one of conventional image forming apparatuses, a sorter attached thereto includes fixed bins for accommodating the sorted sheets. In such an apparatus, the distance from the sheet inlet of the sorter to the most distant bin is longer than the sheet, and therefore, various proposals have been made as to the sorter provided with intermediate conveying means disposed halfway of the conveying passage. For example, Japanese Patent Application Publication No. 7969/1975 proposes that a pair of belts is provided in the conveyance passage, by which the sheet is gripped and conveyed; Japanese Patent Application Publication 39516/1980 discloses that the sheet is vacuum-attracted by a perforation belt; and Japanese Laid-Open Patent Application 130858/1983 proposes that the sheets are conveyed and sorted using a number of conveying roller couples and flappers disposed correspondingly to the respective bins.

Any of the above proposals results in bulky and complicated structures of the apparatus. In order to solve these problems, a proposal has been made in Japanese Patent Application Publication 43497/1982 wherein a distance from the sorter inlet to a discharging means is shorter than the length of the sheet measured along the sheet conveyance, and the bins accommodate the sheets substantially vertically. However, since the sheet is accommodated substantially vertically, flexible sheets are easily bent, and if a curled sheet is received, the order of the sheets may be disturbed.

Japanese Laid-Open U.M. Application No. 105982/1987 proposes that a pair of discharging rollers constituting a carriage which grips a sheet received by the inlet, and the carriage gripping the sheet moves to a bin and distributes it to the bin. However, since the time is required for returning the carriage, it is not suitable for a high speed image forming apparatus.

SUMMARY OF THE INVENTION

Accordingly, it is a principal object of the present invention to provide an image forming apparatus equipped with a sheet sorter wherein the sheet discharging directions can be switched without particular driving mechanism.

According to an aspect of the present invention, there is provided an image forming apparatus comprising a number of bins for receiving sorted sheets, discharging means for discharging the sheets to the bins, guiding means for guiding the sheets to the discharging means or to sheet accommodating means other than the sorting bins, switching means for switching the guiding means, wherein the bin or discharging means is substantially vertically movable relative to a main assembly of the sheet sorter, and wherein when the bin is at a sheet receiving position or when the discharging means is at a sheet discharging position, said switching means switches said guiding means to guide the sheet to the discharging means, whereas when the bin is at non-receiving position or when the discharging means is at non-discharging position, said switching means switches the guiding means to guide the sheet to the sheet accommodating means.

According to this aspect of the present invention, when the bin is at the sheet receiving position or when the discharging means is at the sheet-discharging position, the switching means switches the guiding means to guide the sheet into the sheet sorter, whereas when the bin is at non-receiving position or when the discharging means is at the non-discharging position, the switching means switches the guiding means to guide the sheet to the sheet accommodating means (other than the bin), and, therefore, the special driving means is not required thus simplifying the structure and reducing the cost.

It is another object of the present invention to provide a sheet sorter having a simple structure and usable with a high speed image forming apparatus. According to another aspect of the present invention, there is provided a sheet sorter comprising a number of bins for accommodating sorted sheets, substantially vertically movable discharging means for discharging the sheet receives into the bin, a discharge passage for guiding the sheet to the discharging means, wherein the discharging passage is constituted by a first guiding member fixed to the main assembly of the sorter and a second guiding member movable together with the discharging means.

According to this aspect of the present invention, the discharging passage is constituted by the first guiding means fixed to the main assembly and the second guiding member movable together with the discharging means, and, therefore, the sheet is assuredly guided even if the discharging means is moved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
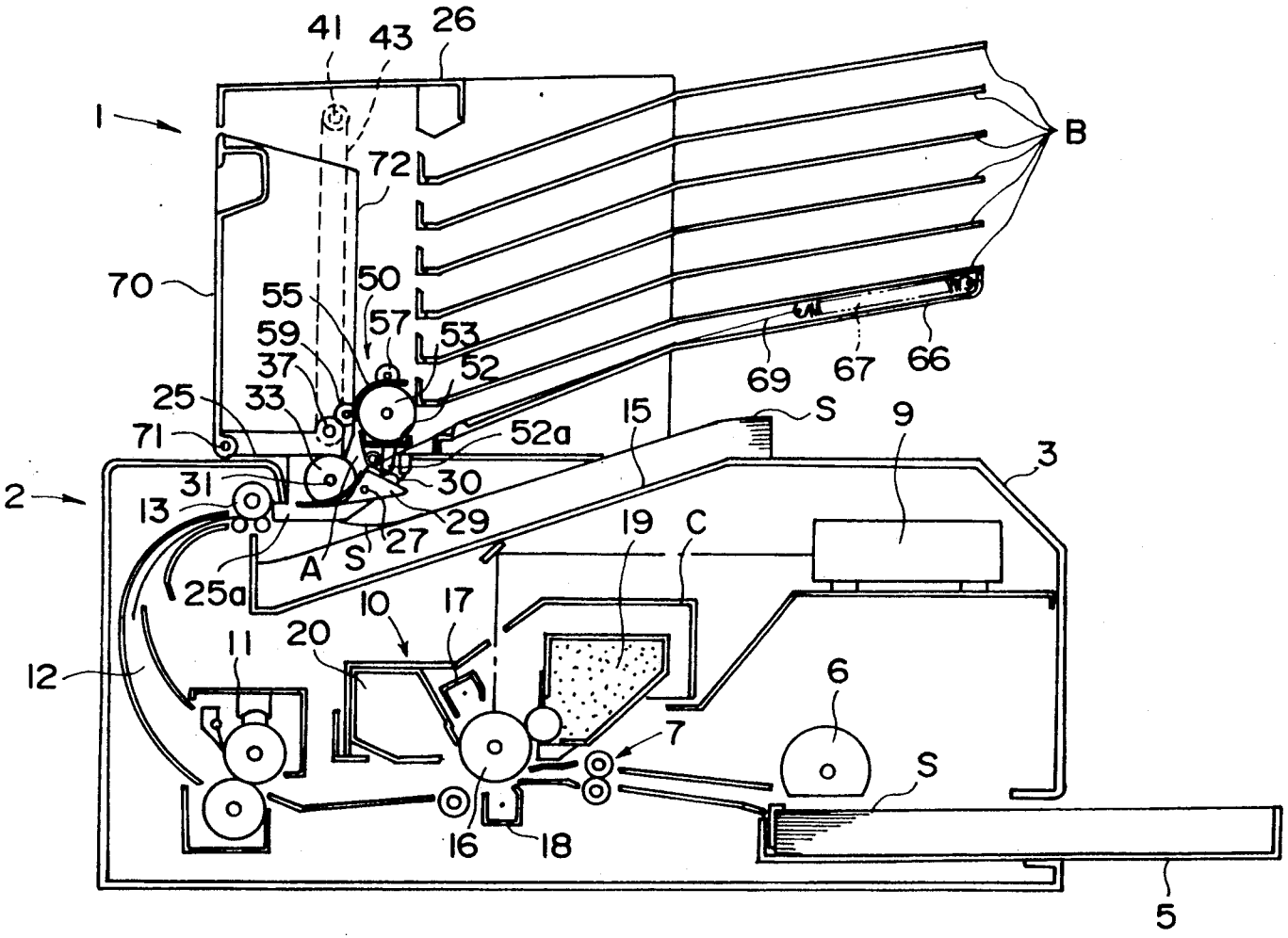
FIG. 1 is a front sectional view of a sheet sorter according to an embodiment of the present invention.
Figure 2:
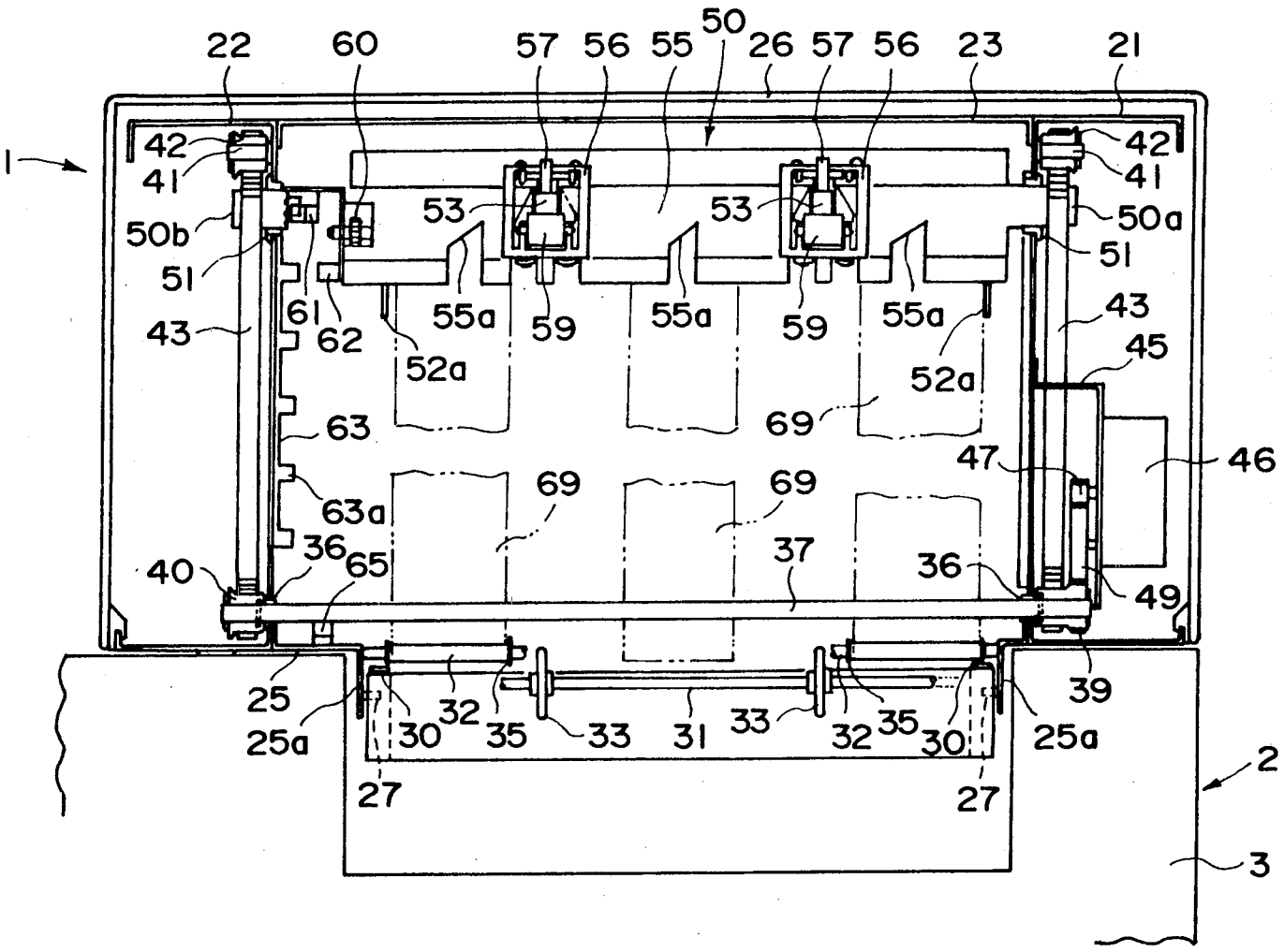
FIG. 2 is a side sectional view of the sorter of FIG. 1.

Referring to FIGS. 1 and 2, there is shown an image forming apparatus according to an embodiment of the present invention, wherein a sorter 1 is mounted on a laser beam printer 2 which is an exemplary image forming apparatus. The sorter functions to sort and accommodate the sheets discharged from the laser beam printer 2. The laser beam printer 2 is equipped with a cassette 5 which is detachably mountable to the main assembly 3 of the laser beam printer 2. The cassette 5 is provided with a pair of sheet feeding rollers for feeding the sheet S out of the cassette 5. Downstream of the rollers 6, there is disposed a registration roller pair 7. Downstream of the rollers 7, an image forming station 10 is disposed where an image is formed in accordance with a laser signal supplied from a laser scanner 9. Downstream of the image forming station 10, an image fixing device 10 is disposed. A U-shaped conveying passage 12 is disposed downstream of the fixing device 11. At the downstream end of the passage 12, discharging rollers 13 are provided, and the downstream of the rollers 13, a sheet discharging tray 15 is disposed which also constitutes a top cover of the main assembly 3. The image forming station 10 is provided with a cylindrical photosensitive drum 16. Around the drum 16, there are a primary charger 17, a developing device 19, a transfer charger 18 and a cleaner 20. Those elements other than the transfer charger 18 are accommodated in a process cartridge C.

The sorter 1 has a channel shaped side plates 21 and 22. An upper stay is bridged between the side plates 21 and 22, and a bottom stay 25 is extended between the same. The side plates 21 and 22 and the stays 23 and 25 are covered with an outer casing 26 to constitute the main assembly. A part of the bottom stay 25 is extended downwardly to constitute opposite extensions 25*a* and 25*a*. Shafts 27 are fixed to the extensions 25*a* and 25*a*, respectively. A flapper 29 is rotatably supported by the shafts 27 and 27. At opposite ends, leaf springs 30 are fixed to the flapper 29. To the extensions 25*a* and 25*a*, shafts 31 and 32 are fixed extending parallel to each other. The shaft 31 rotatably supports a roller 33, and the shaft 32 rotatably supports a guiding roller 35. To the side plate 21 and 22, bearings 36 are fixed.

The bearings 36 and 36 rotatably support a shaft 37 which has at its one end a pulley 39 provided with a gear and at the other end a pulley 40. At upper portions of the side plates 21 and 22, a shaft 41 is fixed, to which a pulley 42 is rotatably supported. Around the pulleys 42 and 39, a timing belt 43 is stretched, and around the pulleys 42 and 40, a timing belt 43 is stretched. The side plate 21 is provided with a motor supporting table 45, to which a motor 46 is fixedly secured. To a shaft of a motor 46 a gear 47 is fixed which is meshed with the gear of the pulley 39 to an idling gear 49.

The timing belts 43 and 43 carry a sheet discharge unit 50. The unit 50 has a right end portion 50*a* engaged with a vertically movable guiding member 51 along an unshown elongated slot formed in the side plate 21, and has a left end portion 50*b* engaged with a vertically movable guiding member 51 along an elongated slot formed in the side plate 22 (FIG. 2). The unit 50 is provided with a frame, and a part of the frame 52 is cut and bent to form a projection 52*a*. By the frame 52, a discharging roller 53 is rotatably supported, and the frame 52 has a guiding plate 55 fixed thereto, the guiding plate 55 having a cut-away portion 55*a*. The guiding plate 55 is provided with a leaf spring 56 which rotatably supports the rollers 57 and 59 and urge them to the discharging roller 53. The shaft of the discharging roller has a gear 60 fixed thereto, which is coupled with an unshown driving means. The discharging unit 50 has, at its left end, a combination of a position detecting sensor 61 and a light intercepting plate 62. The sensor 61 is actuated and deactuated.

By projections 63*a* of a member 63, the projections 63*a* being formed at positions corresponding to plural bins B. The bottom stay 25 is provided with a sensor 65 which is actuated by the light intercepting plate 62. The bottom side of the bottommost bin B is enclosed by a cover 66. Between the cover 66 and the bin B, there is a spring 67 having an end fixed to the cover 66. Between the other end of the spring 67 and the frame 52 a guiding member 69 in the form of a sheet is stretched. The guiding member 69 constitutes one side surface of a sheet discharging passage A. The outer casing 26 is provided with a door 70 mounted by a hinge 71. The inside of the door 70 has ribs 72 constituting one another side surfaces of the discharging passage A. The ribs 72 are so disposed as to correspond to the cut-away portions 55*a* of the guiding plate 55.

In operation, when the operator selects the sheet discharge onto the discharge tray 15 on an operation panel not shown, a control device (not shown) receiving the signal from the operation panel energizes the motor 46 to lower the sheet discharge unit 50, by which the light intercepting plate 62 deactuates the sensor 65, in response to which the motor 46 is stopped. In this manner, the sheet discharge unit 50 is placed at its home position (FIG. 1). At this time, the projection 52*a* of the frame 52 of the unit 50 is brought into contact with the leaf spring 30 to rotate the flapper 29 in the clockwise direction, so that the flapper 29 is moved to a position away from the sheet S discharged by the discharging rollers 13. The guiding member 69 is pulled by the spring 67 and is disposed between the bin B and the cover 66. When an image signal is supplied from an unshown external device to the laser beam printer 2, the control device controls the image forming station 10 to form an image by the laser scanner 9 in accordance with the image signal.

On the other hand, the sheet S is supplied from the cassette 5 to the registration rollers, by which it is fed into the image forming station in timed relation with the image in the image forming station. The image is printed on the sheet S in the image forming station. The sheet S is then conveyed into the fixing device 17, by which the image is fixed thereon. The sheet S is conveyed to the discharging rollers 13 by way of the U-shaped passage 12, and is discharged onto the discharge tray 15 by the discharging rollers.

Figure 3:
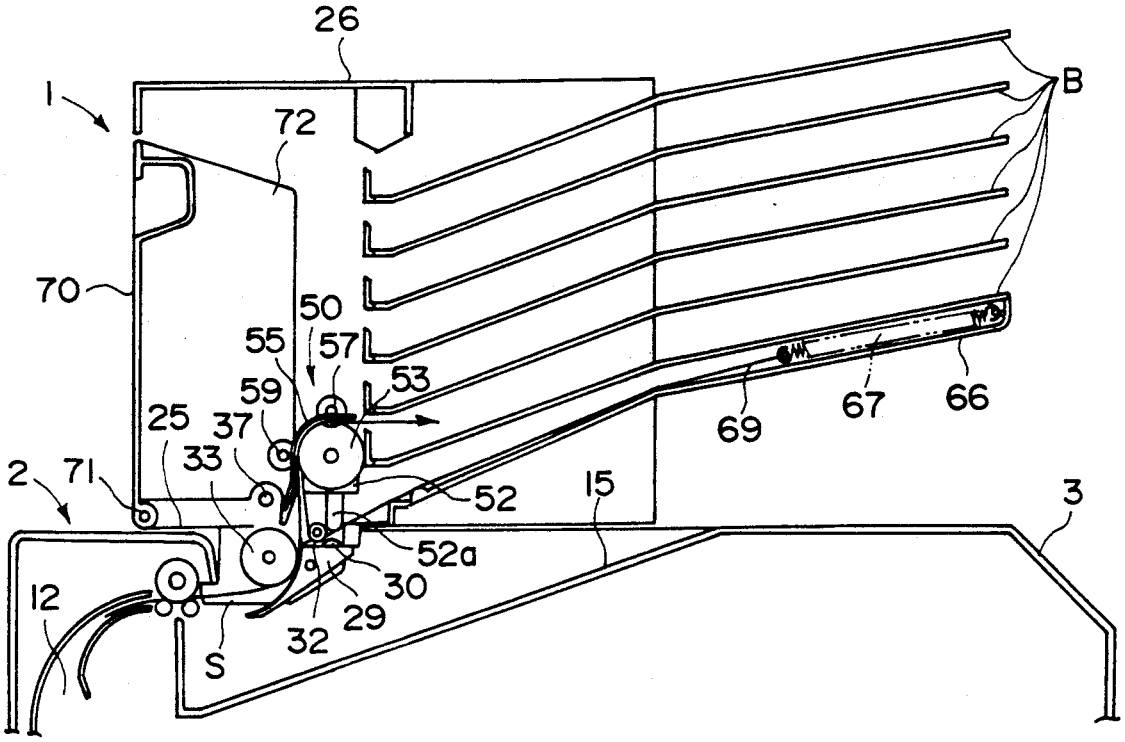
FIGS. 3 and 4 are front sectional views illustrating operation of the sorter.

When the operator selects the sheet discharge to the sorter 1, the control device receiving the selection signal energizes the motor to raise the sheet discharge unit 50 where it is faced to the bottommost bin B, that is, the position where the sensor 61 is deactuated by the bottommost one of the projections 63*a* of the member 63 (FIG. 3). At this time, the projection 52*a* of the frame 52 is spaced apart from the leaf spring 30; therefore, the flapper 29 rotates in the counter-clockwise direction by its own weight, so that it moves to a position for guiding into the sorter 1 the sheet S discharged by the discharging rollers. The guiding member 69 is drawn against the spring 67 from between the bin B and the cover 66 by the upward movement of the sheet discharging unit 50 (FIG. 3). In the same manner as described above, the sheet S on which the image is fixed is discharged outside the main apparatus 3 by the discharging rollers 13, and is guided to the inlet roller 33 by the flapper 29.

The sheet S is conveyed by the inlet roller 33 through the sheet discharge passage A between the ribs 72 and the guiding member 69 into a nip formed between the sheet discharging roller 53 and a roller 59. The sheet S is introduced by the rollers 53 and 59 and the guiding plate 55 into a nip formed between the sheet discharging roller 53 and the roller 57. The sheet S is driven by the rollers 53 and 57 onto the bottommost bin B (FIG. 3). Thereafter, the control device raises the sheet discharging unit 50 by the motor 46. When the sensor 61 is deactuated by the second bottom projection 63*a* of the member 63, the motor 46 is stopped. By this, the sheet discharging unit 50 is placed at a position where it faces the second bottom bin B, and the guiding member 69 is further drawn out by the movement of the unit 50.

Figure 4:
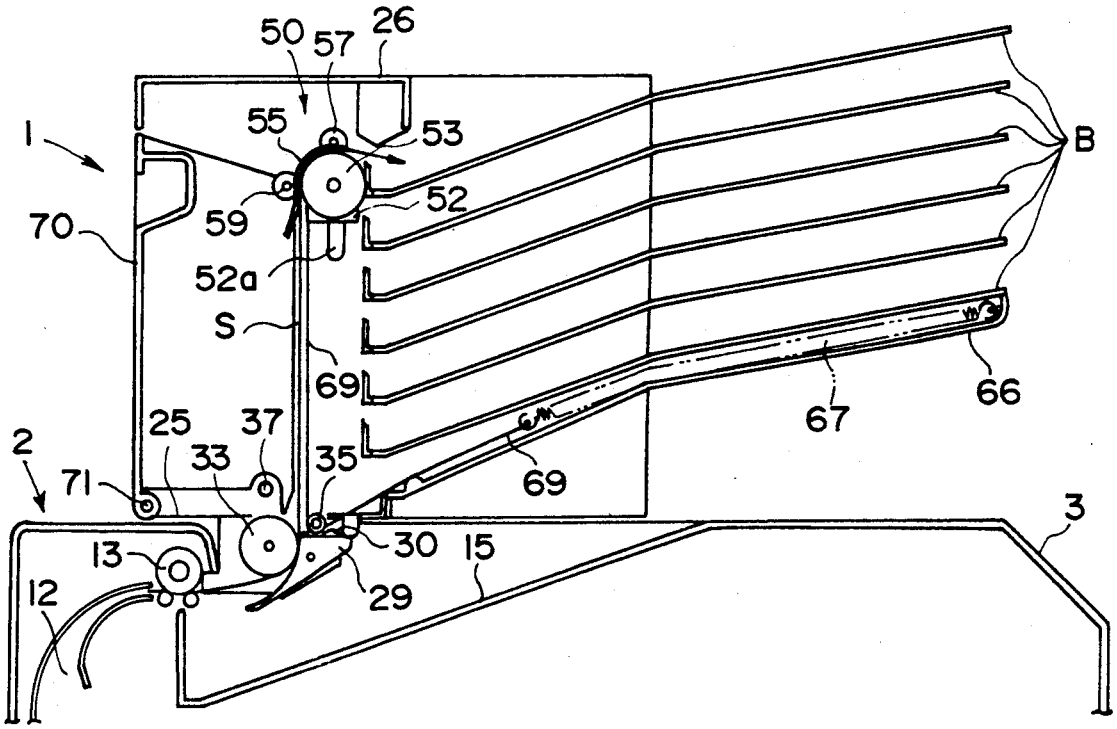

In the similar operation as described above, the sheet S having received the image is received on the second bottom bin B. By repeating the same operations, the sheet discharging unit 50 is stepwisely moved by one bin and receives the sheets S. When the sheet S is discharged onto the topmost bin B (FIG. 4), the control device lowers the sheet discharge unit to a position where it is faced to the bottommost bin B, and the same operations are repeated.

When the time required for the movement of the sheet discharging unit 50 is shorter than the time required for the image formation on the sheet S, the bin B can be selected randomly.

In the foregoing embodiments, the guiding member 69 is in the form of a sheet.

Figure 5:
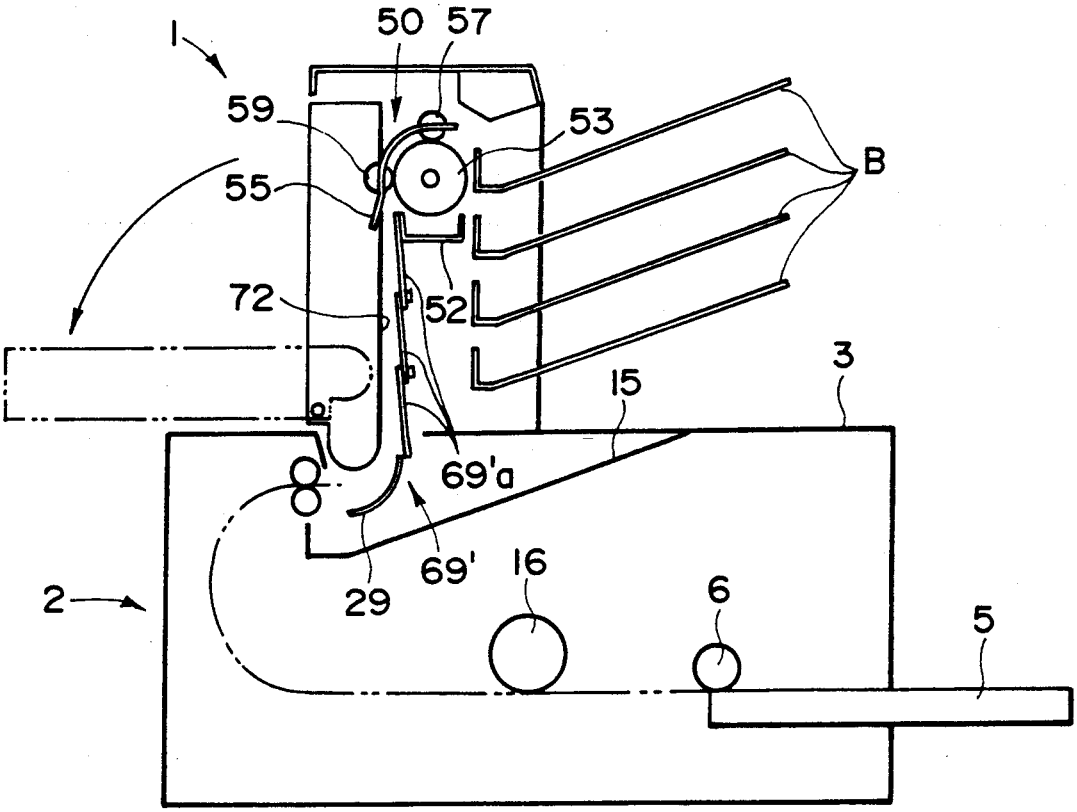
FIGS. 5 and 6 are front sectional views of an image forming apparatus according to another embodiment of the present invention.
Figure 6:
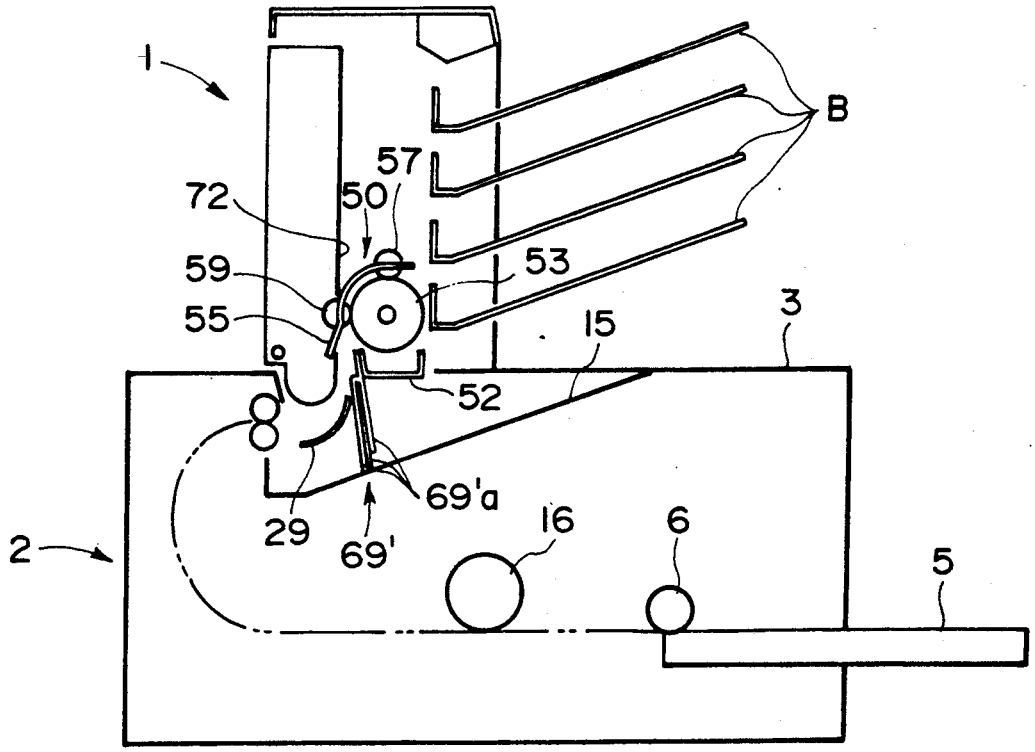

FIGS. 5 and 6 show another form of the guiding member 69, wherein the guiding member designated by a reference 69' is constituted by guiding plate 69'a. When the guiding member 69 is expanded, the end portions of the adjacent guiding plates 69'a are overlapped.

Figure 7:
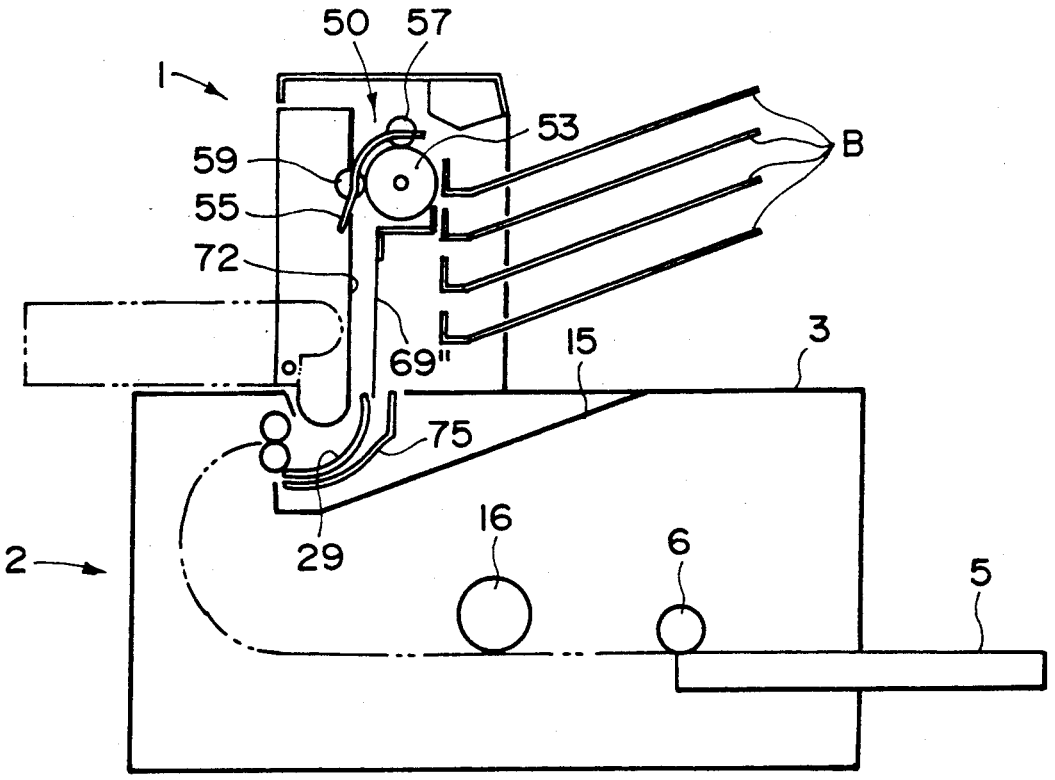
FIGS. 7 and 8 are front sectional views of an image forming apparatus according to a further embodiment of the present invention.
Figure 8:
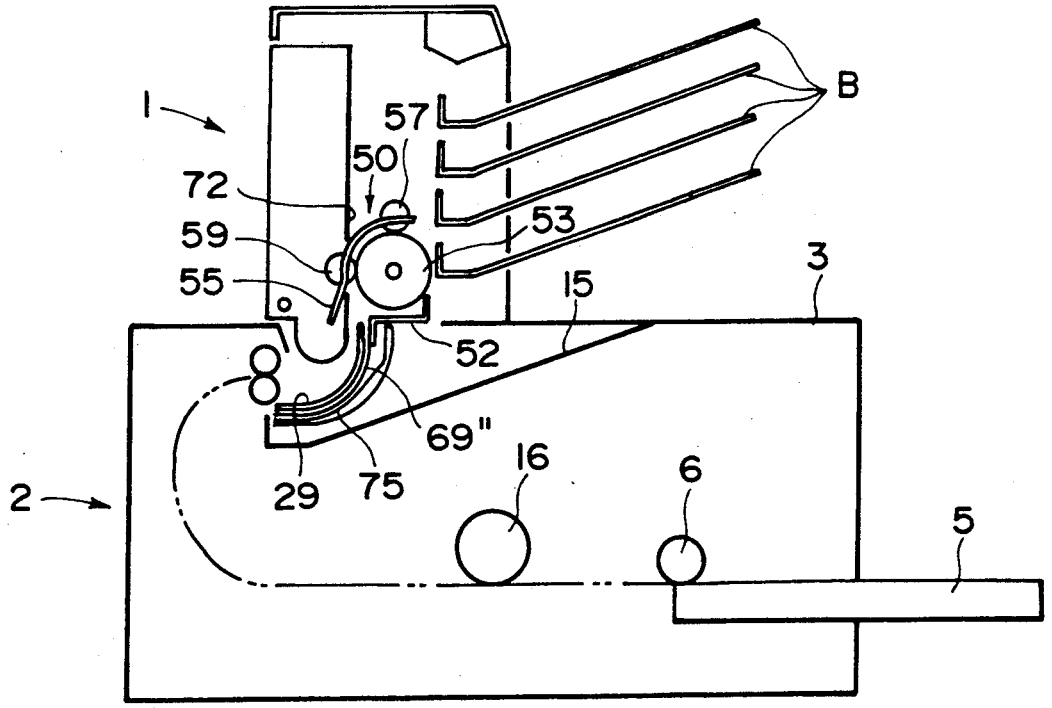
Figure 9:
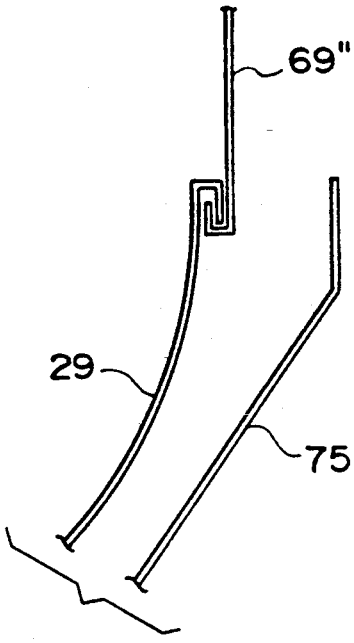
FIG. 9 is a sectional view of a guiding passage.

FIGS. 7 and 8 show another example wherein a thin metal plate 69' having flexibility and rigidity. The metal plate 69' can be accommodated in the space between the flapper 29 and a cover 75 provided at a backside of the flapper 29. The bottom portion thereof is bent so as to be engaged with the flapper 29 when it is drawn out (FIG. 9). This arrangement is effective to stabilize the bottom portion of the metal plate of 69''.

Figure 10:
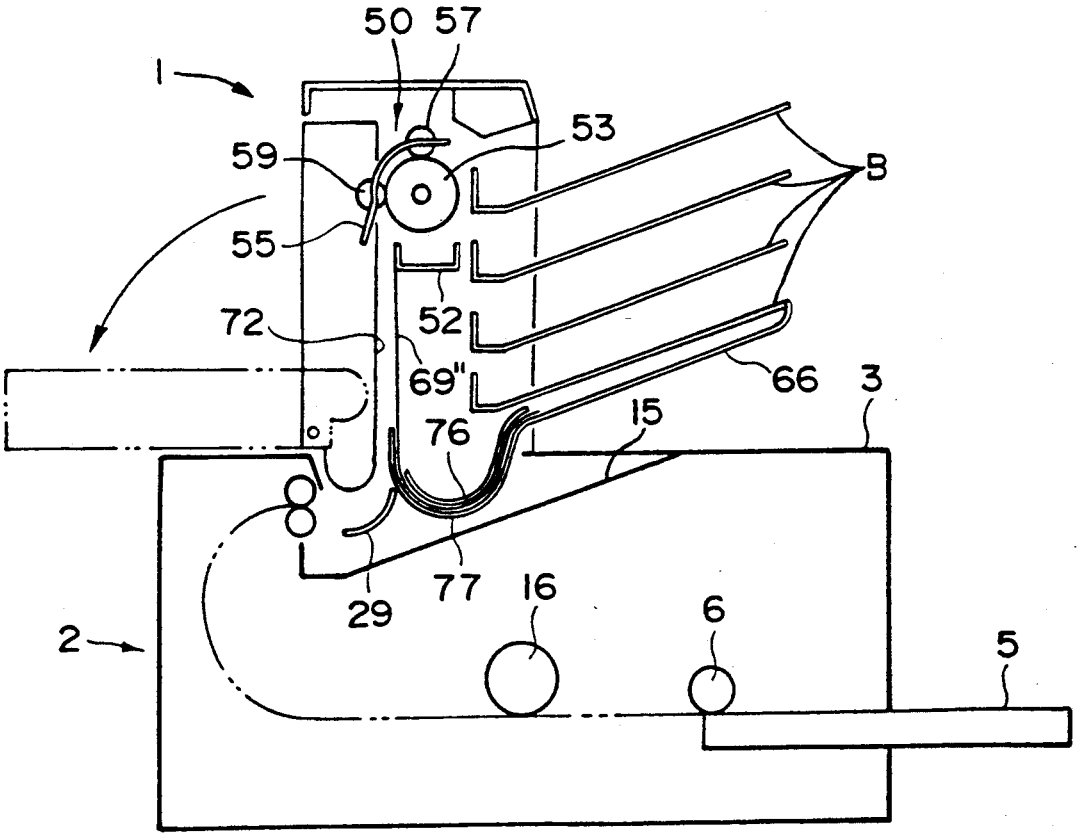
FIGS. 10 and 11 are front sectional views of an image forming apparatus according to a further embodiment of the present invention.
Figure 11:
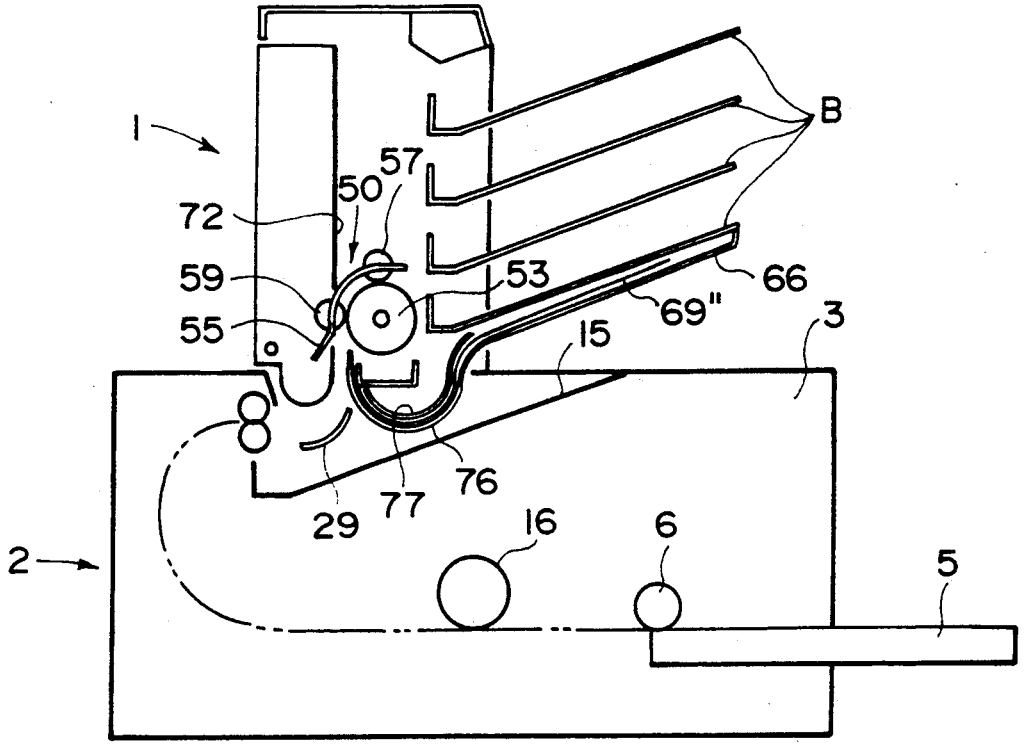

FIGS. 10 and 11 show a further example wherein the metal plate 69'' is accommodated in the space between the bottommost bin B and the cover enclosing the bottom portion of the bin. In this example, curved guide plates 76 and 77 guide the metal plate 69'' into between the bin B and the cover 66.

In the foregoing embodiment, the guiding member 69 in the form of a sheet is accommodated in the space between the bin B and the cover 66.

Figure 12:
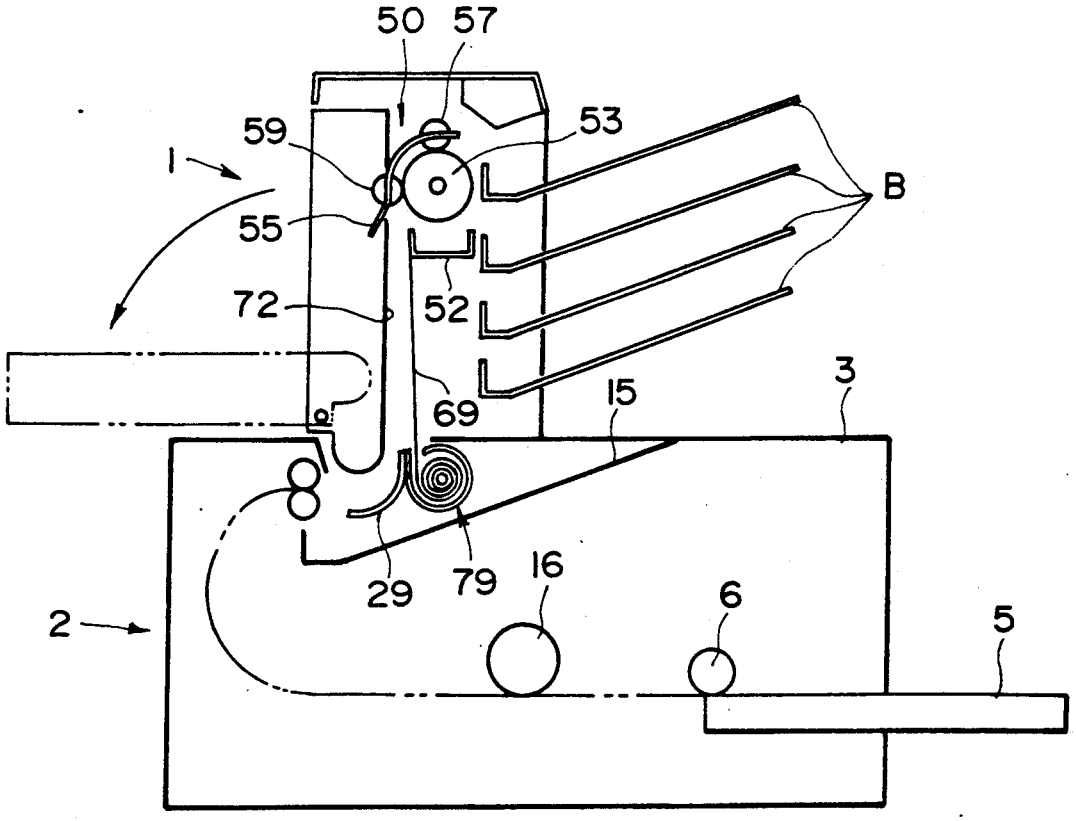
FIG. 12 is a front sectional view of an image forming apparatus according to a further embodiment of the present invention.

FIG. 12 shows another example wherein it is accommodated by being wound around a retractor 79. In this case, the guiding member 69 is connected to a spring not shown at an end thereof, so that the guiding member 69 is normally urged in the winding direction.

In the foregoing embodiment, the sorter 1 is mounted on a laser beam printer 2.

Figure 13:
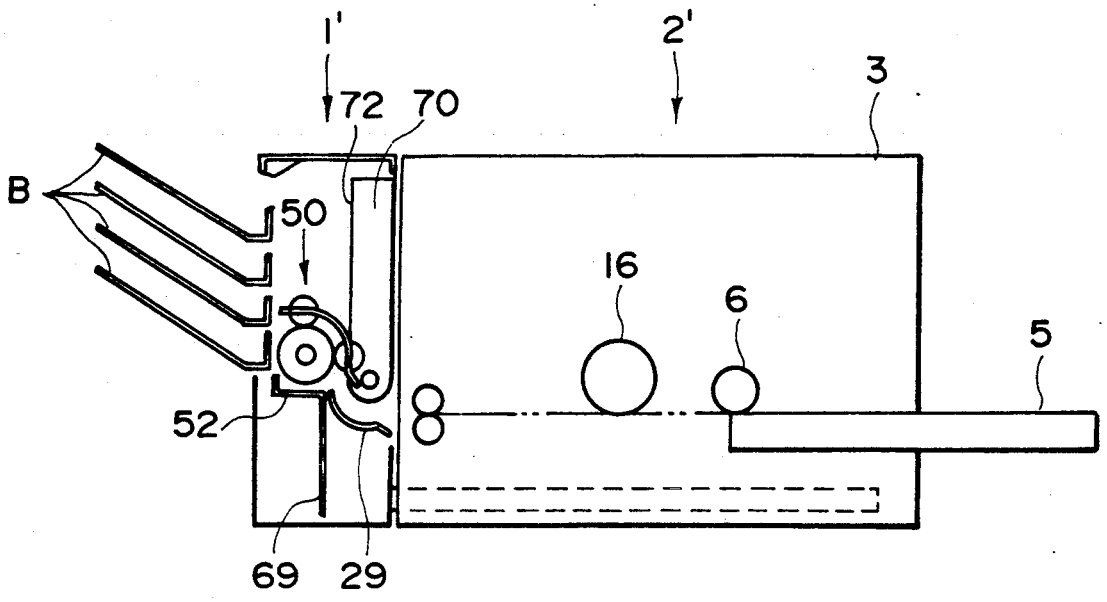
FIGS. 13, 14 and 15 are front sectional views of an image forming apparatus according to a further embodiment of the present invention.
Figure 14:
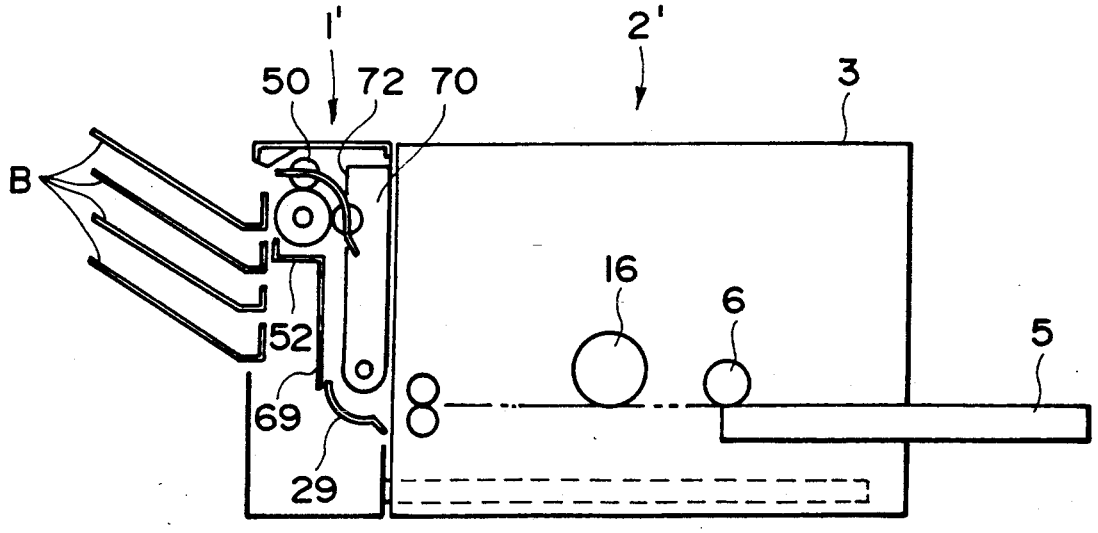
Figure 15:
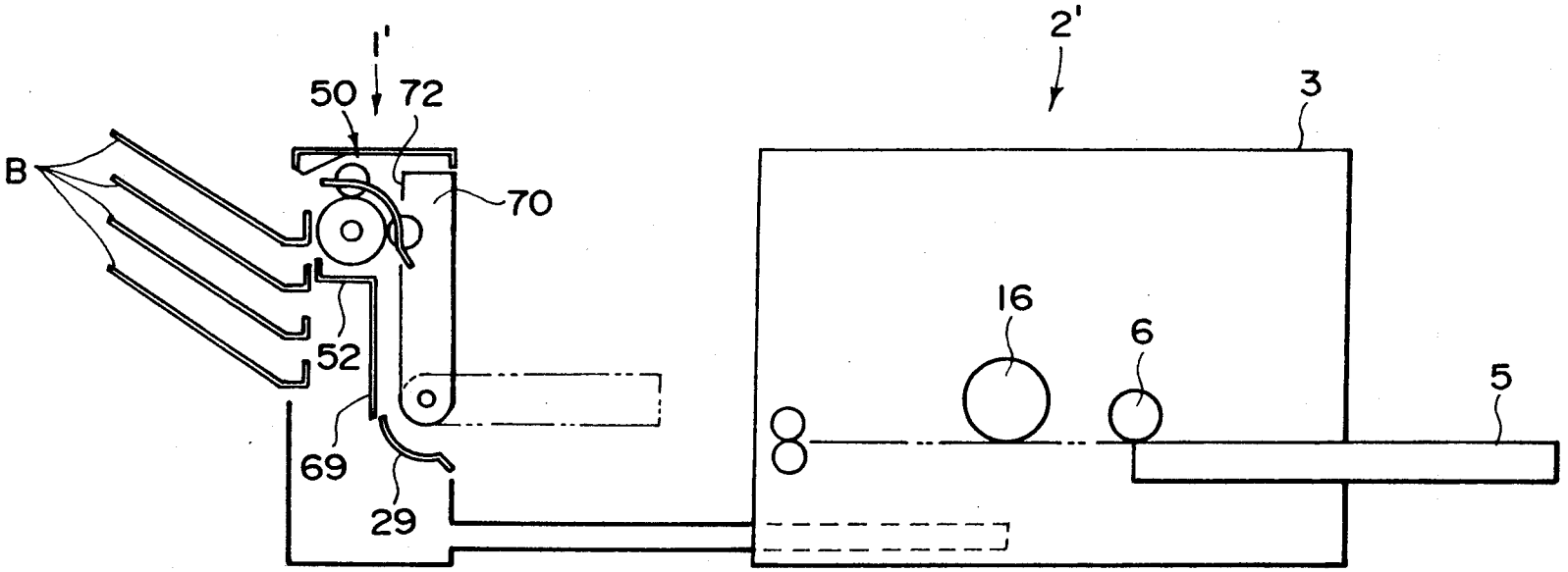

FIGS. 13 and 15 show another examples wherein, the sorter 1' is attached or mounted to a side of the laser beam printer 2'. When a sheet is jammed, the sorter 1' is moved away from the laser beam printer 2' and the door 70 is opened. Since the guiding member is movable, the necessity of switching the flapper or the like to the position corresponding to the respective bins, is eliminated.

In the foregoing embodiment, the sorter 1 includes fixed bins.

Figure 16:
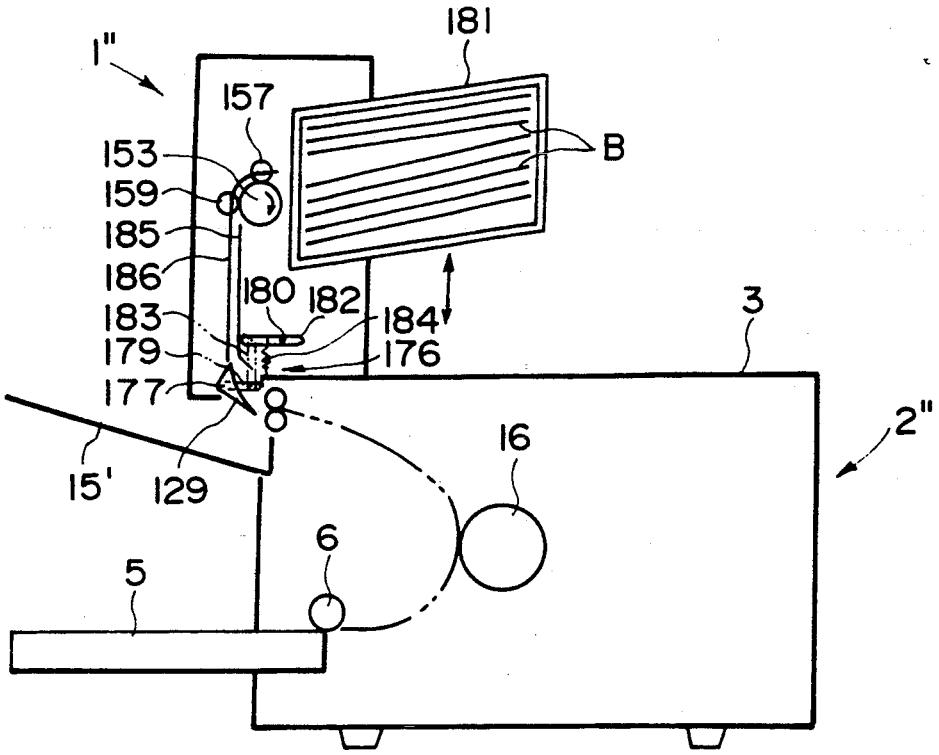
FIGS. 16 and 17 are front sectional views of an image forming apparatus according to a further embodiment of the present invention.
Figure 17:
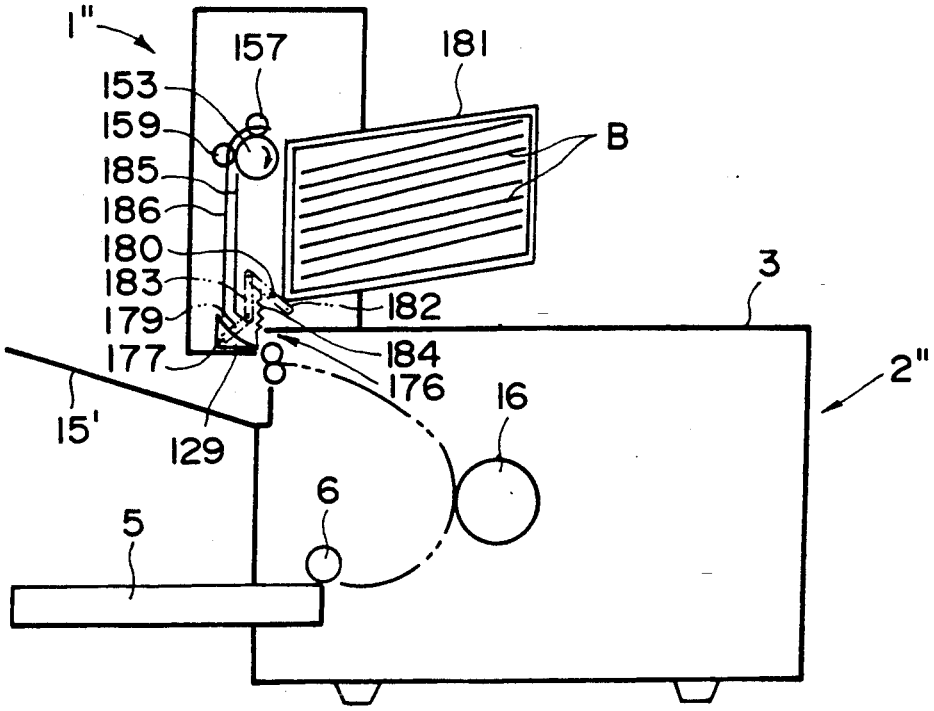

FIGS. 16 and 17 show another examples, wherein the sorter 1'' is provided with movable bins. The sorter 1'' has as link mechanism 176 for swinging the flapper 129. The link mechanism 176 is constituted by a link arm 179 fixed to a shaft 177 which is rotatably supported by an unshown frame and to which a flapper 129 is fixed, a link arm 182 which is rotatably supported on shaft 180 and which is contacted to a bin unit 181 and swings when the bin unit 181 containing the bins B lowers to the bottommost position, a link arm 183 for connecting the arm 182 and the link arm 179, a spring 184 for urging the arm 182 in the counterclockwise direction.

When the sheet is sorted and accommodated in the bin B, the bin B is moved to the position faced to the discharging roller 153 and the roller 157. At this time, the bin unit 181 and the link arm 180 are spaced apart, and the flapper 129 rotates by its own weight in the clockwise direction to move the sheet to be guided to the sorter 1''. The sheet discharged by the laser beam printer 2 is conveyed to the discharging rollers 153 by the flapper 129 between the guides 185 and 186 and is discharged and accommodated into the bin B by the rollers 153 and 159 and a roller 157.

When the sheet is discharged onto the discharge tray 15', the bin unit 181 is lowered to the bottommost position, upon which the unit 181 and the link arm 182 are contacted, and the arm 182 is swung in the clockwise direction. By this, the link arm 183 moves upwardly, by which the link arm 179 rotates in the counterclockwise direction. Together with the arm 179, the flapper 129 rotates in the counterclockwise direction, too. Therefore, the discharge of the sheet from the laser beam printer 2'' to the discharge tray 15' is not prevented.

Figure 18:
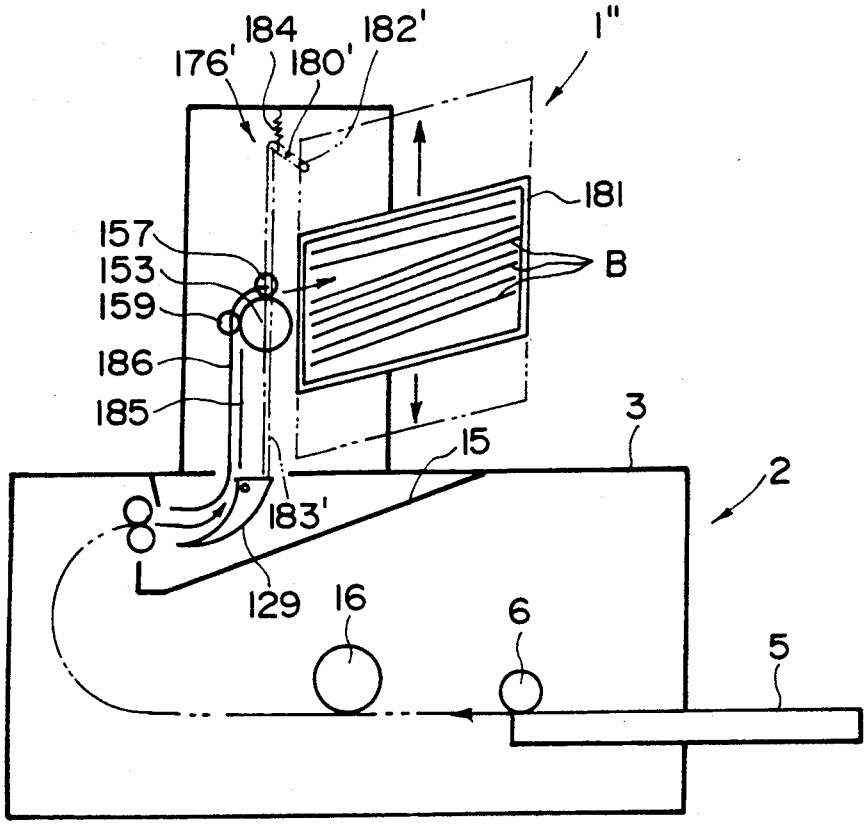
FIGS. 18 and 19 are front sectional views of an image forming apparatus according to a further embodiment of the present invention.
Figure 19:
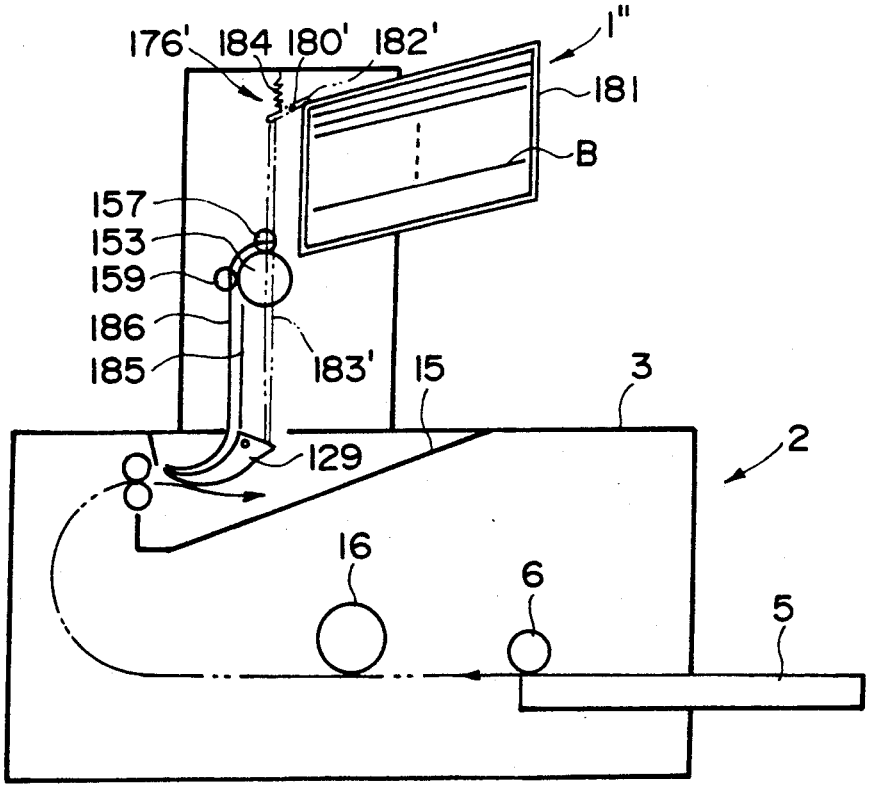

As shown in FIGS. 18 and 19, the link arm 182' of the link mechanism 176' may be swung by the upward movement of the bin unit 181. The sheet accommodating means may be disposed below the sorting bins of the sorter as a bin for exclusively accommodating the sheet.

The description will be made as to other examples of guiding roller arrangement which can properly guide a thick sheet.

EXAMPLE 1

Figure 20:
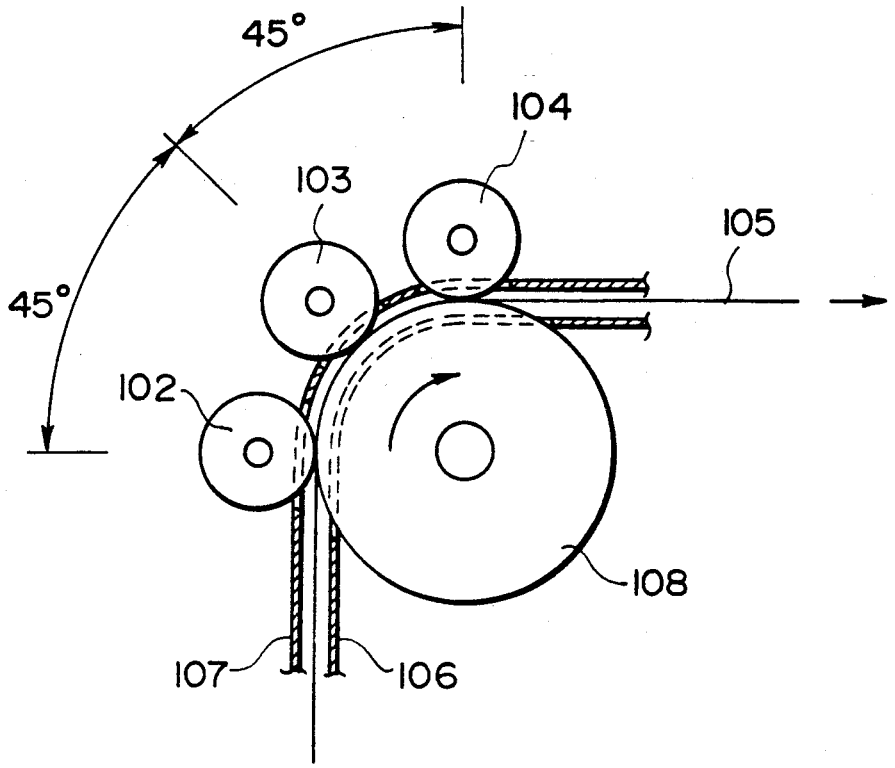
FIG. 20 is a sectional view of an example of each roller arrangement.

FIG. 20 shows a first another example of the guiding roller arrangement (pinch roller arrangement) comprising a conveying roller 108, a first pinch roller 102, a second pinch roller 103 and a third pinch roller 104. The first, second and third pinch rollers 102, 103 and 104 are disposed in the order named along the conveyance direction of the sheet material 105, and are press-contacted to the outer periphery of the conveying roller 108. The contact point between the pinch roller 102 and the conveying roller 108 and the contact point between the pinch roller 104 and the conveying roller 108, are spaced by approximately 90 degrees as seen from the rotational center of the conveying roller 108.

An inside curved guide 108 is provided with an opening, through which a part of the outer periphery of the conveying roller 108 is projected. An outside curved guide 107 is provided with openings for exposing the pinch rollers 102, 103 and 104. The outside guide 107 is curved along the outer periphery of the conveying roller 108 with a constant space therefrom, extending parallel with the inside guide 108, through an angular distance of 90 degrees.

In operation, the sheet material 105 is introduced along the curved guides 106 and 107, and is received by the nip formed between the conveying roller 108 and the pinch roller 102, which it is transported further. The leading edge thereof is advanced by the pinch roller 103 and is bent by approximately 45 degrees as seen from the center of the conveying roller 108. Then, the sheet is further bent by the pinch roller 104 and the conveying roller 108, and therefore, during the bending through approximately 90 degrees, the sheet is securedly confined, whereby a more or less thick sheet can be conveyed with certainty.

EXAMPLE 2

Figure 21:
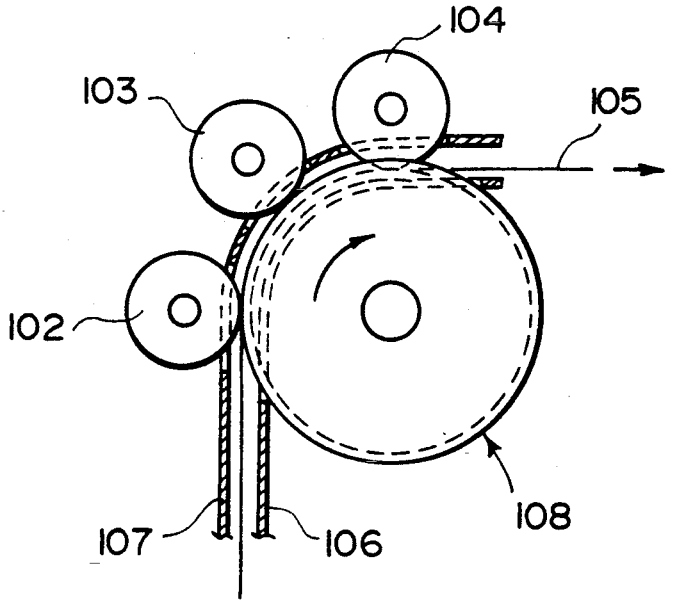
FIG. 21 is a sectional view of another example of a pinch roller arrangement.
Figure 22:
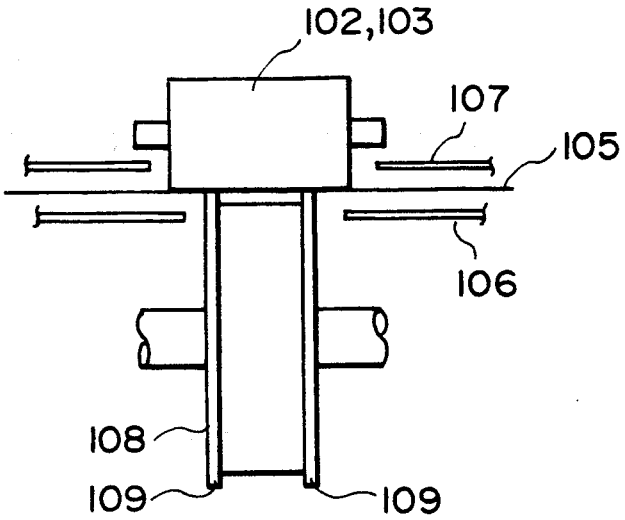
FIGS. 22 and 23 are longitudinal sectional views of said further example of the pinch roller arrangement.
Figure 23:
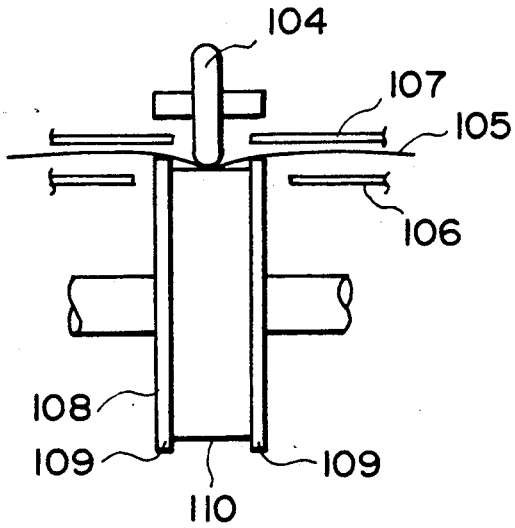

FIGS. 21, 22 and 23 show a second example, wherein the same reference numerals as in Example 1 are assigned to the elements having the corresponding functions. What is different from the first example is in that the conveying roller 108 has flanges 109 at opposite longitudinal ends, the flanges 109 having a diameter larger than that of central portion 110. The outer peripheries of the first and second pinch rollers 102 and 103 have widths larger than that of the conveying roller 108 (FIG. 22 and are press-contacted to the flange portion 109. The width of the outer periphery of the third pinch roller 104 is smaller than the width of the conveying roller 108 measured between the insides of the flanges 109 (FIG. 23), and is press-contacted only to the central portion 110 of the conveying roller 108. The sheet material 105 is conveyed to the second pinch roller in the same manner as in Example 1, but the sheet 105 received by the nip between the third pinch roller 104 and the conveying roller 108 is bent at shown in FIG. 23, and therefore, the sheet is prevented from dangling at its leading portion, when it is discharged. When a tray (not shown) is disposed immediately after the contact point between the pinch roller 104 and the conveying roller 108, the sheet is sometimes not properly received thereby if the leading portion thereof is dangling. Because the sheet is wrapped around the conveying roller by the three pinch rollers, and the sheet is easily curled, by which the improper stacking on the tray is promoted. This example is effective to prevent this drawback. This example is also usable for conveying thick sheets.

EXAMPLE 3

Figure 24:
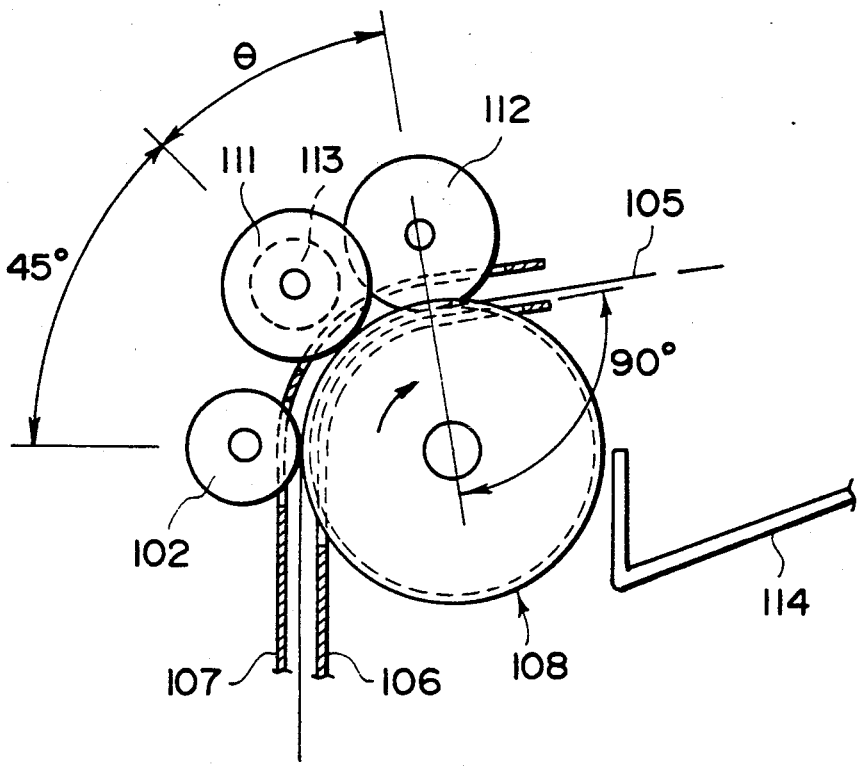
FIG. 24 is a sectional view of a further example of the pinch roller arrangement.
Figure 25:
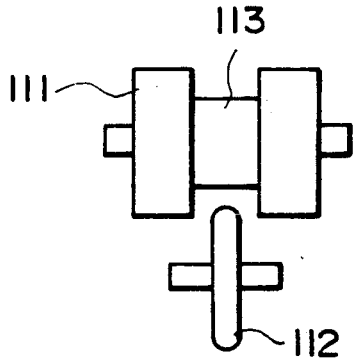
FIG. 25 is a longitudinal sectional view of said further example of the pinch roller arrangement.

FIGS. 24 and 25 show a third example. In the second example, when the sheet discharging direction by the third pinch roller is desired to be more upward, for example, in order to increase the better discharge, it is preferable that the discharging sheet is not contacted to the already stacked sheets. Particularly when the stacking tray 114 is inclined as shown in FIG. 24, it is inevitable to direct the discharging sheet upwardly.

As shown in FIG. 25, the central portion 113 of the second pinch roller 111 has as diameter smaller than the other portion, and the second pinch roller 111 is contacted to the flanges 109 (FIG. 23) of the conveying roller 108 with the large diameter portion. In order to accomplish the upward direction discharge, the third pinch roller 112 comes closer to the second pinch roller 111 ($\theta < 45$ degrees). Since the central portion 113 of the second pinch roller 111 has as smaller diameter, the interference with the third pinch roller 112 can be avoided (FIG. 25). By this example, the sheet can be discharged upwardly immediately after the curved passage.

EXAMPLE 4

Figure 26:
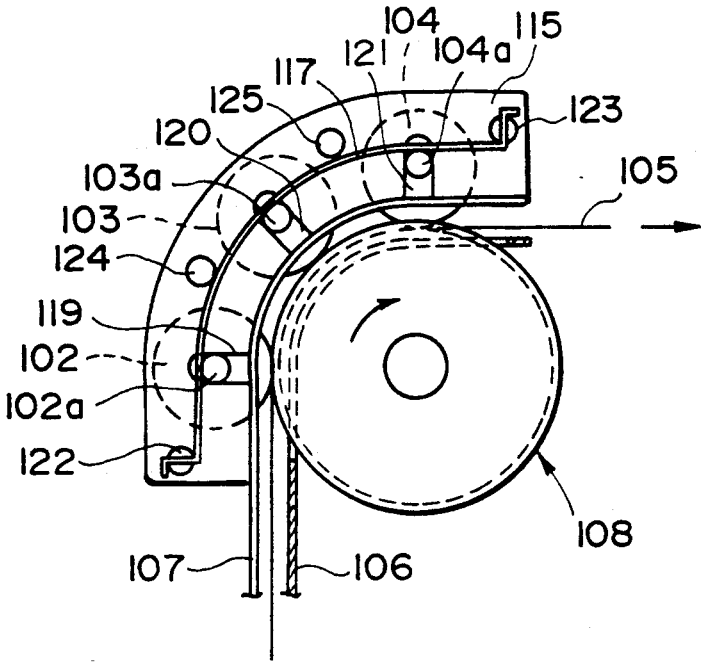
FIG. 26 is a further example of the pinch roller arrangement.
Figure 27:
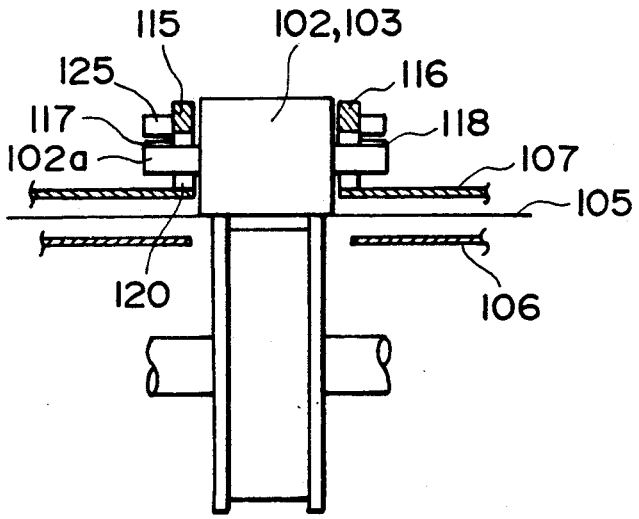
FIGS. 27 and 28 are longitudinal sectional view of said further example.
Figure 28:
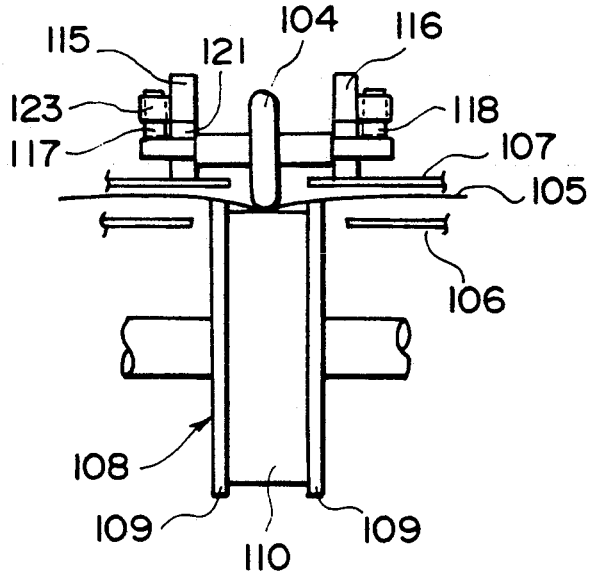

FIGS. 26, 27 and 28 show a fourth example wherein three pinch rollers are press-contacted to one conveying roller. Holders 115 and 116 each have three U-shaped grooves 119, 120 and 121. The first, second and third pinch rollers 102, 103 and 104 are engaged in the respective grooves for longitudinal and rotational movement. Since the holders 115 and 116 have symmetrical structures, the description will be made only with respect to the holder 115. Adjacent opposite ends of the holder 115, projections 122 and 123 are formed, the projections having grooves of a width corresponding to thickness of a leaf spring 117. At a position between the first groove 119 and the second groove 120, there is a stopper 124 for the leaf spring 117; at a position between the second groove 120 and the third groove 121, there is a stopper 125. End portions of the leaf spring 117 is fitted into and fixed to the grooves of the projections 122 and 123. The central portion of the spring 117 urges the shaft 102*a*, 103*a* and 104*a* of the three pinch rollers toward the conveying roller, while being limited by the stoppers 124 and 125. The same applies to the holder 116. In this manner, the closely arranged three pinch rollers are urged by uniform pressure by a simple structure including one leaf spring at one side of each of them.

EXAMPLE 5

Figure 29:
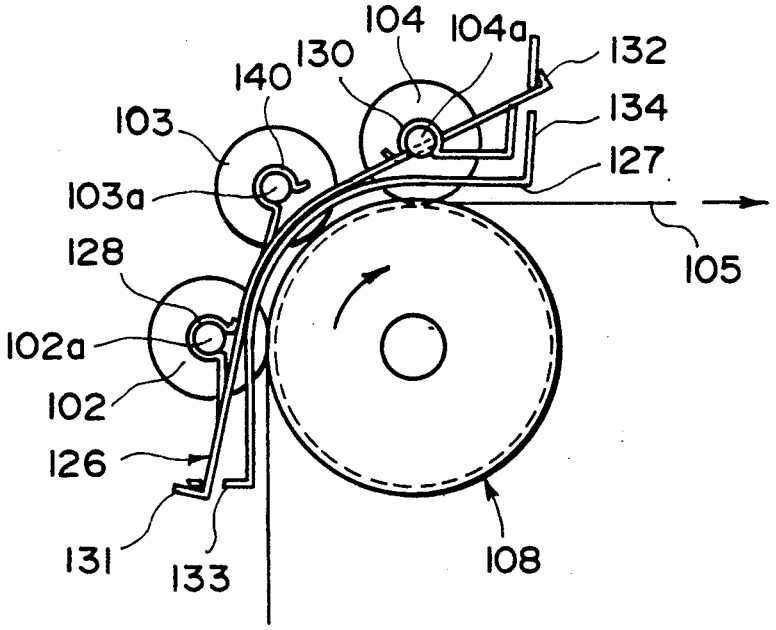
FIG. 29 is a sectional view of a further example of the pinch roller arrangement.

FIG. 29 shows another example of the press-contacting means for the three rollers. The shafts 102*a*, 103*a* and 104*a* of the three pinch rollers are rotatably supported by cut-and-bent portions 128, 140 and 130 of one leaf spring 126. The portions receiving the shafts are cut away so as to provide an opening having its inlet smaller than the outer diameter of the pinch roller shafts so as not to allow the shafts from being disengaged from the opening. The end portions 131 and 132 of the leaf spring 126 is engaged in the openings 133 and 134 of the curved guide 127.

The description will be made as to the assembling of the three pinch rollers. The pinch rollers 102, 103 and 104 are mounted beforehand to the leaf spring 126. Next, the leaf spring 126 is bent along the guide 127, and is hooked in the opening of the curved guide 127, so that it is prevented from disengagement by the force of the leaf spring. In this embodiment, the pinch rollers and the leaf spring are formed as a sub-unit, and therefore, the following advantages are provided:

(1) The structure is simple, since only one leaf spring is used (low cost);

(2) The assembling operation is easy, and the structure is not easily disassembled once it is assembled; and (3) The disassembling is easy if it is intentionally made.

In this embodiment, if the upward discharging direction is desired, the pinch rollers 103 and 104 are disposed closer as in Example 3 with partly overlapping.

Figure 30:
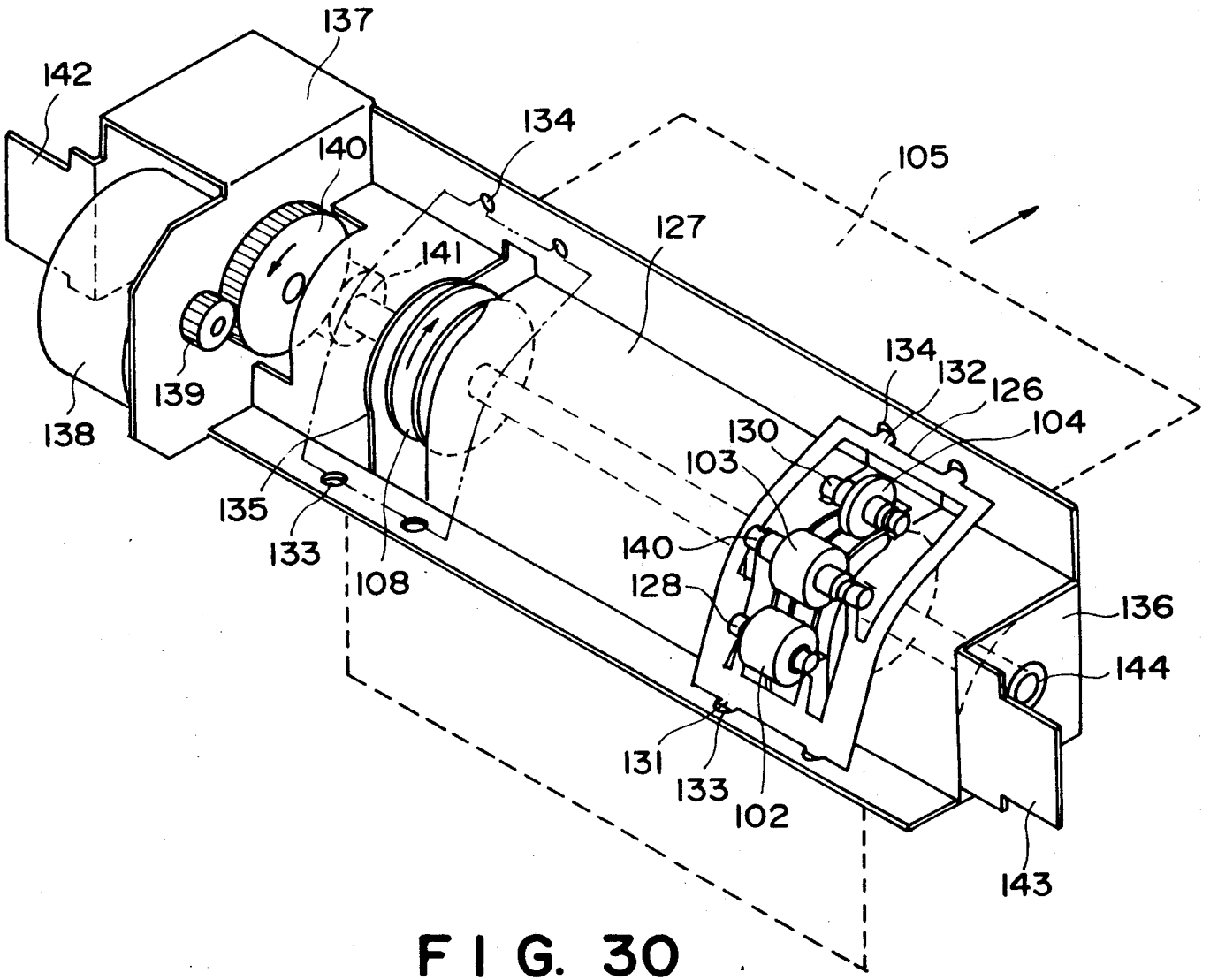
FIG. 30 is a perspective view of a conveying station using said further example of the pinch roller arrangement.

FIG. 30 shows an arrangement wherein the above described Example 5 is used in discharging station. In this Figure, the same reference numerals as in FIG. 29 are assigned to the elements having the corresponding functions. In this embodiment, two sets of combinations of the conveying roller and the pinch rollers, are disposed spaced in the direction perpendicular to the sheet conveyance direction, but three or more sets may be employed. The curved guide 127 is provided with openings 135 having the configurations matching the pinch rollers 102, 103 and 104 to expose them therethrough. At the opposite ends, members 136 and 137 for supporting the bearings 144 for the conveying roller 108 are fixed. To the member 137, a driving motor 138 is fixed, and an idler gear 140 is rotatably supported. By the meshing engagement between a gear 139 fixed to the output shaft of the driving gear and a gear 141 fixed to the shaft of the conveying roller 108, the driving force of the driving motor 138 is transmitted to the conveying roller 108. The bent portions 142 and 143 of the members 136 and 137 are used for fixing the unit to a timing belt or the like to move the unit substantially vertically.

Figure 31:
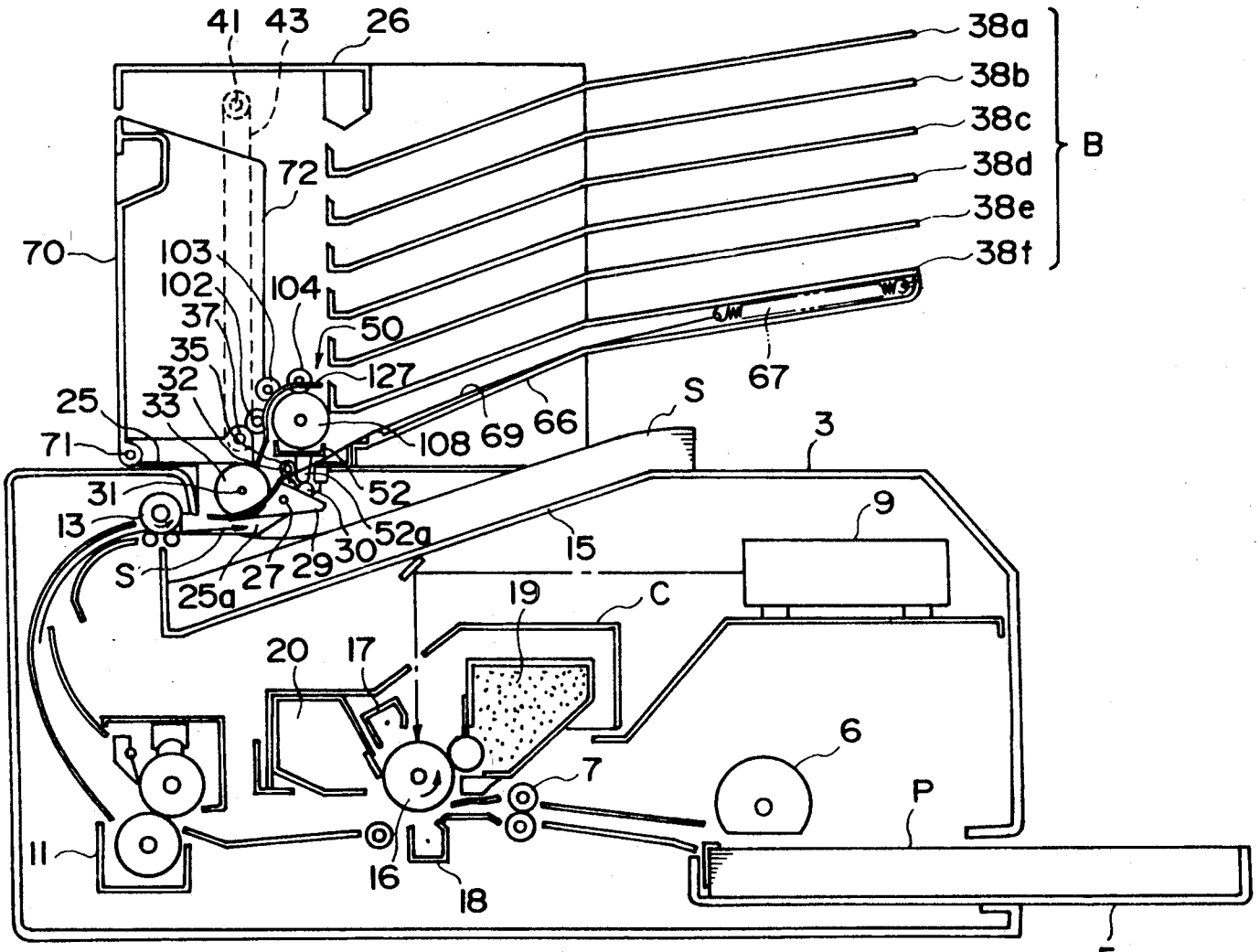
FIG. 31 is a sectional view of an image forming apparatus incorporating the pinch roller arrangement according to said further example.

FIG. 31 shows an arrangement wherein the fifth example is used in a sheet discharging portion of a sorter. A sorter is disposed at a position for receiving the sheet discharged from a face-down discharge outlet of an image forming apparatus.

Figure 32:
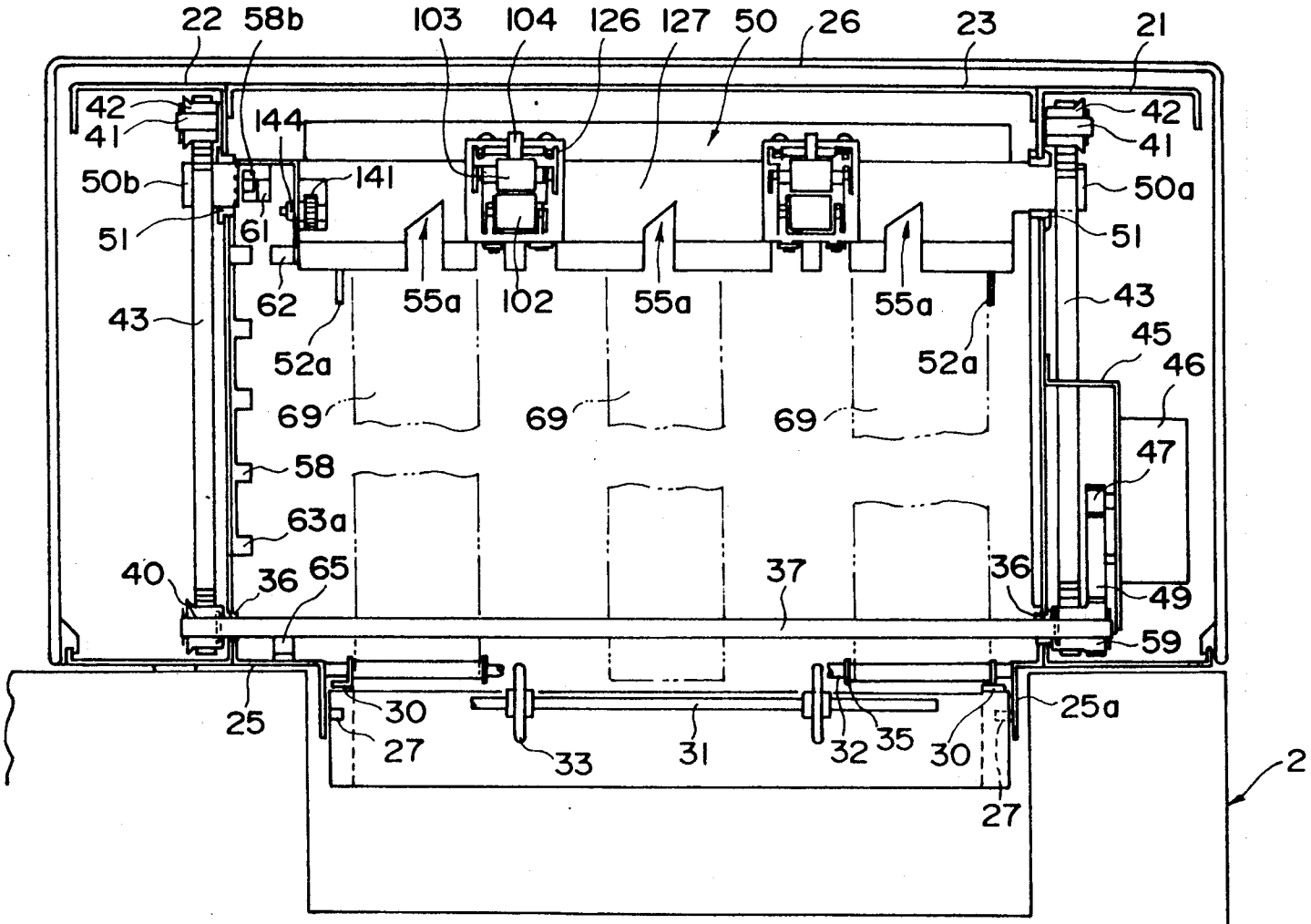
FIG. 32 is a top plan view of the apparatus of FIG. 31.

In FIGS. 31 and 32, a conveying roller 108 is assembled into a sorter together with three pinch rollers (FIG. 32 is a left side view of the sorter of FIG. 31). The roller 108 functions as a discharging roller. Adjacent to the outer periphery thereof, a guiding member 127 is disposed, and to the outer periphery thereof, pinch rollers 102, 103 and 104 are rotatably press-contacted by a leaf spring 126. The discharging roller 108, pinch rollers 102, 103 and 104 and the guide 127 or the like are supported on a frame 52 to constitute a sheet discharge unit. A part of the frame 52 is cut and bent to provide a projection 52*a*.

A gear 141 is fixed to the discharging roller 108 and serves to transmit the driving force from a driving motor (138, FIG. 30). The roller 108 is supported by bearings 144 at its opposite ends. In FIG. 32, the sheet discharging unit is shown as being at the topmost position, wherein the sheet can be discharged to the topmost bin (corresponding to FIG. 34 which will be described hereinafter).

Figure 33:
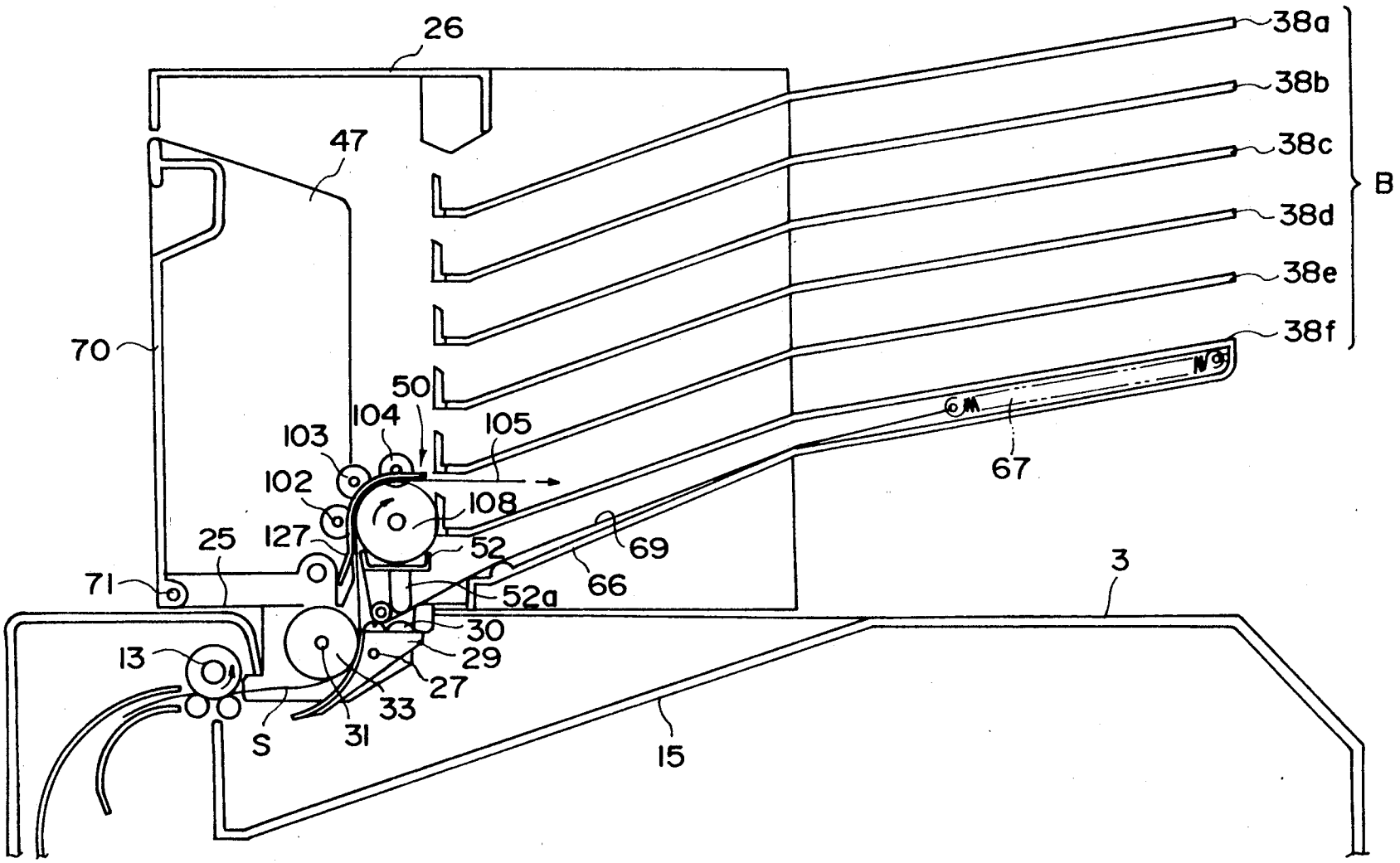
FIGS. 33 and 34 are sectional views illustrating operation of the apparatus of FIG. 31.

Referring to FIG. 33, the sheet discharge to the bottommost bin 38*f* will be described. The sheet S discharged from the sheet discharge outlet of the main assembly is received by the flapper 29 and is guided by the flapper 29 and the roller 33 upwardly. It is further guided to the sheet discharge unit 50 by the ribs 72 and a guiding sheet 69. It is then received by a nip formed between the conveying roller 108 and the pinch roller 102 and is bent into horizontal direction by the guide 127 and the pinch rollers 103 and 104. Finally, the sheet is transported by the discharging roller 108 and the pinch roller 104 into the bin (FIG. 33). At this time, the roller 33 freely rotates, and therefore, does not obstruct handling thick sheets or the like.

Figure 34:
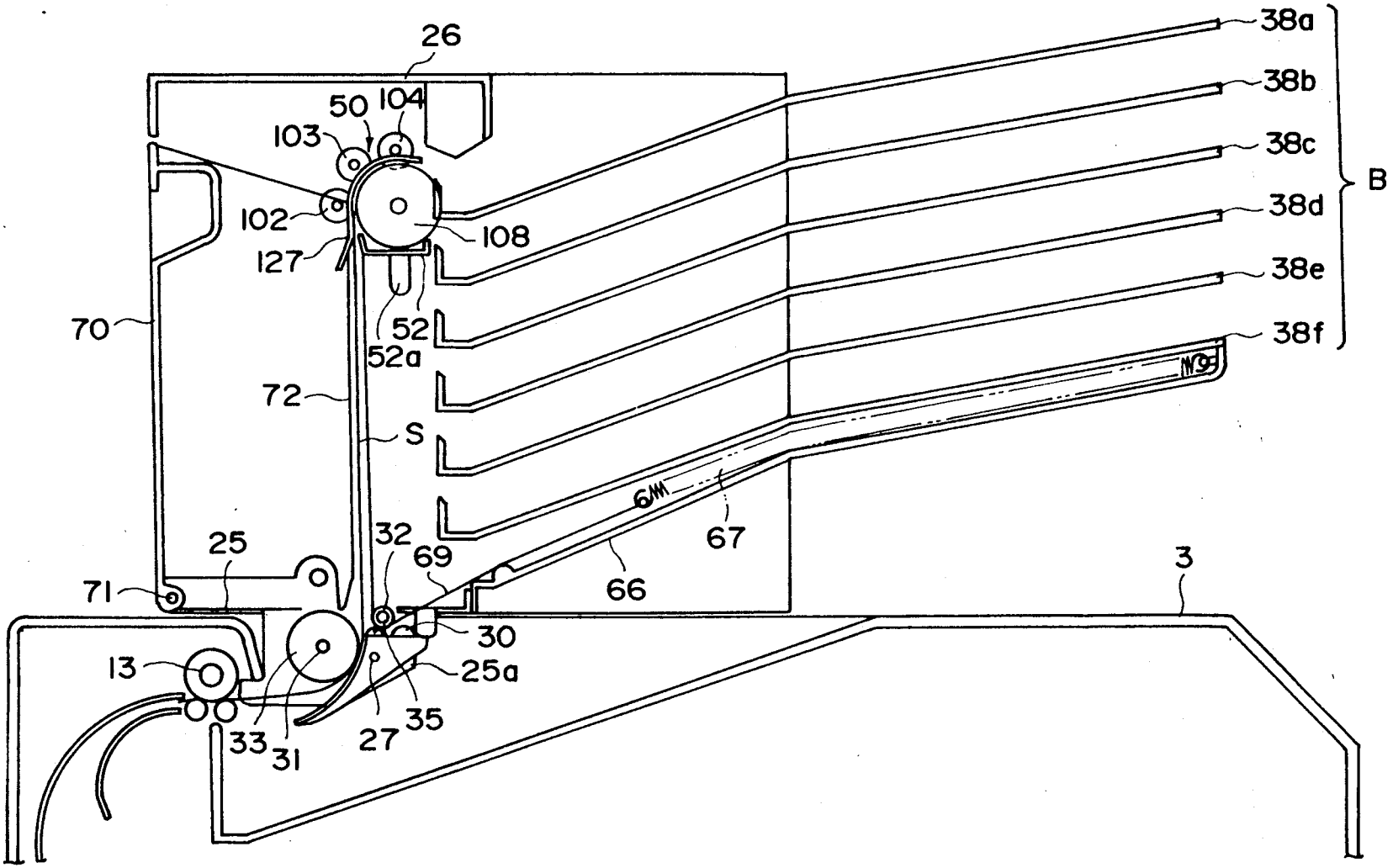

Referring to FIG. 34, the sheet discharge to the topmost bin 38*a* will be described. In this structure, the length of the passage from the sheet discharge outlet of the main assembly to the roller of the sheet discharging unit 50 is shorter than the minimum sheet length, and therefore, only the passage structure is sufficient without the necessity of the sheet conveying means therein. Since the structure is the same as that of FIG. 33 except for the length of the passage, the detailed description is omitted.

Also, since the discharge to the other bins 38*b*–38*e* is the same except for the position of the sheet discharge unit 50, the detailed description is omitted. When the sheet is discharged to any of the bins, the sheet discharge unit 50 is moved beforehand to a bin position designated before the sheet is conveyed. After the completion of the sheet discharge, it is moved to the next bin to which the next sheet is discharged. Therefore, when the sheets are discharged continuously to the same bin, the sheet discharging unit 50 does not need to be moved. When the time required for the movement from the topmost bin 38*a* of the bottommost bin 38*f* is shorter than the interval between the adjacent sheets continuously discharged, the bin can be randomly designated. When this is used for a sorter, which requires smaller space, the present invention is effective.

EXAMPLE 6

In the foregoing example, the sheet is upwardly conveyed and is bent by 90 degrees.

Figure 37:
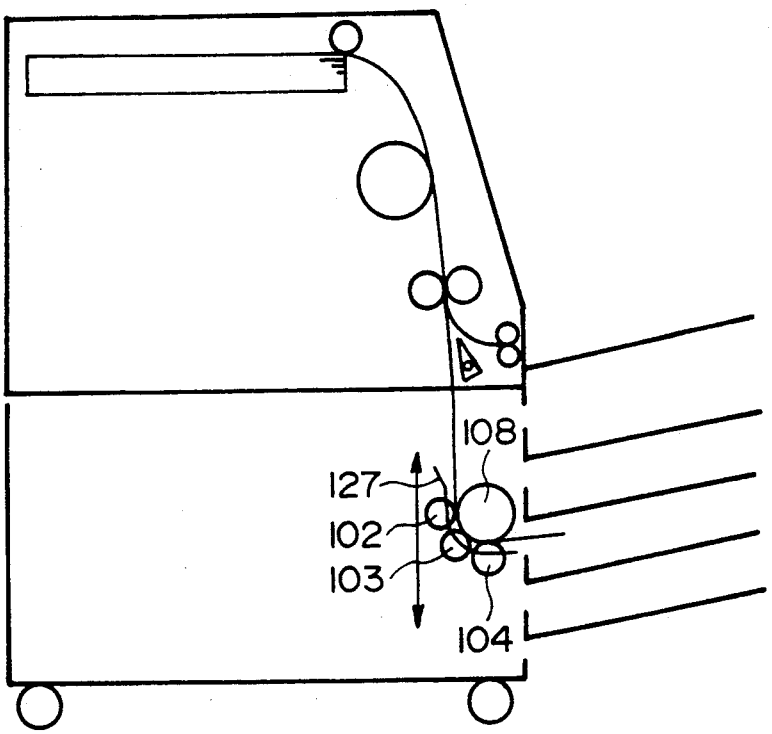
FIG. 37 is a sectional view illustrating a further example of the pinch roller arrangement.

FIG. 37 shows an example wherein the sheet material is directed downwardly. In this Figure, the apparatus is shown as being a sorter accommodated in a pedestal and only the sheet discharging unit of the sorter and the sheet accommodating bins are shown. The sheet discharged from the bottom portion of the image forming apparatus on the pedestal is introduced directly into the sorter, and is deflected by the combination of the conveying roller 108 and the pinch rollers 102, 103 and 104, and discharged into the bin. In this example, the sheet conveyed vertically (upwardly or downwardly) is deflected by 90 degrees and discharged. However, the sheet non-vertically conveyed can be received by the arrangement of this example.

Figure 35:
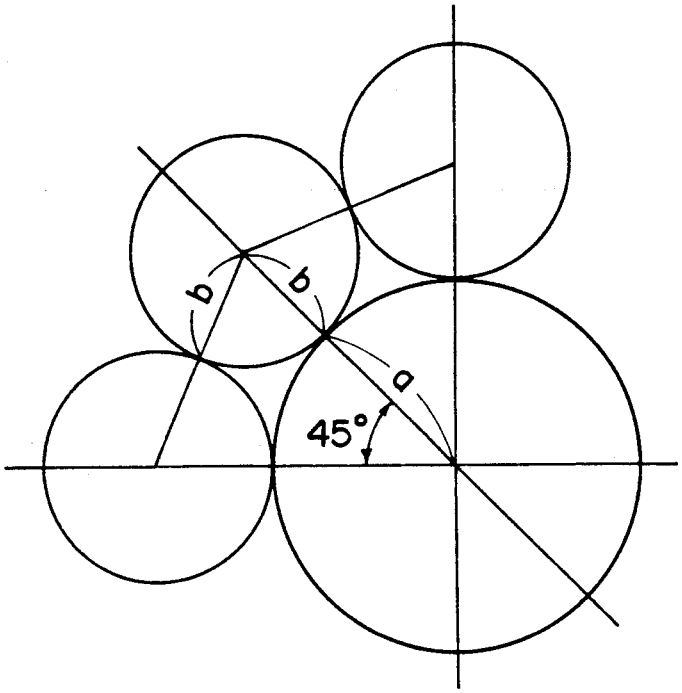
FIGS. 35 and 36 are schematic views explaining the pinch roller arrangement.

FIG. 35 illustrates a geometrical limit of an external diameter of the pinch roller relative to the external diameter of the conveying roller. The radius a of the conveying roller and the radius b of the pinch roller satisfy the following:

$$b/(a+b)=\sin 22.5^\circ$$

$$b/a=0.619914$$

The practical limit is expressed by $b_{max} \leqq 0.6a$.

Figure 36:
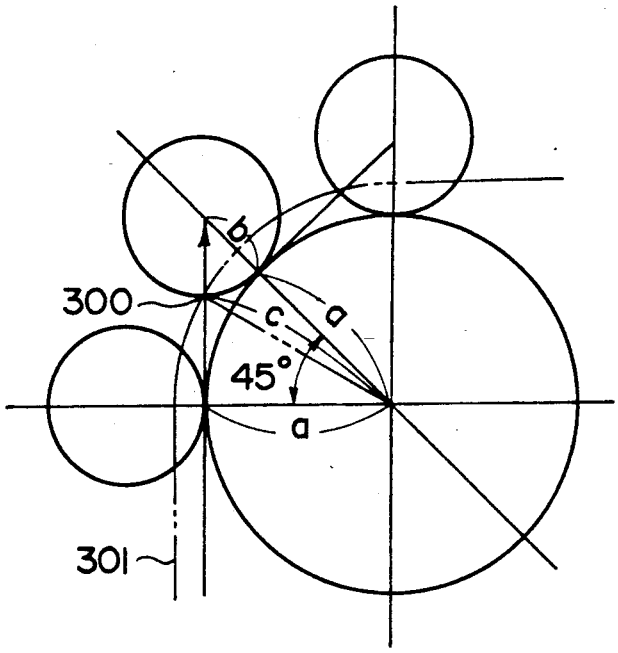

FIG. 36 illustrates the minimum limit of the external diameter of the pinch roller. The point where a tangential line between the first pinch roller and the conveying roller passes through the center of the second pinch roller is the lower limit of the external diameter of the pinch roller. If the diameter is smaller than this, the leading edge of the sheet being conveyed is not properly guided by the external periphery of the pinch roller, and the possibility that it is directed away from the conveying roller is increased.

$$a+b=\sqrt{2}\,a$$

$$b/a=\sqrt{2}-1=0.41421356\ldots$$

The practical limit is expressed by $b_{min} \geqq 0.4x$.

Therefore, $0.4xa \leqq b \leqq 0.6xa$ results.

When the smallest pinch roller is used ($b=(\sqrt{2}-1)a$) a distance c between the center of the conveying roller and a cross point 300 between the outer periphery of the second pinch roller and a tangential line between the first pinch roller and the conveying roller, satisfy:

$$c = \sqrt{(a-b)^2+a^2} = \sqrt{(2-\sqrt{2})^2a^2+a^2}$$

$$= \sqrt{7-4\sqrt{2}}\;a \approx 1.1589a$$

$$c \leqq 1.15a$$

From this, a phantom limit line 301 for the curved guide can be obtained. Therefore, even if the outer diameter of the pinch roller $b=(\sqrt{2}-1)a$, it is possible that the leading edge of the sheet material is urged toward the conveying roller by the curved guide before it abuts the outer periphery of the pinch roller, whereby it is guided by the outer periphery of the pinch roller, and the leading edge is received by the nip between the next pinch roller and the conveying roller, if the radius c of the portion R of the curved guide satisfies $c<1.15a$.

The experiments by the inventors show that when $a=15$, $b=6-7$, $c=16.5$, a thick sheet of paper having a basis weight of 135 g/cm$^2$ can be smoothly discharged.

The features of the examples are expressed in brief as follows:

(1) A conveying device for deflecting a sheet by approximately 90 degrees, comprising one conveying roller provided at an inside of a curved passage and imparting a driving force to the sheet and three pinch rollers press-contacted to the outer periphery of the conveying roller.

(2) A conveying device as defined in (1) wherein the sheet is discharged by the most downstream pinch roller and the conveying roller.

(3) The conveying device of (1) wherein the conveying roller has flanges at opposite ends, and the most downstream pinch roller is press-contacted to the outer periphery of the conveying roller at a position other than the flange.

(4) A sheet conveying device of (1) wherein the three pinch rollers are press-contacted to the conveying roller by a single leaf spring.

(5) A sheet conveying device wherein the conveying device is movable relative to the sheet accommodating device (tray).

(6) A sheet conveying device of (1), wherein a radius a of the conveying roller and a radius b of the pinch roller satisfy:

$$0.4 \times a \leqq b \leqq 0.6 \times a.$$

As described in the foregoing, by press-contacting three pinch rollers to the outer periphery of one conveying roller, a thick sheet can be smoothly deflected and conveyed.

By providing the conveying roller with flanges, the discharged sheet after the deflection is received by the tray improper manner.

By press-contacting the three pinch rollers by a single leaf spring, the structure is simple, and the pressure-contact is assured.

Figure 38:
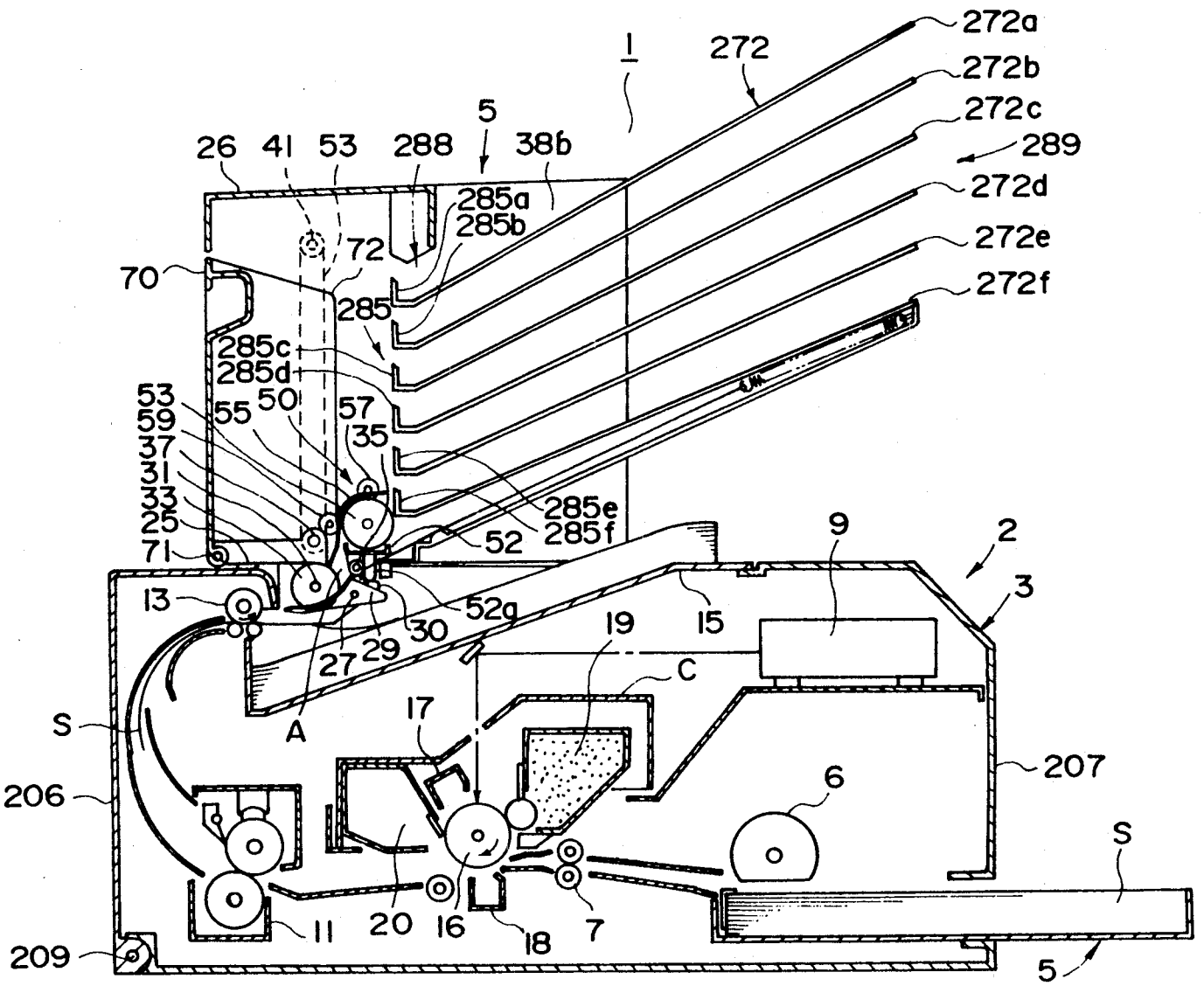
FIG. 38 is a sectional view of a sorter according to a further embodiment of the present invention.

Referring to FIG. 38, a further embodiment of the present invention will be described, wherein the inclinations of the sorter are increased gradually to improve the better reception of the sheet by the sorter. Bins 272*a*–272*f* of the sorter have base portions fixed to a side plate 38*b* with regular intervals between adjacent ones at the base portions. The inclination of any one of the bins is greater than the inclinations below it,.except for the bottommost bin. By disposing the bins 272*a*–272*e* in this manner, the intervals between adjacent bins at the free ends are larger than the intervals between adjacent ones at the base portion side.

The bottommost bin 272*f* is enclosed with a cover 276 to provide a space. In the space, a spring 277 having an end fixed to the cover 276 is accommodated. Between the spring 277 and the frame 52, a guiding member 69 in the form of a sheet is stretched.

In operation, the sheet S is subjected to an image forming operation and is discharged from the main assembly 3 of the image forming apparatus from the sheet discharging portion by the sheet discharging rollers. Then, it is guided to the inlet rollers 33 by the flapper 29. The sheet S is conveyed by the inlet roller 33 through the discharge sheet passage between the ribs 72 and the guiding member 69, into a nip formed between the discharging roller 53 and the roller 59. The sheet, being guided by the guiding plate 55, is discharged on the bottommost bin 272*f* by the discharging roller 53 and the roller 57. Similarly, the sheet S is discharged to the other bins 272*a*–272*e*.

In this embodiment, the sorter 5 is disposed adjacent the upper discharge outlet of the laser beam printer 2, and therefore, a long sheet S, when it is discharged to the bottom bin 272*f* of the sorter 5, is stretched between the sheet discharge unit 50 of the sorter 5 and the fixing rollers of the fixing device 11 of the laser beam printer 2. Therefore, if the discharging roller 53 of the discharging unit 50 is imparted by a discharging speed (discharging torque) which is much larger than the minimum dischargeable speed for the bottommost bin 272*f* of the sorter 5, the sheet discharging speed to the topmost bin 272*a* in which the stretching between the fixing device 16 and the sorter does not take place, the sheet discharging speed becomes high.

However, according to this embodiment, the inclinations of the upper bins are greater than the lower bins, and therefore, the inclination is greater toward the topmost bin 272, by which the returning force applied to the sheet S discharged on the bin, given by the gravity, is larger in the larger bins. Therefore, the trailing edges of the sheets are abutted to the wall place 285 of the bins 272 and aligned properly.

According to the inventors' experiment of this embodiment, when 6 bins 272 are used, 20 degrees of the bottommost bin 272*f* and the 25 degrees of the topmost bin 272*a* with increment of 1 degree have shown good result with the good returning abutment.

In addition, even if the number of sheets stacked on the bins 272 with the result of bending of the leading portions 289, the discharging and stacking of the sheets S on the bin 272 are not obstructed, because the intervals between the adjacent end portions 289 of the bins are larger than that at the base portions 272*b*. Therefore, the sheet S is smoothly stacked.

Figure 39:
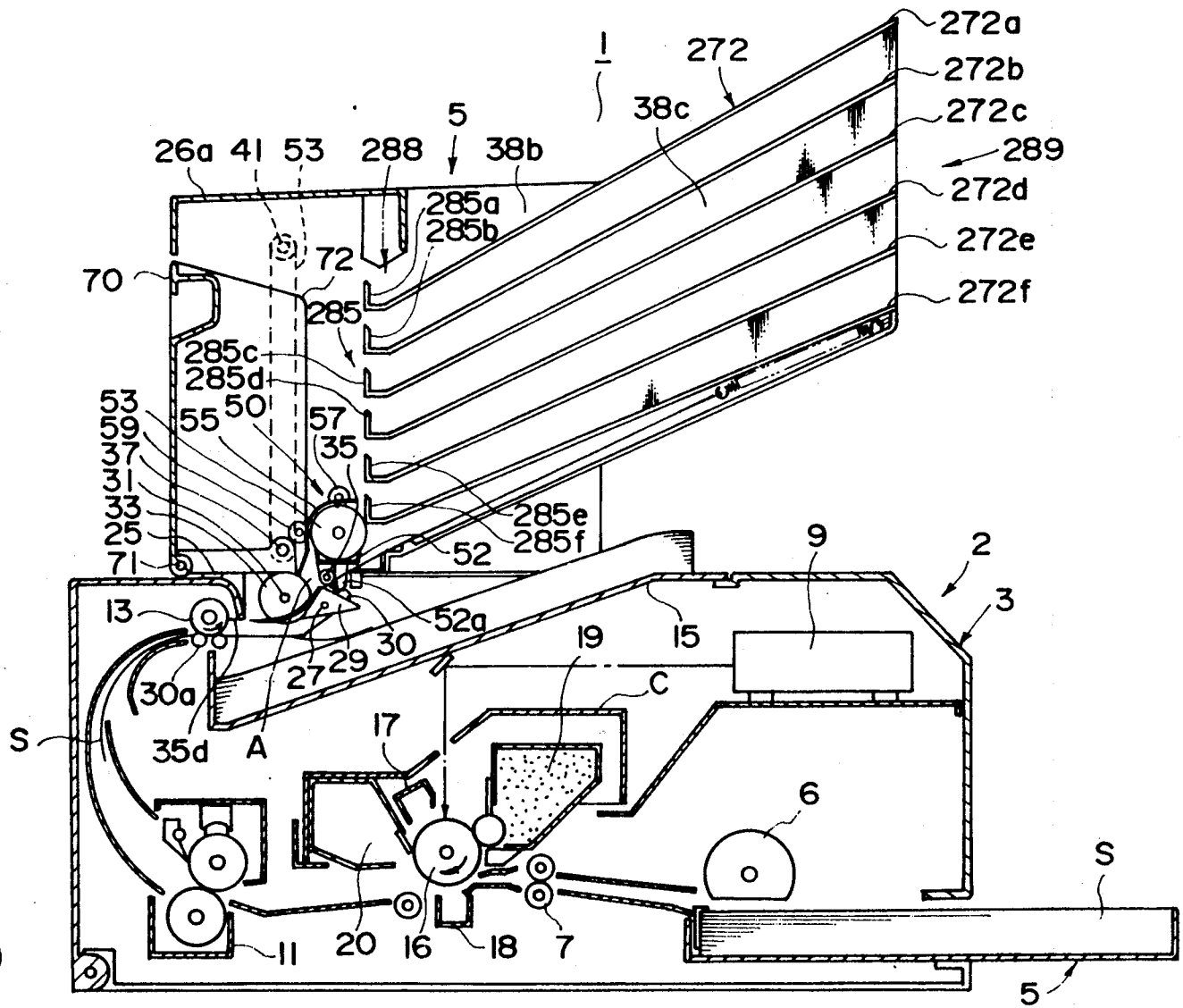
FIG. 39 is a sectional view of a sorter according to a further embodiment of the present invention.

FIG. 39 shows a further embodiment which is a modification of FIG. 38 embodiment. In this embodiment, the side plate 38*b* of the frame 38 of the sorter 5 is provided with an extension 38*c* at its front side (right side in this Figure) to enclose the sides of the bins 272. In the embodiment of FIG. 38, the sides of the bins 272*a*–272*f* of the sorter 5 are closed by the side plate 38*b* only partly adjacent to the base side 288. Therefore, the free end portions are flexed gradually with increase of the number of sheet stacked. In this embodiment, since the sides of the bins are completely closed by the side plate 38*b* and an extension 38*c*, and therefore, the free end portions of the bins 272 are assured in its opening angle irrespective of the number of stacked sheets S, so that the sheet S is always easily taken out.

Figure 40:
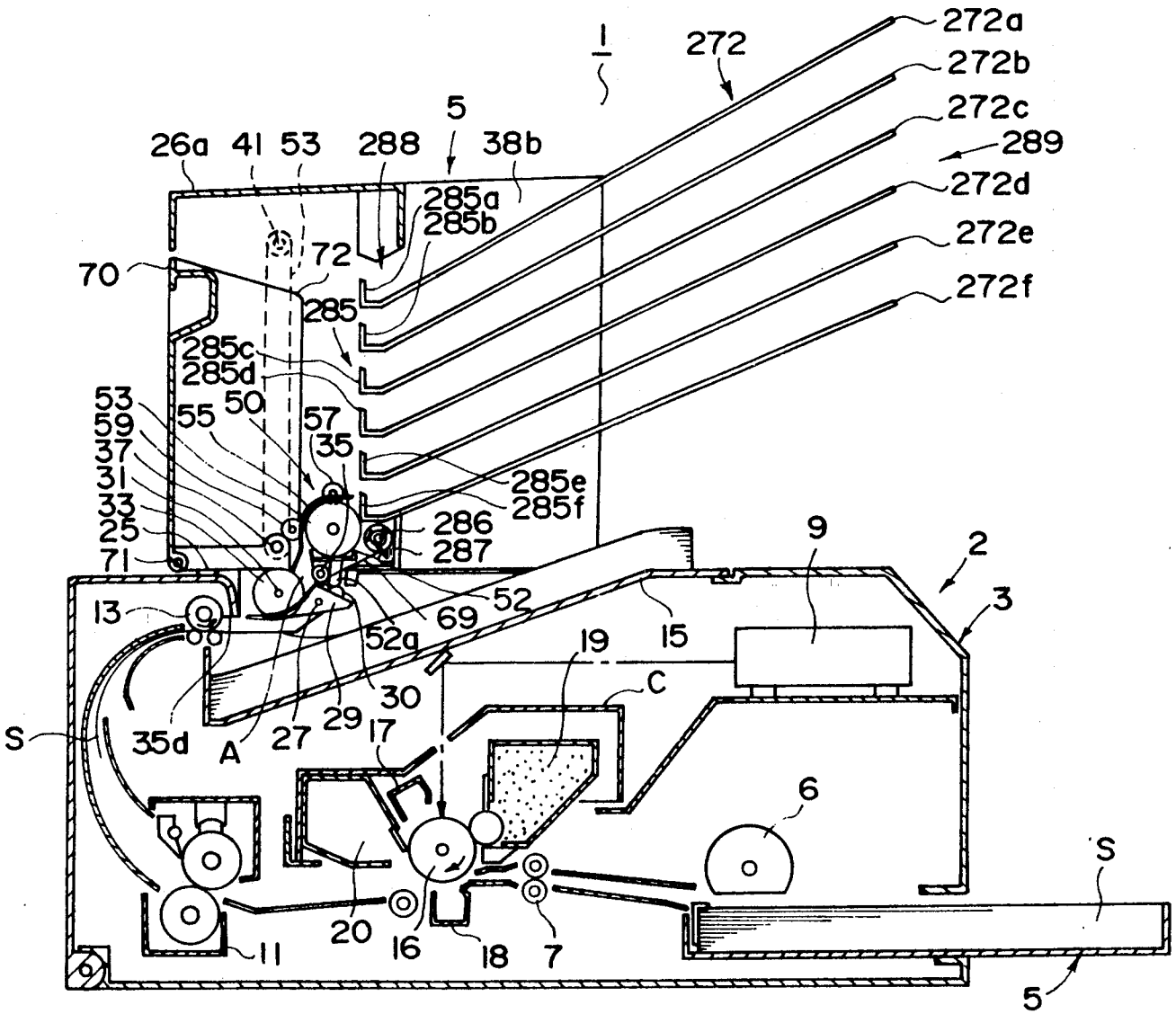
FIG. 40 is a sectional view of a sorter according to a further embodiment of the present invention.
Figure 41:
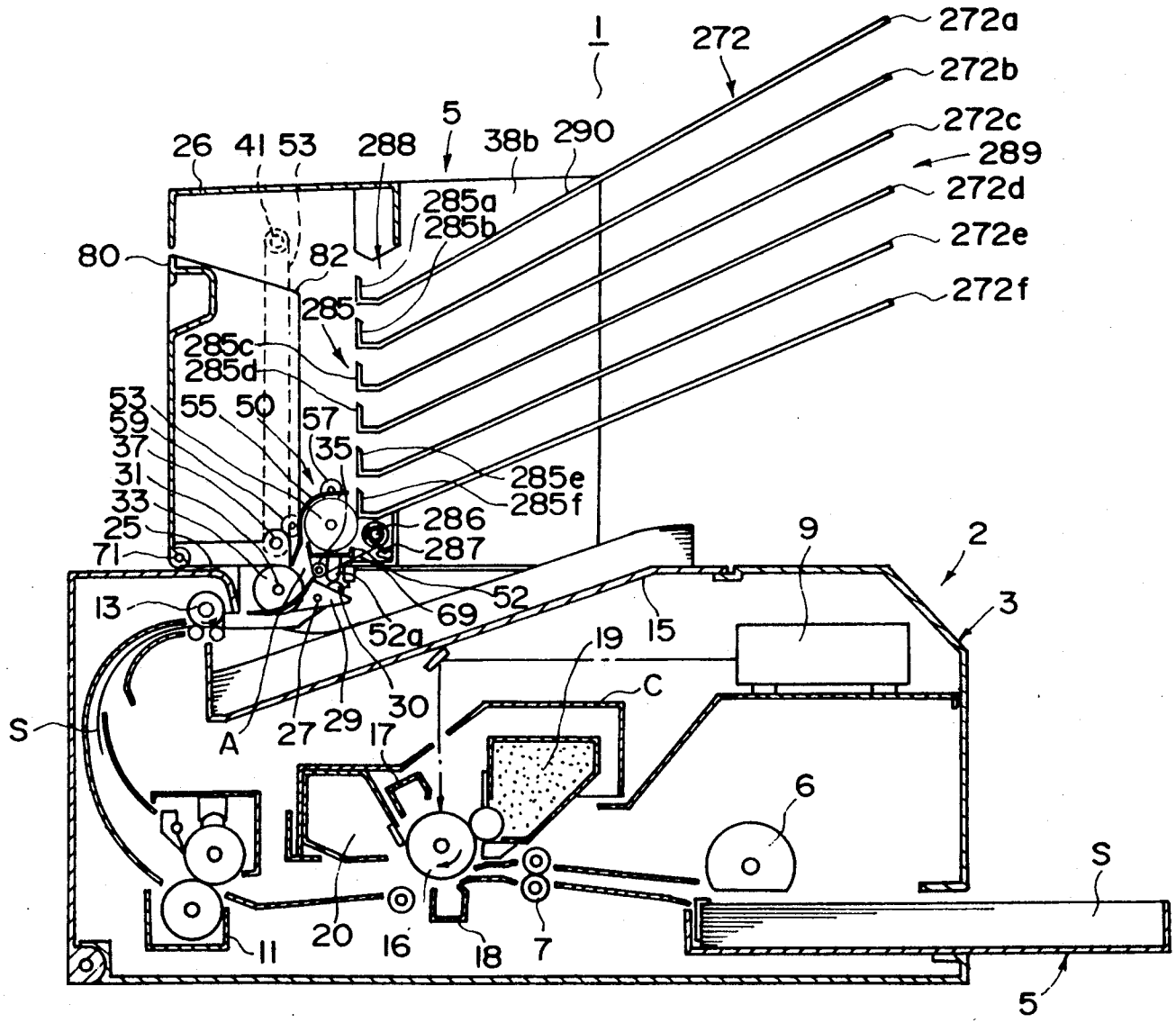
FIG. 41 is a sectional view of a sorter according to a further embodiment of the present invention.

FIG. 40 shows a further embodiment which is a modification of FIG. 38 embodiment. The conveyance of the sheet S to the sorter 5 is guided, as described hereinbefore, by the frame 72 of the door 70 and the guiding member 69 movable substantially vertically together with the sheet discharge unit 50, opposed to the frame 52. In this embodiment, an end of the guiding member 69 is fixed to the frame 52 similarly to the FIG. 38 embodiment. However, the other end is wound on a shaft 286. The shaft 286 is supported to the free end of the lever 287 having a base portion mounted to the frame 38. The guiding member 69 is urged counterclockwisely by an unshown coil spring, that is, in the direction applying tension to the guiding member 69.

By supporting the guiding member 69 in this manner, a large cover 66 (FIG. 1) is not necessarily below the bottommost bin 272*f*, and the degree of movement of the bin 272*f* is assured similarly to the other bins. Even if the number of stacked sheets S is increased, the sheet S can be smoothly taken out from any of the bins 272, since the intervals between the free end portions of the adjacent bins are large.

Figure 42:
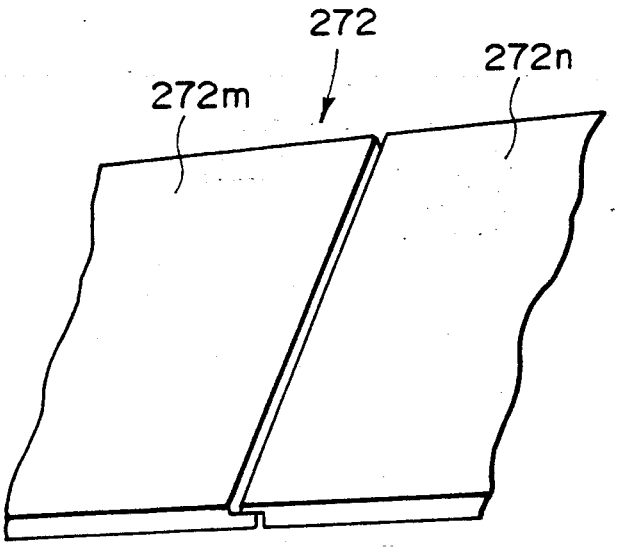
FIG. 42 is a perspective view of the sorter of FIG. 40.
Figure 43:
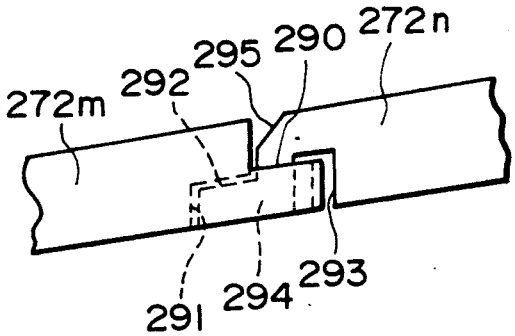
FIG. 43 is a side view of the sorter of FIG. 40.
Figure 44:
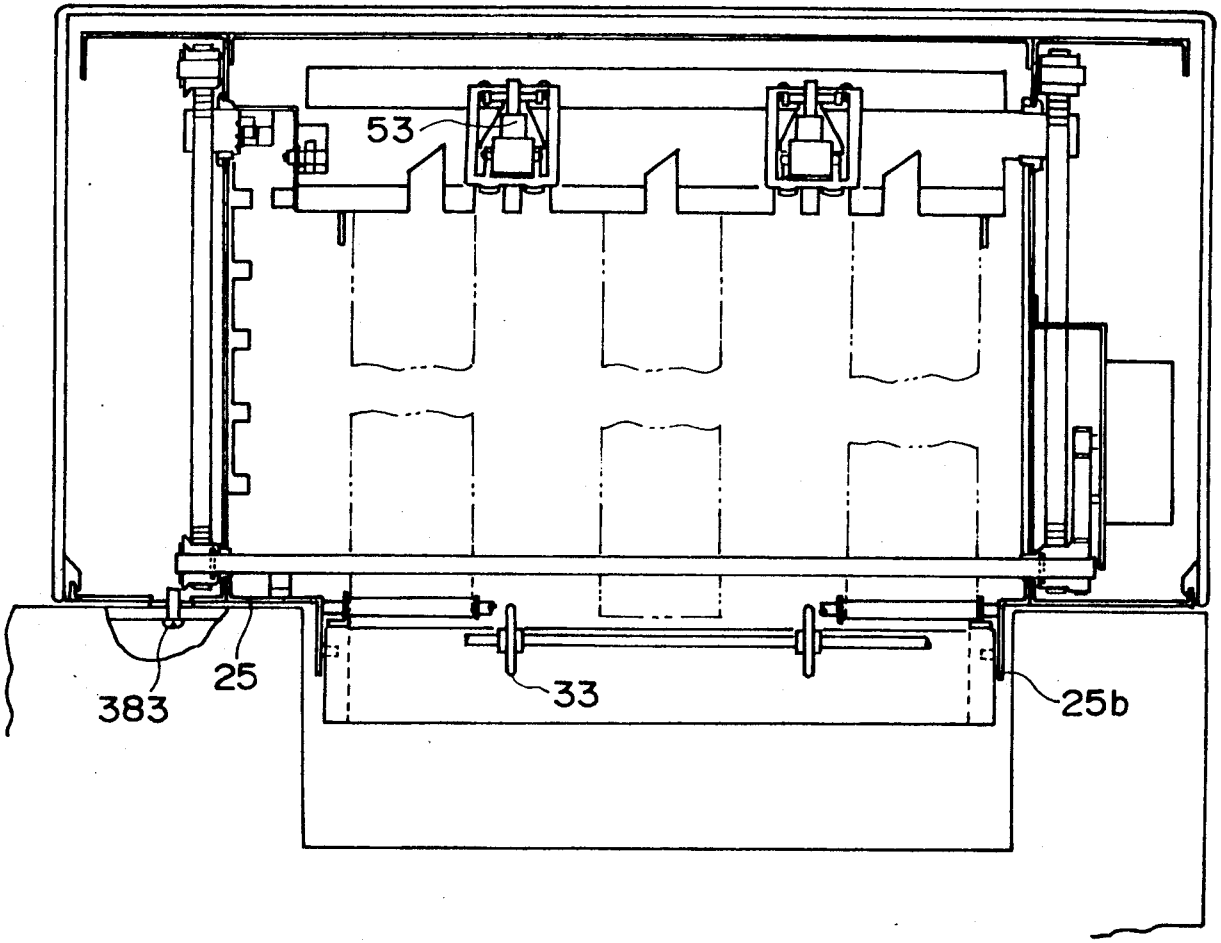
FIG. 44 is a rear sectional view of an image forming apparatus according to a further embodiment of the present invention.

FIG. 42 shows a further embodiment which is a further modification. FIGS. 42 and 43 show details of the connecting portion of the bins 272. In this embodiment, a step 290 is formed at a top surface of a free end of each of base side portion of bins 272*m*. A hole 291 is formed from the bottom side of the step 290, and it is partly penetrated to the top of the step 290. The free end side portion 272*n* of the bin is provided with a step 292 on the top surface of the base side, and a hole 293 is formed, so that an engaging portion 294 of L-shape is formed at the base side of the free end side bin 272. The engagement between the base side bin 272*m* and the free end side bin 272*n* are performed by inserting the engaging portion 294 of the free side bin 272*n* from upper right side into the hole 291. The edge at the base side of the free side bin 272*n* is relieved as indicated by reference 295 so that sheet 5 can be smoothly discharged. By constructing the sorter 5 in this manner, the base side bins 272*m* of the sorter 5 may be constituted as a unit, and the free side bins 272*n* may be commonly usable, so that the cost of the apparatus can be reduced.

As described, according to the foregoing embodiments, the intervals between adjacent bins arranged in multi-stages can be larger at the free end side than the base end side, by which the sheet being discharged is prevented from poping out of the tray and falling. In addition, even if the number of the sheets S stacked on the bins is increased, the space between adjacent bins at the free end sides is not reduced too much, and therefore, the further discharge of the sheet is not obstructed.

Furthermore, the expansion of the intervals at the free end sides makes the sheet handling by the operator easier.

Referring back to FIG. 38, the image forming apparatus 1 is constituted by a laser beam printer 2 and a sorter (sheet processing apparatus) 5 mounted on the top of the main assembly of the laser beam printer 2. The main assembly 3 is constituted by an upper unit 206 and a lower unit 207, wherein the upper unit 206 is rotatable about a shaft 209 to be opened from the lower unit 207.

Figure 45:
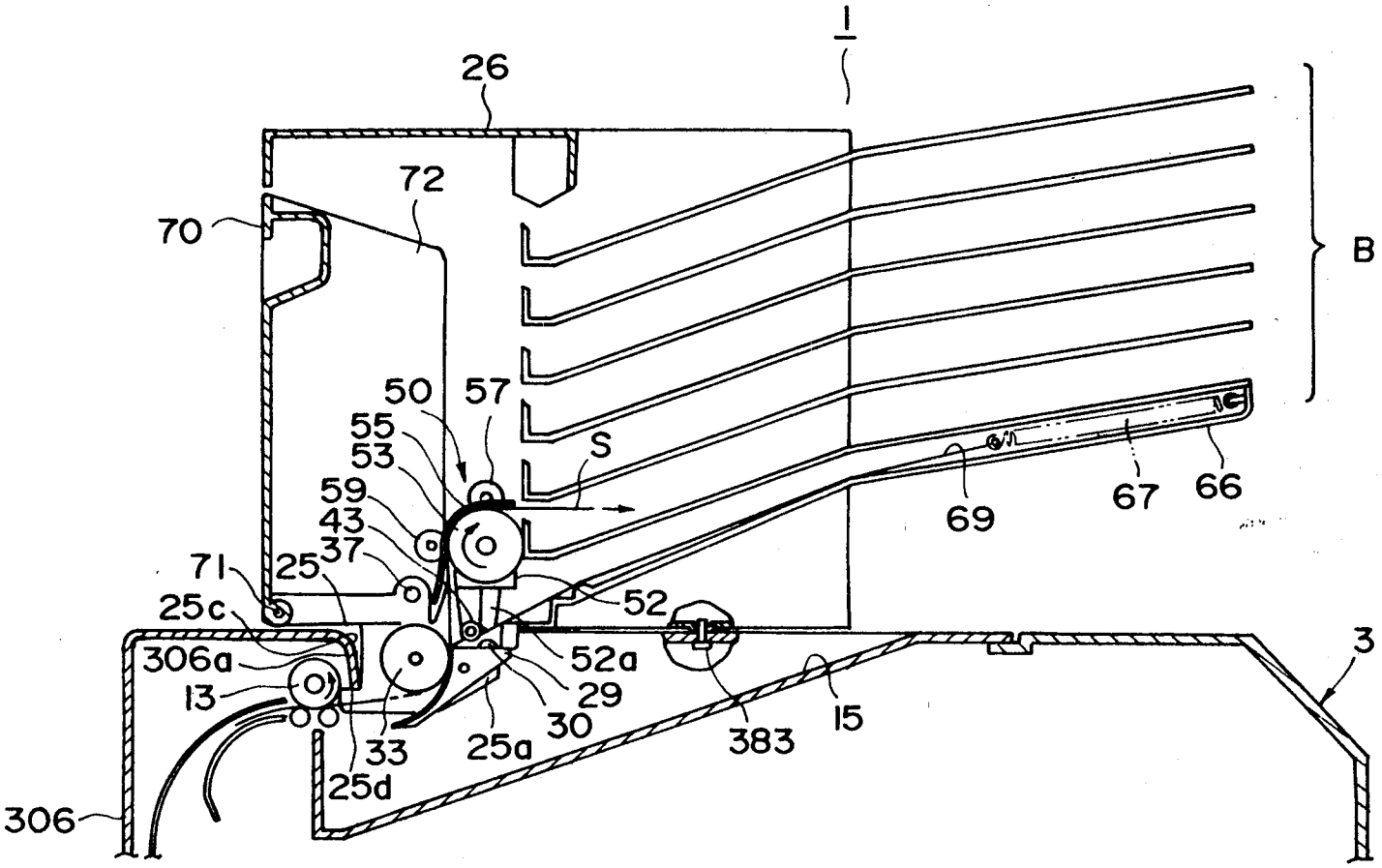
FIG. 45 illustrates an operation of the sorter.

Referring to FIG. 45, the description will be made as to the mounting of the sorter to the image forming apparatus.

In this embodiment, the sorter has two engaging portions, each of which includes a vertical surface 25*c* and a horizontal surface 25*d* formed in extensions 25*a* and 25*b* of the sorter 5. When the sorter 5 is to be mounted on the upper unit 306, the engaging portions are hooked with the engaging portion 306*a* of the upper unit 306. In addition, the sorter 5 is secured by a screw at another portion. Therefore, it will suffice if the top surface of the upper unit 306 is provided with a hole, and therefore, a minimum number of hole on the top surface of the top unit 306 is sufficient.

Alternatively, when the sorter is to be mounted, the sorter 5 is placed on the upper unit 306 and is slide on the top surface of the upper unit 306 functioning as a guide, or it may be engaged with the engaging portion 306*a* while being rotated in the clockwise direction. Since the securing by the screw is carried out at only one position, it is necessary to provide means for preventing rotation of the sorter 5 in a horizontal plane relative to the main assembly of the apparatus 3. As for the measure for the rotation prevention, it is possible that a cut-away portion is formed on a part of the engaging portion 306*a* of the unit 306, and is engaged with a horizontal projection 25*d* of the sorter 5, or that the outer sides of the extensions 25*a* and 25*b* of the bottom stay 25 of the sorter 5 is fitted to the inside sides of the discharge tray 15 of the main assembly or may be slightly smaller.

Figure 46:
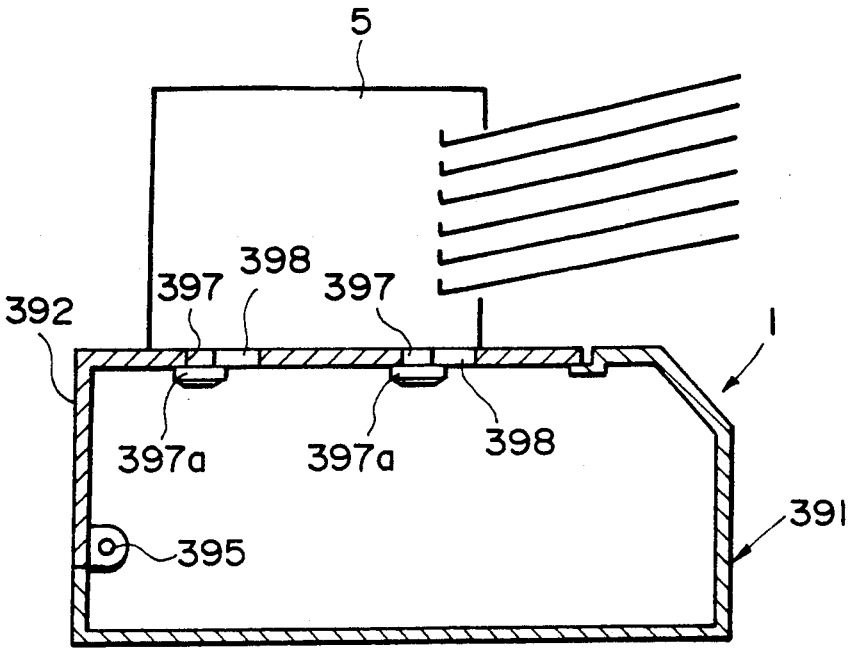
FIG. 46 is a sectional view of an image forming apparatus according to a further embodiment of the present invention.
Figure 47:
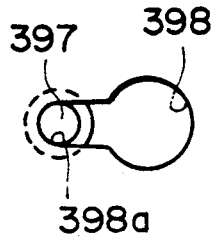
FIG. 47 is a top plan views illustrating an engagement hole of FIG. 46 apparatus.
Figure 48:
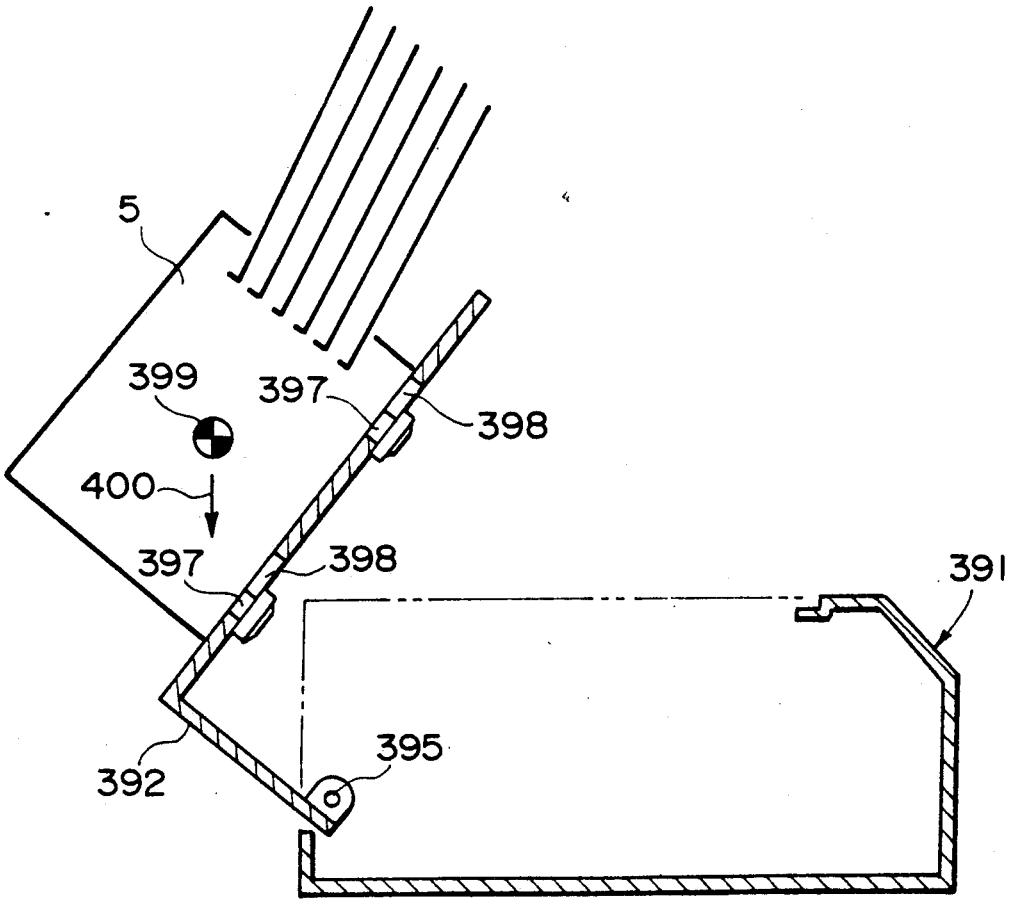
FIG. 48 is a front sectional view illustrating function of the hole of FIG. 46.

FIGS. 46 and 47 shows a modification. The main assembly 391 of the image forming apparatus 1 is constituted by an upper unit 392 and a lower unit 393. The upper unit is rotatable about a shaft 395. The sorter (sheet handling apparatus) 5 mounted on the main assembly 391 is provided, at the junction surface with the main assembly 391, an engaging member 397 having a large diameter portion 397*a* at an end. On the top surface of the image forming apparatus 1, an opening 398 having a hole and a smaller width elongated hole (engaging portion) 398*a* are formed at a position corresponding to the engaging member 397.

In FIGS. 46 and 47, the sorter 5 is shown as having been mounted on the main assembly 391 of the image forming apparatus 1.

When the upper unit 309 is rotated in the counterclockwise direction from the state shown in FIG. 8, the gravity applies to the center of gravity 399 of the sorter 5 in the direction indicated by an arrow 400, the engaging member 397 is displaced to the elongated slot 398*a* of the hole 398 so as to be assuredly engaged without the possibility of unintentional dismounting of the sorter 5 from the image forming apparatus. When the sorter 5 is dismounted from the image forming apparatus 1, the sorter 5 is moved rightwardly in the Figure, by which the engaging member 397 is disengaged from the hole 398, and therefore, the sorter 5 can be dismounted without difficulty.

Figure 49:
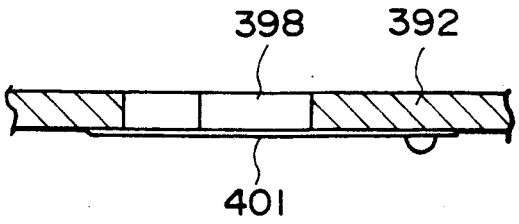
FIG. 49 shows another example of the engaging hole.

According to this modified embodiment, by forming two or three simple holes 398 on the top surface of the main assembly 391, the sorter 5 can be positively mounted and positioned relative to the image forming apparatus without the necessity of the screws. When the sorter is kept not attached to the image forming apparatus, the holes 398 of the main assembly 391 is preferably covered with a blind cover, or a flexible closing member 401, as shown in FIG. 49, is provided below the holes 398 to blind the hole.

Figure 50:
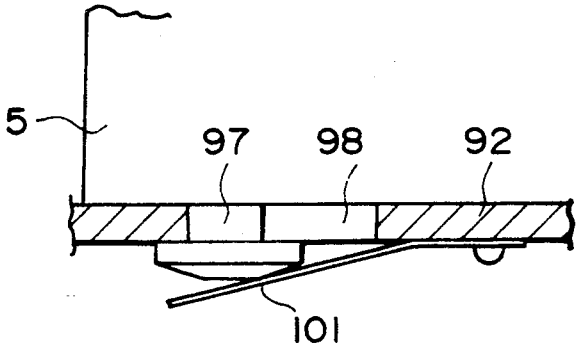
FIG. 50 is a sectional view illustrating the function of the hole.

As shown in FIG. 50, when the sorter 5 is mounted, the covering member 401 is pressed by the engaging member 397 and is flexed to allow the engaging member 397 to be inserted into the holes 398. The covering member 401 confines the free end of the engaging member 397 to assure the positioning of the sorter 5.

Figure 51:
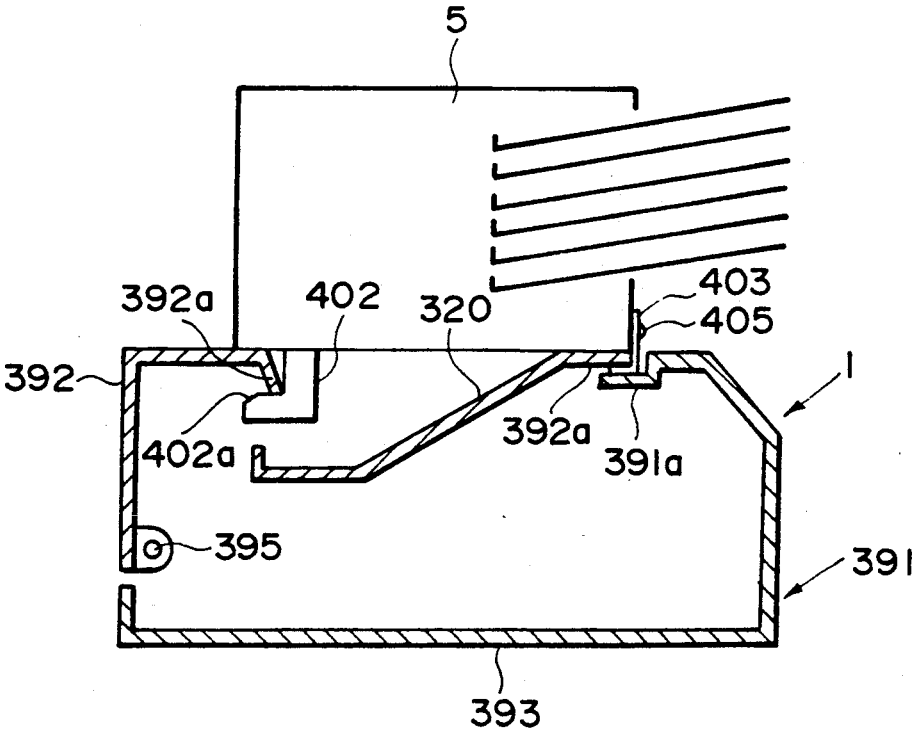
FIG. 51 is a sectional view of a sorter according to a further embodiment of the present invention.

FIG. 51 shows a further modification, wherein the bottom of the sorter 5 is provided with two L-shaped engaging members 402, which can be fitted into the inside of the walls of the discharging tray 320 of the upper unit 392. The free end portion of the engaging member 402 is bent toward the shaft 395 and is engageable with the engaging portion 392*a* of the upper unit 392. Adjacent the free end of the engaging member 402, an inclined portion 402*a* is formed to facilitate engagement with the engaging portion 392*a*. The upper unit 392 is normally urged in the counterclockwise direction, and a clearance is formed between the right end portion 392*a* of the upper unit 392 and the receiving portion 391*a* of the lower unit 393. Into the clearance, an L-shaped locking member 403 is inserted to grip the receiving portion 391. The locking member 403 is fixed by a screw 405 on the sorter 5.

In this modified embodiment, The sorter 5 can be mounted to the main assembly 391 without modifying the main assembly 391, and therefore, the sorter 5 is usable with the printers already sold.

Figure 52:
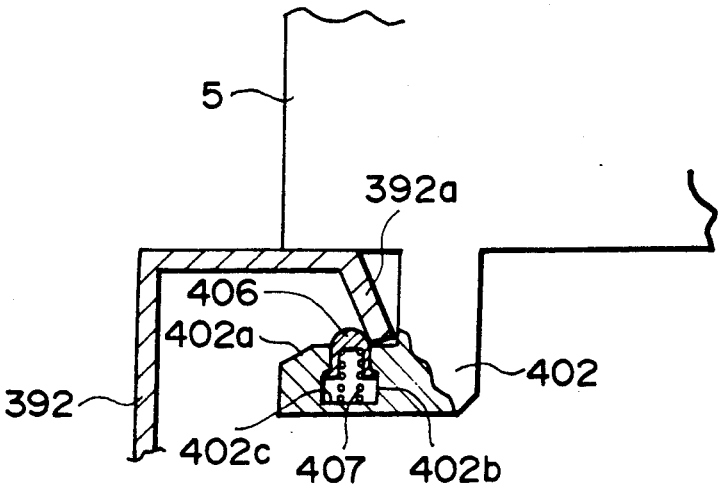
FIG. 52 is a sectional view illustrating a mounting portion of the sorter.

FIG. 52 shows a further modification, wherein into a hole 402*c* formed in the horizontal portion 402 of the engaging member 402, a pin 406 is inserted with means for preventing disengagement. The pin 406 is urged in its projecting direction by a compression spring 407, and the top end extending from the body is contacted to the backside of the engaging portion 392*a* to assure the positioning of the sorter 5. When the sorter 5 is displaced rightwardly in a horizontal plane, the pin 406 is abutted and pressed by the engaging portion 392*a* and is retracted, so that it is disengaged to allow the sorter 5 to be dismounted.

In this modified embodiment, when the sorter is to be mounted, the sorter 5 is moved from the right side to the left side to abut it to the upper unit 392, by which the mounting is completed. Even if force of certain degree is applied to the sorter, it is not deviated from the correct position. When the sorter 5 is to be dismounted, the sorter 5 is displaced rightwardly fairly strongly, by which the sorter 5 is dismounted. Similarly to the other embodiments, when the upper unit 392 is rotated to open the apparatus, the force is automatically applied to strengthen the engagement between the engaging member 402 and the engaging portion 392*a*, and it is not usual that the rightward force applies, and therefore, the mounting or dismounting of the sorter 5 is not obstructed.

Figure 53:
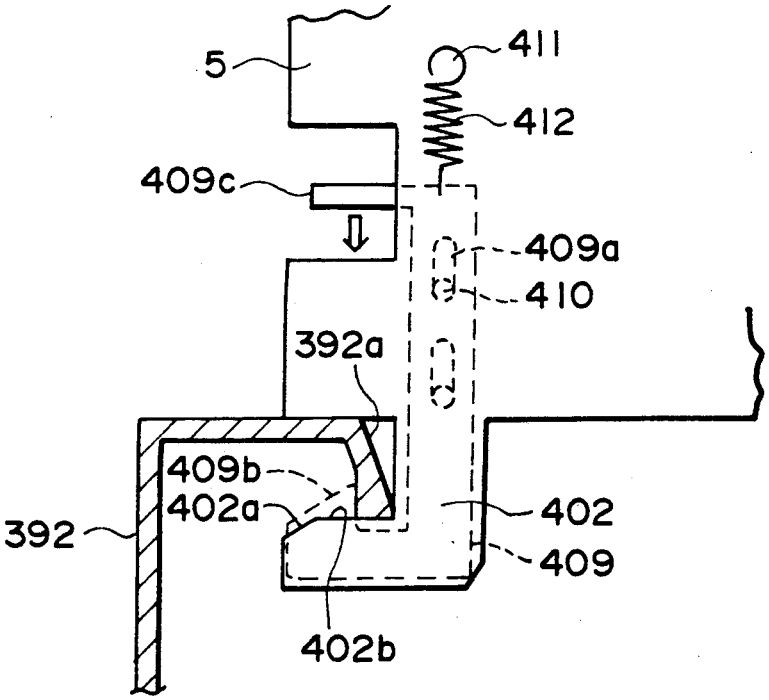
FIG. 53 shows another example of the mounting portion.

FIG. 53 shows a further modified embodiment, wherein a locking member 409 is provided with an elongated slot 409*a* engageable with a couple of pins 410 mounted on the sorter 5, and is vertically movably mounted on the sorter 5. The locking member 409 is normally upwardly urged by a tension spring 412 having a top end fixed to a pin 411 of the sorter 5. The locking member 409 has an inclined portion 409*b* extended upwardly from the horizontal portion 402*b* of the engaging member 402 fixed to the bottom thereof. The engaging portion 392*a* is gripped by the engaging member 402 and the inclined portion 409*b* for the positioning.

When the sorter 5 is to be mounted, the sorter 5 is moved from the right side to the left side similarly to the previous modified embodiment, by which the inclined portion 409*b* of the locking member 409 is pressed by the engaging portion 392*a* so that the locking member 409 lowers. By the further pressing, the inclined portion 409*b* is engaged with the back surface of the engaging portion 392*a*. When the locking of the sorter 5 is to be released, the lever 409*c* at the top end of the locking member 409 is lowered to disengage the inclined portion 409*b* from the engaging portion 392*a*, and then, the entire sorter 5 is slide rightwardly, by which the dismounting is completed. In this embodiment, the lock releasing of the sorter 5 includes one more step than the foregoing modified embodiment, but the locking function is more assured.

Figure 54:
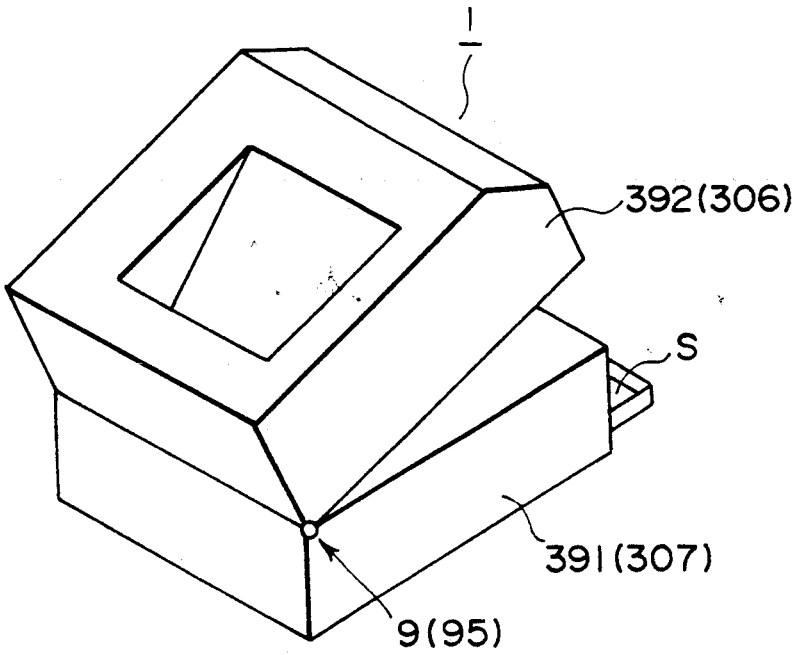
FIG. 54 is a perspective view wherein an upper unit is opened in the apparatuses of FIG. 44, FIG. 46, FIG. 51, FIG. 52 and FIG. 53.

In the foregoing modified embodiments, the pivoting shafts 309 (395) of the upper unit 306 (392) extend in a direction perpendicular to the direction of the sheet S movement, as shown in FIG. 54.

Figure 55:
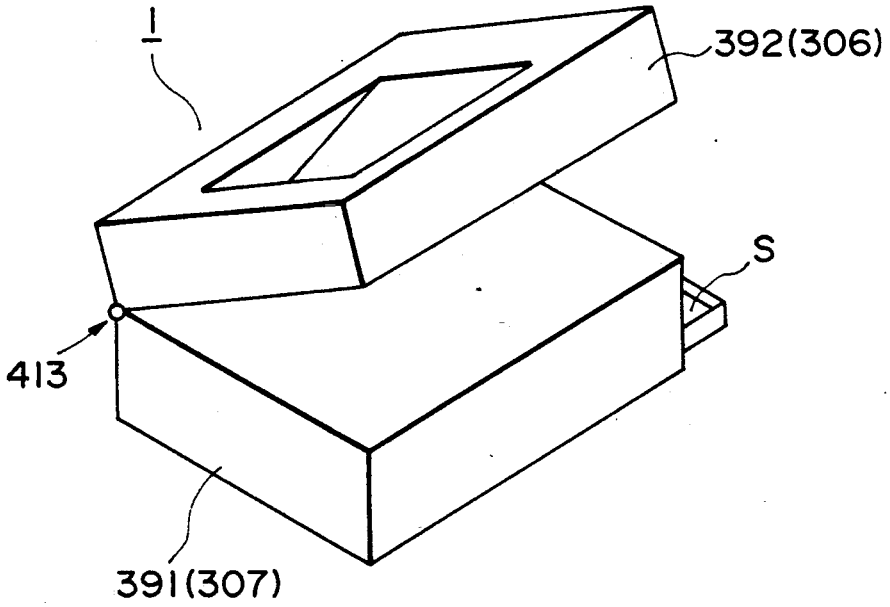
FIG. 55 shows another example of the opening of the upper unit.

As shown in FIG. 55, however, those embodiments are applicable to an image forming apparatus 1 wherein the pivot shaft 413 extends parallel with the sheet conveyance direction.

Figure 56:
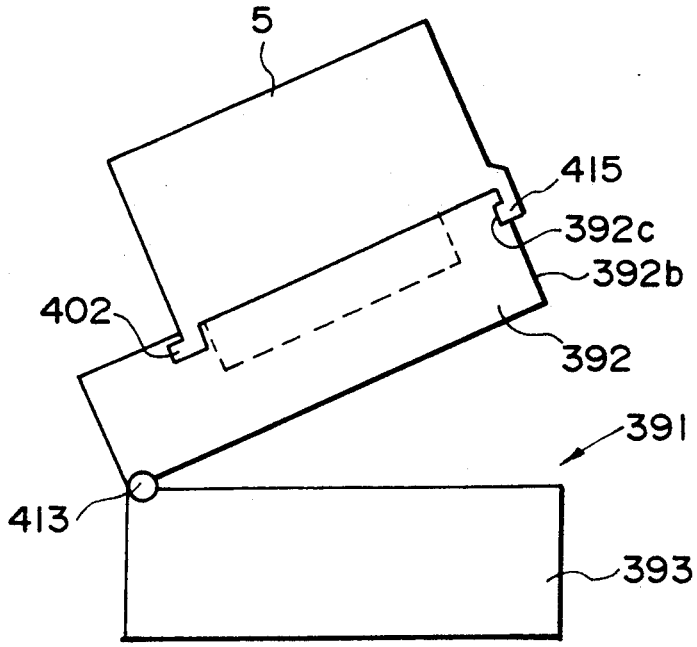
FIG. 56 is a rear view of the sorter in which the structure of FIG. 55 is employed.

FIG. 56 shows a further modification, wherein the upper and lower units 392 and 393 are connected by the shaft of FIG. 55. The sorter 5 is mounted to the main assembly 391 constituted by the upper and lower unit 392 and 393. In this embodiment, the engaging member 402 mounted on the upper unit 392 is similar to that shown in FIG. 53. A projection 415 of the sorter 5 is engageable with a hole 392*c* formed in one side 392*b* of the upper unit 392. The locking of the sorter 5 may be effected by fixing the projection 415 to the side surface 392*b* of the sorter 5 screw or screws, or an engaging member 402 may be used similarly to the embodiment of FIG. 53.

Figure 57:
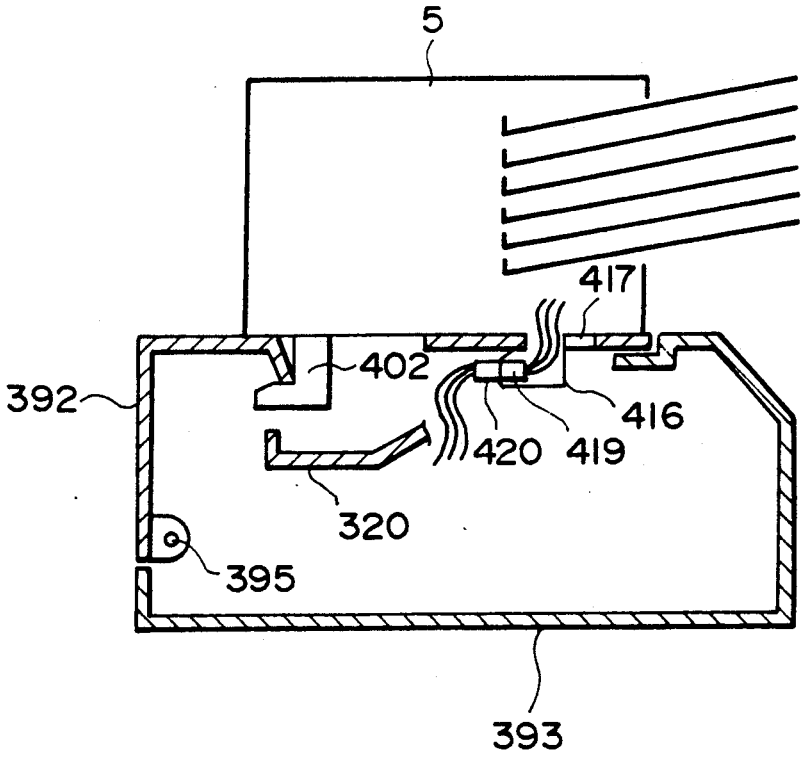
FIG. 57 is a sectional view of a sorter according to a further embodiment of the present invention.

FIG. 57 shows a further modification, wherein an L-shaped projection 415 is extended from the main assembly 3 of the sorter 5. The projection 416 is engaged with a hole 417 formed on the top of the upper unit 392. To the free end of the projection 416, a connector 419 is fixed; and the connector 419 is detachably engaged with a connector 420 fixed to the lower unit 393. The connectors 419 and 420 are to connect power supply lines or control signal lines to the sorter 5. By sliding the sorter 5 from right side to the left side in FIG. 57, the mechanical and electric connections between the image forming apparatus 1 and the main assembly 3 are all accomplished, so that there is no need of wiring outside of the image forming apparatus.

As described, according to the embodiment, the sheet processing apparatus is provided with an extension having an end bent to be directed to a pivot shaft of the image forming apparatus. By doing so, the upper unit of the image forming apparatus is rotated about the pivot shaft, the weight of the sheet processing apparatus functions to strengthen the engagement between the bent portion and the upper unit, so as to enhance the mounting of the sheet processing apparatus and the image forming apparatus. In addition, even if the operator forgets locking such as locking by a screw after the operator mounts the sheet processing apparatus on the main assembly, the upper unit is prevented from falling when the upper unit is rotated about the pivot shaft.

The description will be made as to embodiments for allowing sheet jam clearance in the sorter.

Figure 58:
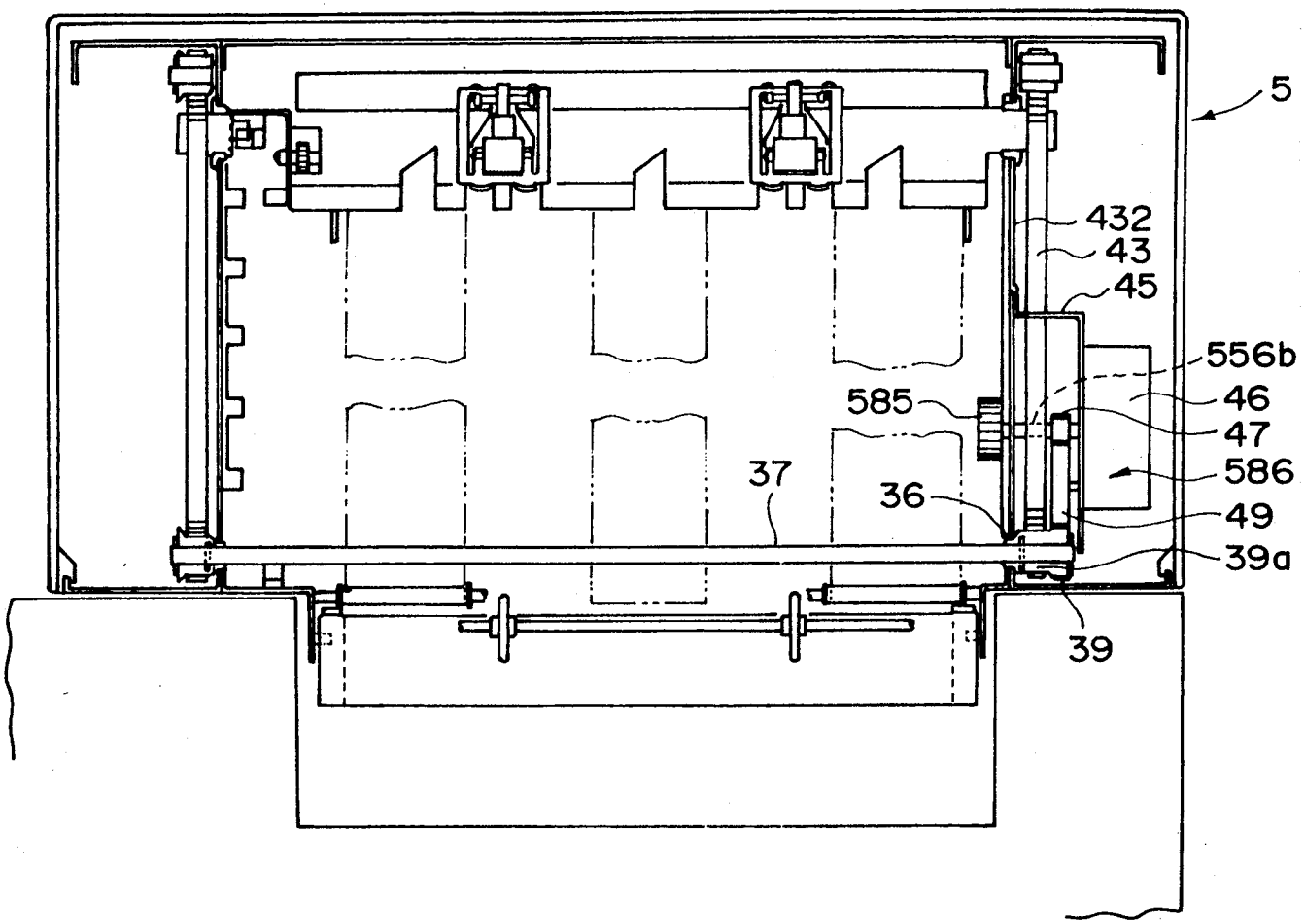
FIG. 58 is a top plan view of a sorter according to a further embodiment of the present invention.

Referring to FIG. 58, a driving pinion 47 is meshed with a gear 39*a* of the pulley 39*a* through an idler gear 49 mounted on a supporting plate 45. An output shaft 556*b* of the motor 46 is penetrated through a side plate 532. At a free end, a manually operable means 585 is mounted for manually rotating the motor 46. A drive transmission mechanism 586 is constituted by the driving pinion 47, the idler gear 49, the gear 39 of the pulley under the elements.

The motor 46 (driving source) is provided with a manual means 585, as described hereinbefore. When the jam of the sheet occurs in the sorter 5, the door 70 is opened, and the manual means 585 is rotated in a proper direction, by which the sheet discharge unit 50 is manually moved to a desired position. The sheet discharge unit 50 may be moved without operating the driven side, that is the sheet discharge unit 50 side, and therefore, the movement of the unit 50 and the disposal of the jammed sheets are made easier.

Figure 60:
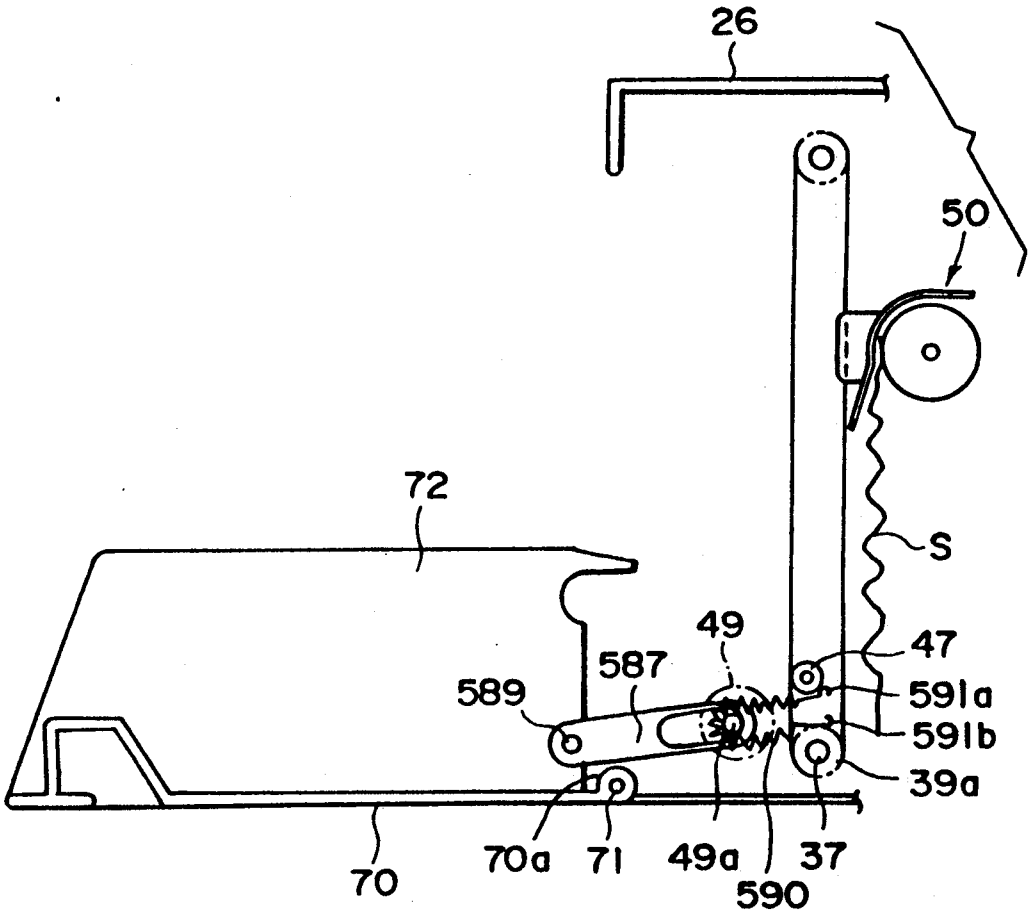
FIG. 60 illustrates operation of the sorter.
Figure 59:
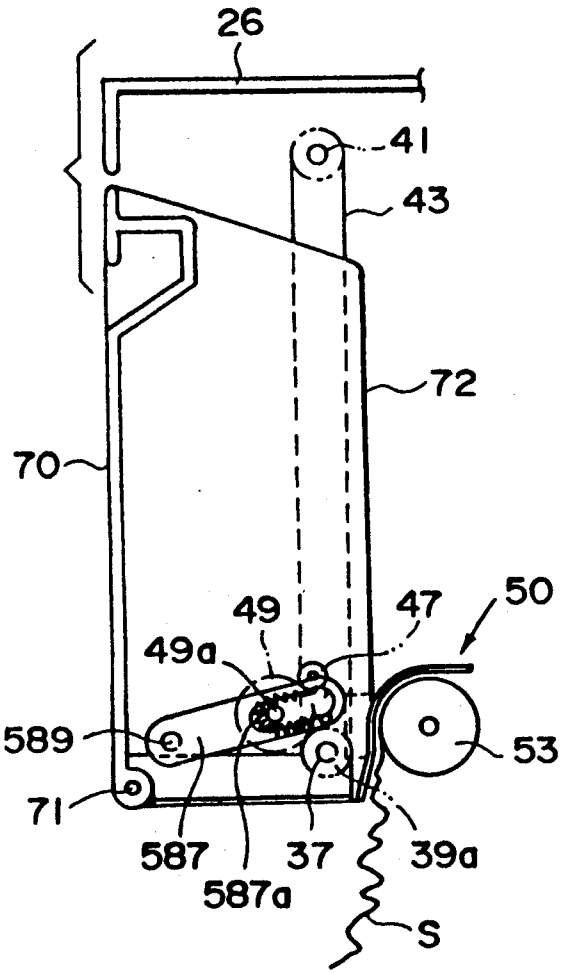
FIG. 59 is a sectional view of a major portion of a sorter according to a further embodiment of the present invention.
Figure 61:
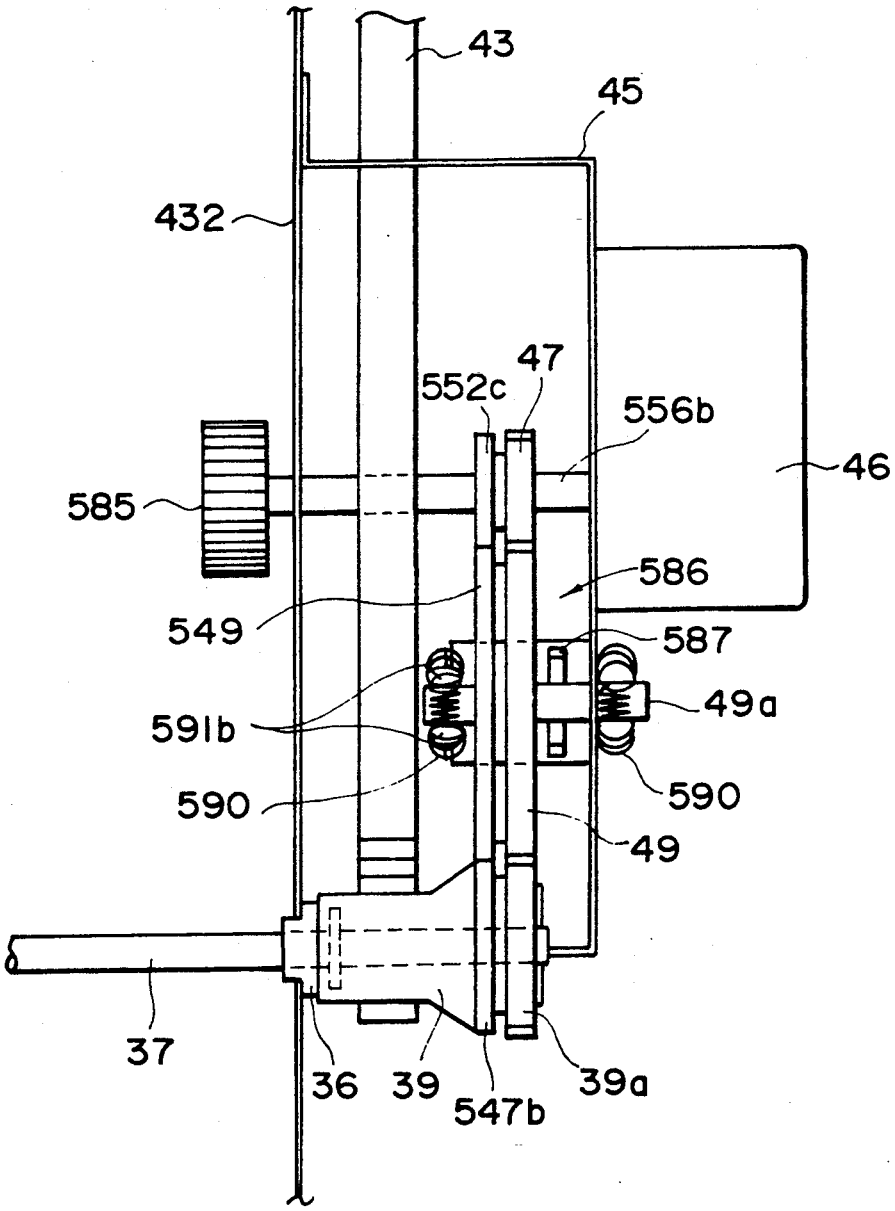
FIG. 61 is an enlarged view of a major portion of the arrangement shown in FIG. 59.
Figure 63:
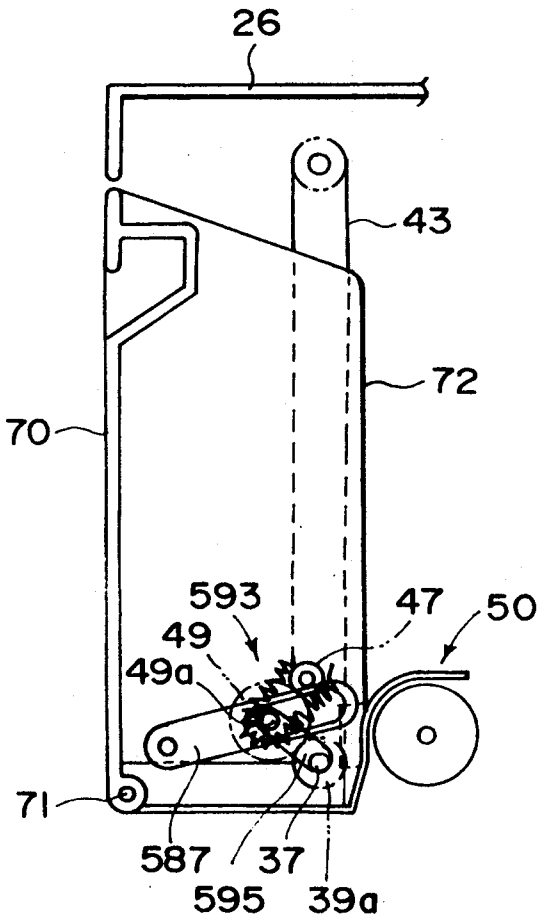
FIG. 63 is a sectional view of the apparatus according to a further embodiment of the present invention.

FIGS. 59, 60, 61 and 62 show a modification. In FIGS. 59, 61 and 63, a shaft 49*a* of the idler gear 49 is loosely fitted in an elongated slot 587*a* formed in a supporting lever 587. The base portion of the supporting lever 587 is rotatably mounted on the ribs 72 of the door 70 by a shaft 589. The shaft 49 is hooked by a couple of tension springs 590 at opposite ends thereof. The ends of the tension spring 590 are engaged with an engaging hole 591*a* and an engaging tab 591*b* of the supporting plate 45. By the spring force of the tension spring 590, the idler gear 49 is urged to the driving pinion 47 and to the gear 39*a* by a uniform spring force.

Figure 62:
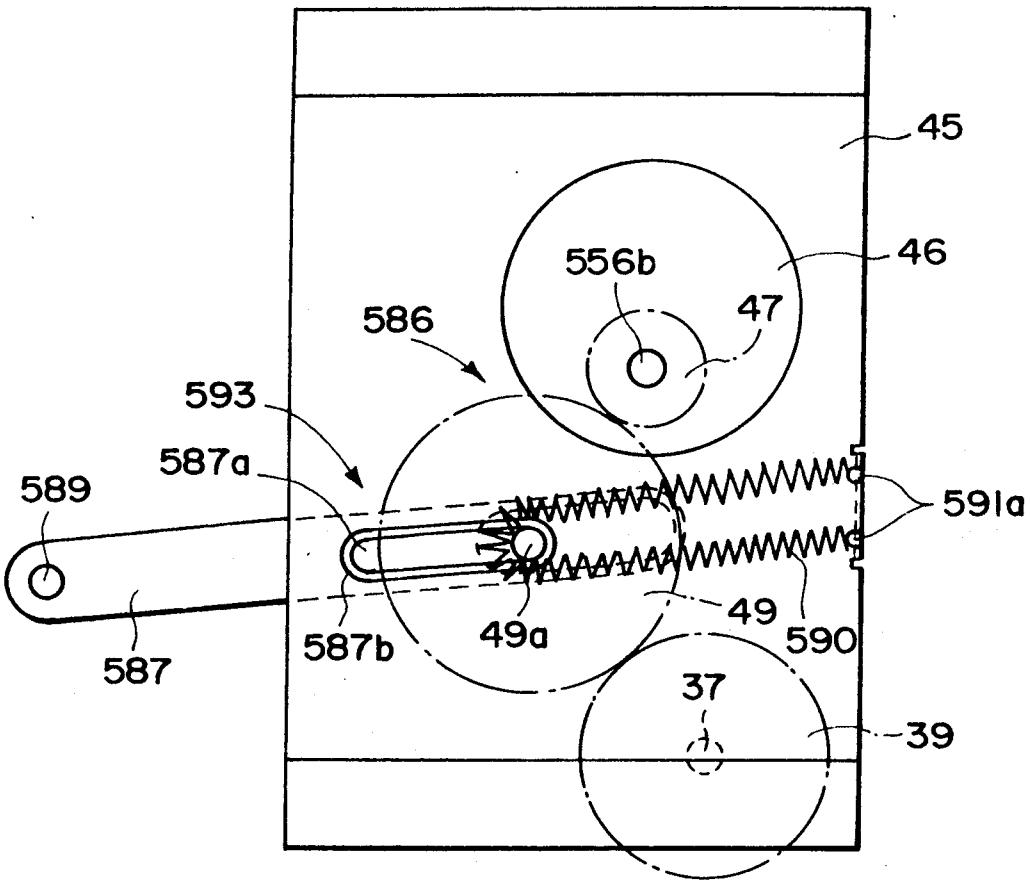
FIG. 62 illustrates the operation of the same.

As shown in FIG. 61, an abutment 549 is integrally formed with the idler gear 49 and the abutment 549 are abutted to abutments 552c and 547b integrally formed on the driving pinion 47 and the gear 39, respectively, so as to maintain the pressing among the gears 47, 49 and 39. In the elongated slot 587a of the supporting lever 587, a bearing member 587b is press-fitted, as shown in FIG. 62.

In this manner, the idler gear 49 is selectively meshable with the driving pinion 47 or the gear 39, by which the drive transmission mechanism 586 constituted by the idler gear 49, the driving pinion 47, the gear 39 selectively establishes the driving connection thereof. A releasing mechanism 593 for releasing the drive transmission of the drive transmission mechanism 596 is constituted by the supporting lever 587, the shaft 49a, the tension spring 590 and others.

FIGS. 59 and 60 show the state wherein the door 70 is opened. The supporting lever 57 pulls the shaft 47a against the spring force of the spring 590, so that the idler gear 49 is separated from the driving pinon 47 of the motor 46 and the gear 39. Therefore, when the sheet S is jammed at the position where the sheet discharge unit 50 (sheet discharging means) is located, the drive transmission of the drive transmission mechanism 586 for the vertical movement of the sheet discharge unit 50 is released by opening the door 70, as shown in FIG. 60.

By manually operating the manually operating means 585, the sheet discharge unit 50 can be moved to a desired position, that is, the position for easy jam clearance operation. The movement of the sheet discharge unit 50 can be effected without operation of the driven side, and therefore, can be effected without difficulty.

In FIG. 60, by contacting the bottom end portion of the idler gear 49 to the base portion 70a of the door 70 when the door 70 is opened, the supporting lever 587 functions as a stopper when the door 70 is opened.

Figure 64:
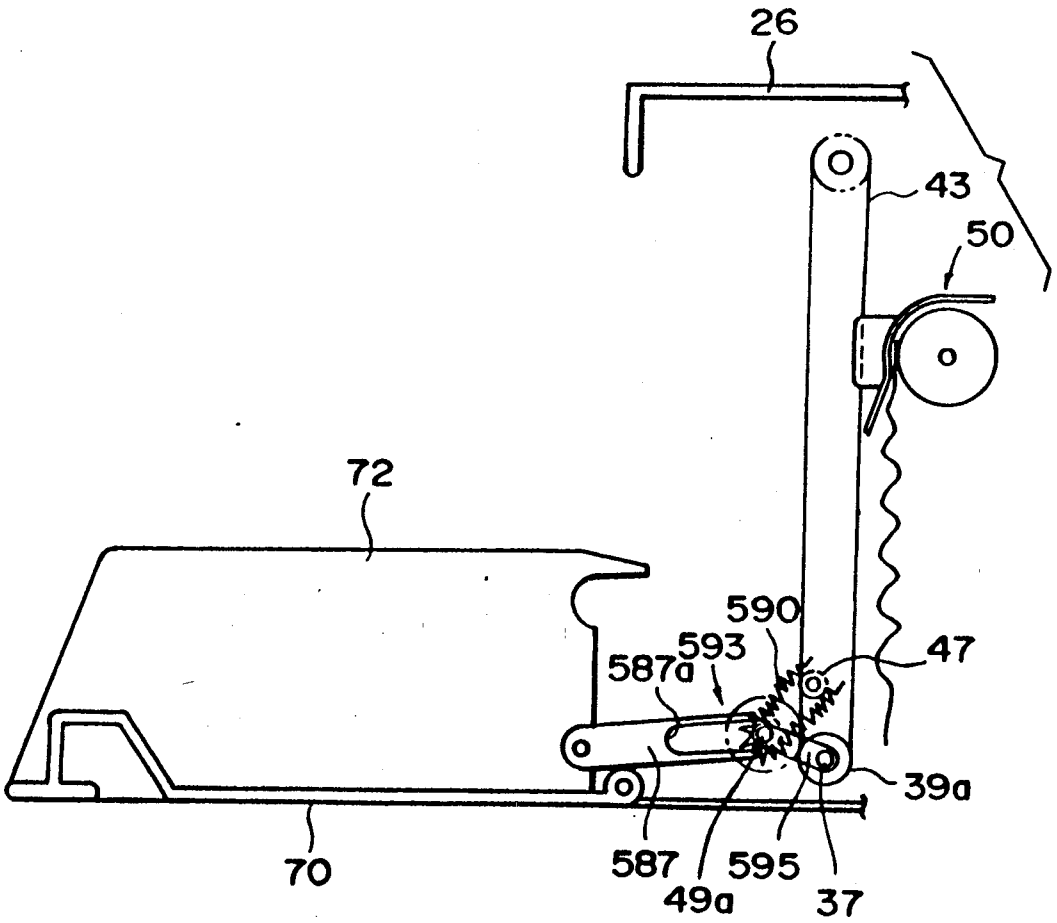
FIG. 64 illustrates the operation thereof.

FIGS. 63 and 64 show a further modified embodiment, wherein an end of a connecting member 595 is rotatably mounted to the shaft 49a of the idler gear 49, and the other end of the connecting member 595 is rotatably mounted on the shaft 37 of the gear 39. When the door 70 is opened, the idler gear 49 moving in association with the opening action of the door 70 rotates about the shaft 37 while it is always being meshed with the gear 37a, and is disengaged only from the driving pinion 47. In this manner, the establishment and release of the drive transmission by the drive transmission mechanism 586 by the idler gear 49 is carried out only by separable engagement with the driving pinion 47, and therefore, the possible failure of the meshing engagement with the gear can be reduced as compared with the selective engagement with two gears 47 and 39. In this embodiment, the releasing mechanism 593 is constituted by the supporting lever 587, the tension spring 590, the connecting member 595 and others.

Figure 65:
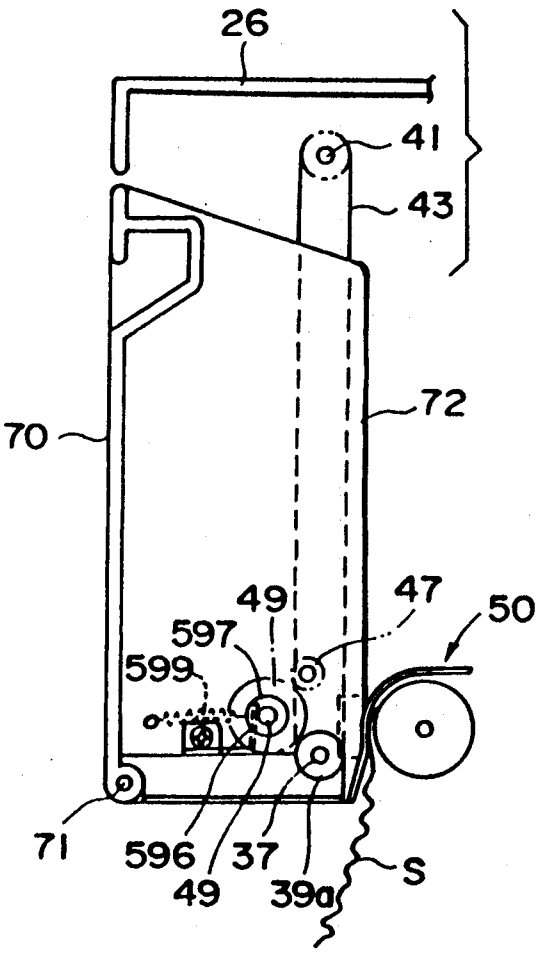
FIG. 65 is a sectional view of an apparatus according to a further embodiment of the present invention.
Figure 66:
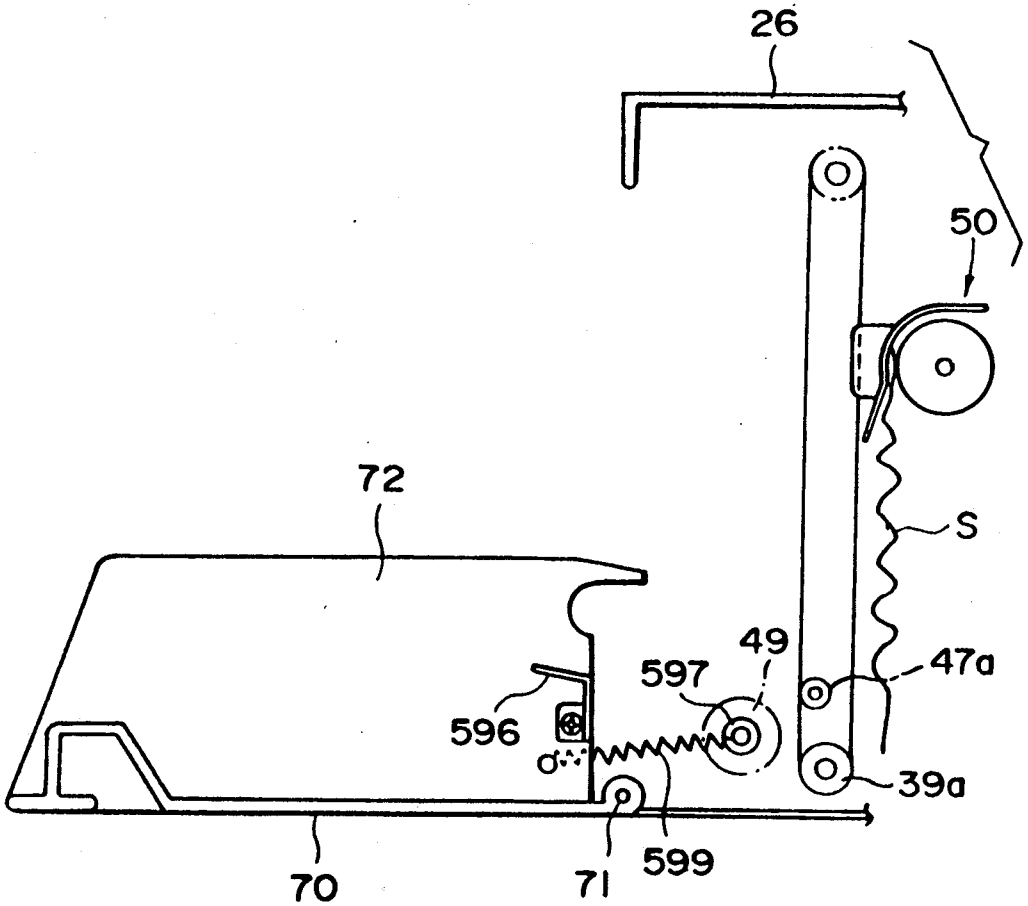
FIG. 66 illustrates operation of the same.

FIGS. 65 and 66 show a further modification, wherein the shaft 49a of the idle gear 49 is supported for movement back and forth (right-left direction in the Figure) relative to the supporting plate 45, as shown in FIG. 62. To a rear portion of the shaft 49a, a resilient member 596 having a base portion fixed to the rib 72 of the door 70 is press-contacted so as to press-contact the idler gear 49 to the driving pinion 47a and the gear 39a. An annular member 597 is mounted on the shaft 49a, and is urged toward a releasing mechanism 593 by a tension spring 599 having an end hooked with the rib 72. In this modified embodiment, the releasing mechanism 593 is constituted by the elastic member 596, the annular member 597, the tension spring 599 and others.

When the door 70 is closed as shown in FIG. 65, the releasing mechanism 593 and the tension spring 599 satisfy [resilient force of the resilient member 596<-spring force of the tension spring 599], and the difference therebetween is effective to urge the shaft 49a of the idle gear 49 to the gears 47a and 39a.

When the door 70 is opened as shown in FIG. 66, the shaft 49a moved slightly along a guide not shown on the supporting plate 49, and thereafter, is stopped by an end of the guide. The resilient member 596 is separated from the shaft 49a, and by the tension spring 599 pulling the shaft 49a through the annular member 597, the idle gear 49 is disengaged from the driving pinion 47a and the gear 39 in association with the opening of the door 70. By the non-establishment of the drive transmission by the drive transmission mechanism 586, the resistance against the manual vertical movement of the sheet discharge unit 50 is reduced so as to facilitate access to and handling of the jammed sheet in the sorter 5.

It is possible that the shaft 49a is loosely engaged to the annular member 587b as in the first mentioned embodiment for the jam clearance; the annular member 587b is mounted on the supporting plate 45 to make the shaft 49a movable back and forth, the shaft 49a is contacted to an end of the annular member 587b when the door 70 is opened, whereby the annular member 87b can be used also as a stopper for the opening of the door 70.

Figure 67:
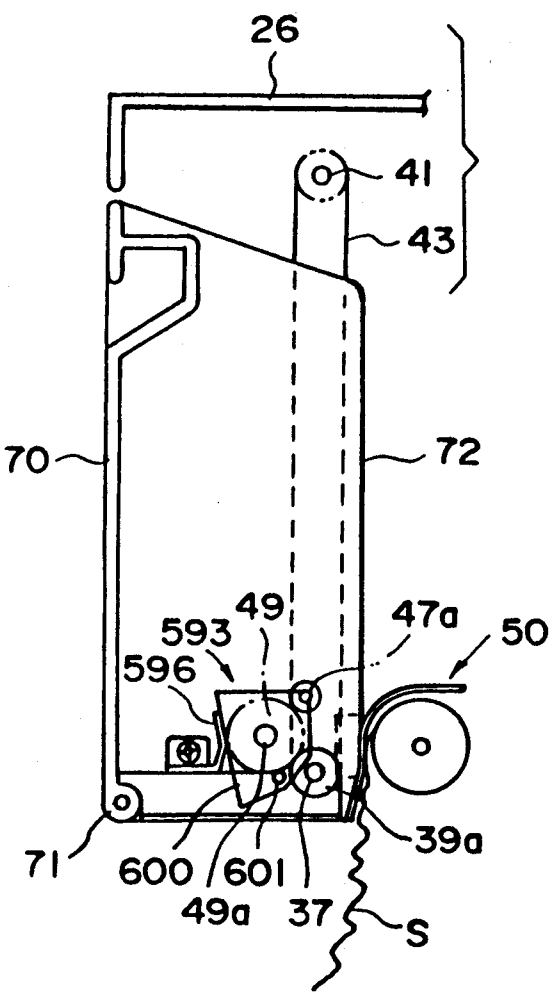
FIG. 67 is a sectional view of an apparatus according to a further embodiment of the present invention.
Figure 68:
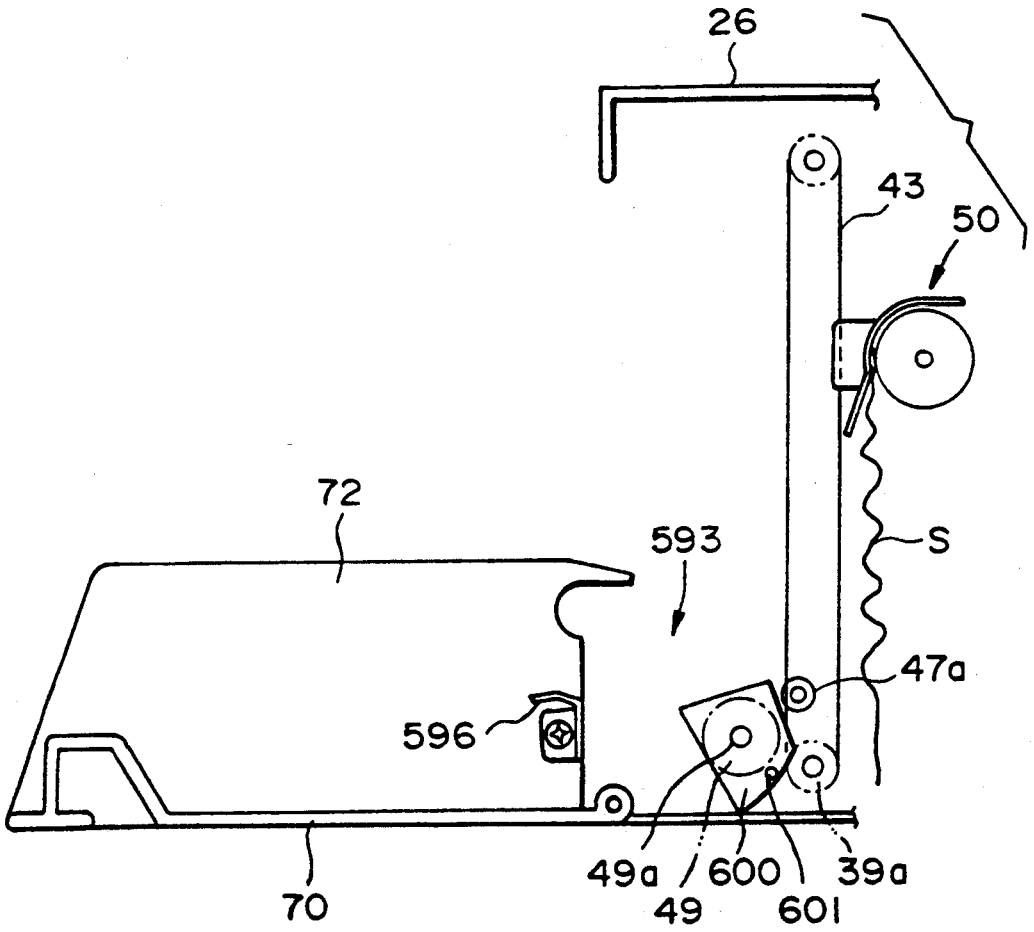
FIG. 68 illustrates operation of the same.

FIGS. 67 and 68 show a further modification, wherein the shaft 49a of the idle gear 49 is mounted on the gear box 600 for rotation, and the gear box 600 is rotatably mounted on the supporting plate 45 by a shaft 601. When the door 70 is closed, as shown in FIG. 67, the resilient member 596 of the rib 70 pushes the rear side of the gear box 600, by which the idle gear 49 is meshed with the driving pinion 47 and the gear 39a. In this embodiment, the releasing mechanism 593 is constituted by the gear box 600, the resilient member 596 and others.

When the door 71 is opened as shown in FIG. 68, the resilient member 596 is spaced from the gear box 600, by which the gear box 600 rotates by the weight of itself in the counterclockwise direction about the shaft 601 until it is stopped by the abutment with the frame of the sorter 5 as shown in FIG. 68. By the rotation of the gear box 600 and the idle gear 49, the idle gear 49 is disengaged from the driving pinion 47 and the gear 39a, so that the drive transmission by the drive transmission mechanism 586 is released. By this, the sheet discharge unit 50 (sheet discharging means) is manually movable to a desired position to facilitate the handling of the jammed sheet S.

In this modification, the tension spring is not used, but the weight of the gear box 600 is used to release the engagement of the idler gear 49, as contrasted to the second, third and fourth embodiments for the jam clearance, the cost of the sorter 5 can be reduced.

As described, according to those embodiments, when the door of the sorter 5 for the jam clearance is opened, the driving source for the drive transmission mechanism for vertically moving the sheet discharge unit (sheet discharging means) in the vertical direction become capable of being manually driven, and therefore, the sheet discharging means can be moved to a desired position without difficulty, whereby the sheet jammed in the sorter can be easily removed.

In addition, by establishing non-drive-transmission of the drive transmission mechanism for vertically moving the sheet discharge unit by a releasing mechanism operable in association with the opening operation of the door, only small force is required, despite the movement of the sheet discharging unit to the desired position is imparted from the driven side. Furthermore, the two actions of the door opening and the releasing of the drive transmission mechanism can be carried out by a single operation, whereby the jammed sheet is easy handled.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus having a sorter, comprising:

a plurality of bins for accommodating sheet materials, said bin each having sheet material receiving inlet portion;

discharging means movable along the inlet portions of said bins to discharge the sheet material to select one of said bins;

sheet material accommodating means other than said bins to accommodate the sheet materials;

directing means switchable to direct the sheet material selectively to said bin or to said sheet material accommodating means; and means for switching said directing means in mechanical interrelation with movement of said discharging means to direct the sheet material to said discharging means when said discharging means is at a position for discharging the sheet material to said bin, and direct the sheet material to said accommodating means when said discharging means is not at said position.

2. An apparatus according to claim 1, wherein said discharging means includes a pair of rotatable members.

3. An apparatus according to claim 2, further comprising means for guiding the sheet material from said directing means to said pair of rotatable members.

4. An apparatus according to claim 3, wherein said switching means is provided in said discharging means and acts on said directing means for its switching operation.

5. An apparatus according to claim 3, wherein the means for guiding the sheet material from said directing means to the pair of rotatable members includes a member expandable together with reciprocal displacement of the pair of rotatable members.

6. An apparatus according to claim 5, wherein the expandable member includes a resilient member.

7. An apparatus according to claim 5, wherein the expandable member includes a cover.

8. An apparatus according to claim 4, wherein said directing means includes a swingable member taking different positions between when it is pressed by said switching means and when it is not pressed thereby.

9. An apparatus according to claim 8, wherein said accommodating means is disposed at a top surface of the said image forming apparatus, and wherein said plurality of bins are disposed above said accommodating means as a unit.

10. An image forming apparatus having a sorter, comprising:

a plurality of bins for accommodating sheet materials, said bin each having sheet material receiving inlet portion;

discharging means movable along the inlet portions of said bins to discharge the sheet material to selected one of said bins;

sheet material accommodating means other than said bins to accommodate the sheet materials;

directing means switchable to direct the sheet materials selectively to said bin or to said sheet material accommodating means; and means for switching said directing means in mechanical interrelation with movement of said discharging means to direct the sheet material in said discharging means when said discharging means is opposed to a said bin, and to direct the sheet material to said accommodating means when said discharging means is not opposed to a said bin.

11. An image forming apparatus having a sorter, comprising:

a plurality of bins for accommodating sheet materials, said bins each having sheet material receiving inlet portion;

discharging means movable along the inlet portions of said bins to discharge the sheet material to selected one of said bins;

directing means switchable to direct the sheet material selectively to said bin or to other than said bins; and means for switching said directing means in mechanical interrelation with movement of said discharging means to direct the sheet material to said discharging means when said discharging means is at a position for discharging the sheet material to said bin, and to direct the sheet material to other than said bins when said discharging means is not at said position.

12. An image forming apparatus having a sorter, comprising:

a plurality of bins for accommodating sheet materials, said bin each having sheet material receiving inlet portion;

discharging means movable along the inlet portions of said bins to discharge the sheet material to selected one of said bins;

sheet material accommodating means other than said bins to accommodate the sheet materials;

directing means switchable to direct the sheet material selectively to said bin or to said sheet material accommodating means; and means for switching said guiding means in mechanical interrelation with movement of said discharging means to direct the sheet material to said discharging means in a sorting mode, and to direct the sheet material to said accommodating means in a non-sorting mode.

13. An image forming apparatus having a sorter, comprising:

discharging means for discharging sheet materials;

a plurality of bins for accommodating sheet materials, said bin each having sheet material receiving inlet portion;

sheet material accommodating means other than said bins to accommodate the sheet materials;

directing means switchable to direct the sheet material selectively to said bin or to said sheet material accommodating means; and means for switching said directing means in mechanical interrelation with relative movement between said discharging means and said bins to direct the sheet material to said discharging means when said bins are at a sorting mode position, and to direct the sheet material to said accommodating means when said bins are at a non-sorting mode position.

14. A sorter, comprising:

a plurality of bins for accommodating sheet materials, said bins each having sheet material receiving inlet portion;

discharging means movable along the inlet portions of said bins to discharge the sheet material to selected one of said bins;

directing means switchable to direct the sheet material selectively to said bin or to other than said bins; and means for switching said directing means in mechanical interrelation with movement of said discharging means to direct the sheet material to said discharging means when said discharging means is at a position for discharging the sheet material to said bin, and to direct the sheet material to other than said bins when said discharging means is not at said position.

15. An image forming apparatus having a sorter, comprising:

discharging means for discharging sheet materials;

a plurality of bins for accommodating sheet materials, and bins each having sheet material receiving inlet portion;

directing means switchable to direct the sheet material selectively to said bin or to other than said bins; and means for switching said directing means in mechanical interrelation with relative movement between said discharging means and said bins to direct the sheet material to said discharging means when said bins are at a sorting mode position, and to direct the sheet material to other than said bins when said bins are at a non-sorting mode position.

16. An image forming apparatus according to claim 15, comprising sheet material accommodating means other than said bins to accommodate the sheet materials;

wherein said sheet material receiving inlet portions are movable along said discharging means; and wherein said directing means is switchable to direct the sheet material selectively to said bins or to said sheet material accommodating means; and wherein said means for switching said directing means directs the sheet material to said accommodating means when said bins are at the non-sorting mode position.

17. An apparatus according to claim 16, wherein said discharging means includes a pair of rotatable members.

18. An apparatus according to claim 17, further comprising means for guiding the sheet material from said directing means to said pair of rotatable members.

19. An apparatus according to claim 18, wherein said switching means is provided in a bin unit constituted by said bins, and actable on said directing means for its switching operation.

20. An apparatus according to claim 19, wherein said directing means includes a swingable member taking different positions between when it is pressed by said switching means and when it is not pressed thereby.

21. An apparatus according to claim 20, wherein said accommodating means is disposed at a top surface of the said image forming apparatus, and wherein said plurality of bins are disposed above said accommodating means as a unit.

22. A sorter, comprising:

discharging means for discharging sheet materials;

a plurality of bins for accommodating sheet materials, said bins each having a sheet material receiving inlet portion;

directing means switchable to direct the sheet material selectively to said bin or to other than said bins; and means for switching said directing means in mechanical interrelation with relative movement between said discharging means and said bin to direct the sheet material to said discharging means when said bins are at sorting mode position, and to direct the sheet material to other than said bins when said bins are at a non-sorting mode position.

23. A sorter according to claim 22, wherein said sheet material receiving inlet portions are movable along said discharging means.

* * * * *

UNITED STATES PATENT AND TRADEMARK OFFICE

CERTIFICATE OF CORRECTION

PATENT NO. : 5,154,411
DATED : October 13, 1992
INVENTOR(S) : Saito, et. al.

It is certified that error appears in the above-indentified patent and that said Letters Patent is hereby corrected as shown below:

On the Title page, item [57] Abstract, Line 3, "bin" should read --bins--.

Column 4
Line 4, "plan views" should read --plan view--.

Column 7
Line 14, "member 69" should read --member 69'--.
Line 18, "plate 69'" should read --plate 69"--.
Line 19, "plate 69'" should read --plate 69"--.
Line 42, "another examples" should read --another example--.
Line 52, "another examples" should read --another example--.

Column 9
Line 3, "(FIG. 22" should read --(FIG.22)--.
Line 12, "at shown" should read --as shown--.

Column 12
Line 34, "$b_{min} \geq 0.4$ x" should read --$b_{min} \geq 0.4xa$--

UNITED STATES PATENT AND TRADEMARK OFFICE

CERTIFICATE OF CORRECTION

PATENT NO. : 5,154,411

DATED : October 13, 1992

INVENTOR(S) : SAITO et al.

It is certified that error appears in the above-identified patent and that said Letters Patent is hereby corrected as shown below:

COLUMN 15

Line 23, "poping" should read --popping--.

COLUMN 16

Line 62, ", The" should read --, the--.

COLUMN 17

Line 49, "is slide" should read --is slid--.

Line 65, "unit" should read --units--.

COLUMN 19

Line 21, "pinon" should read --pinion--.

COLUMN 20

Line line 28, "87b" should read --587b-- .

Line 36, "rib 70" should read --rib 72--.

COLUMN 21

Line 22, "said bin" should read --said bins--.

UNITED STATES PATENT AND TRADEMARK OFFICE

CERTIFICATE OF CORRECTION

PATENT NO. : 5,154,411 Page 3 of 3

DATED : October 13, 1992

INVENTOR(S) : SAITO et al.

It is certified that error appears in the above-identified patent and that said Letters Patent is hereby corrected as shown below:

COLUMN 22

Line 52, "guiding" should read --directing--.

Line 42, "said bin" should read --said bins--

Signed and Sealed this

First Day of February, 1994

Bruce Lehman

*Attest:*

BRUCE LEHMAN

*Attesting Officer*

*Commissioner of Patents and Trademarks*